US006810225B2

(12) United States Patent
Kitano et al.

(10) Patent No.: US 6,810,225 B2
(45) Date of Patent: Oct. 26, 2004

(54) CONDUCTIVE MEMBER AND ELECTROPHOTOGRAPHIC APPARATUS INCORPORATING THE CONDUCTIVE MEMBER

(75) Inventors: Hajime Kitano, Kodaira (JP); Gaku Yakushiji, Higashiyamato (JP)

(73) Assignee: Bridgestone Corporation, Tokyo (JP)

( * ) Notice: Subject to any disclaimer, the term of this patent is extended or adjusted under 35 U.S.C. 154(b) by 73 days.

(21) Appl. No.: 10/191,494

(22) Filed: Jul. 10, 2002

(65) Prior Publication Data

US 2003/0118372 A1 Jun. 26, 2003

(30) Foreign Application Priority Data

| | | |
|---|---|---|
| Jul. 11, 2001 | (JP) | 2001-211237 |
| Aug. 30, 2001 | (JP) | 2001-261154 |
| Sep. 19, 2001 | (JP) | 2001-284856 |
| Sep. 20, 2001 | (JP) | 2001-286680 |
| Sep. 20, 2001 | (JP) | 2001-286750 |
| Nov. 1, 2001 | (JP) | 2001-336258 |
| Nov. 1, 2001 | (JP) | 2001-336260 |
| Nov. 1, 2001 | (JP) | 2001-336261 |
| Nov. 1, 2001 | (JP) | 2001-336262 |
| Nov. 1, 2001 | (JP) | 2001-336263 |
| Nov. 1, 2001 | (JP) | 2001-336264 |
| Nov. 1, 2001 | (JP) | 2001-336265 |
| Nov. 1, 2001 | (JP) | 2001-336266 |
| Nov. 1, 2001 | (JP) | 2001-336268 |
| Nov. 1, 2001 | (JP) | 2001-336269 |

(51) Int. Cl.[7] ..... G03G 15/02; G03G 15/08; G03G 15/16; G03G 21/00

(52) U.S. Cl. ..... 399/176; 399/279; 399/313; 399/357

(58) Field of Search ..... 399/176, 279, 399/313, 357

(56) References Cited

U.S. PATENT DOCUMENTS

| | | | | |
|---|---|---|---|---|
| 3,152,012 A | | 10/1964 | Schaffert | |
| 3,731,146 A | | 5/1973 | Bettiga | |
| 4,707,408 A | * | 11/1987 | Iwasawa et al. | 399/357 |
| 5,659,854 A | * | 8/1997 | Masuda et al. | 399/176 |
| 5,982,606 A | * | 11/1999 | Masuda et al. | 399/176 |
| 6,175,709 B1 | * | 1/2001 | Takagi et al. | 399/279 |
| 6,293,895 B1 | * | 9/2001 | Koyama et al. | 399/176 |
| 6,312,792 B1 | * | 11/2001 | Okada et al. | 399/176 |
| 6,317,574 B1 | * | 11/2001 | Shinohara et al. | 399/176 |
| 6,393,243 B1 | * | 5/2002 | Satoh et al. | 399/279 |
| 6,400,919 B1 | * | 6/2002 | Inoue et al. | 399/176 |
| 6,579,473 B1 | * | 6/2003 | Yamada et al. | 399/176 |

FOREIGN PATENT DOCUMENTS

| | | |
|---|---|---|
| JP | 7-310732 | 11/1995 |
| JP | 7-311493 | 11/1995 |

* cited by examiner

*Primary Examiner*—Fred L. Braun
(74) *Attorney, Agent, or Firm*—Sughrue Mion, PLLC

(57) ABSTRACT

The present invention provides a conductive member used for a charging unit a development unit, a transfer unit, and a cleaning unit, which are used for electrophotographic apparatus or an electrostatic recording process. The conductive member includes an elastic layer and a resin layer, wherein the resin layer is formed on the outer side of the elastic layer directly or indirectly via another layer. When the surface of the resin layer being in a state not containing any conductive agent is charged due to corona discharge generated by applying a voltage of 8 kV to a corona discharger disposed with a gap of 1 mm put between the surface of the resin layer and the corona discharger, a surface potential of the resin layer after an elapse of 0.3 sec is in a range of 50 V or less and a surface potential of the resin layer after an elapse of 10 sec is in a range of 5 V or less. The present invention also provides an electrophotographic apparatus including a charging unit, a development unit, a transfer unit, and a cleaning unit, each of which uses the conductive member.

38 Claims, 5 Drawing Sheets

Fig. 1-A
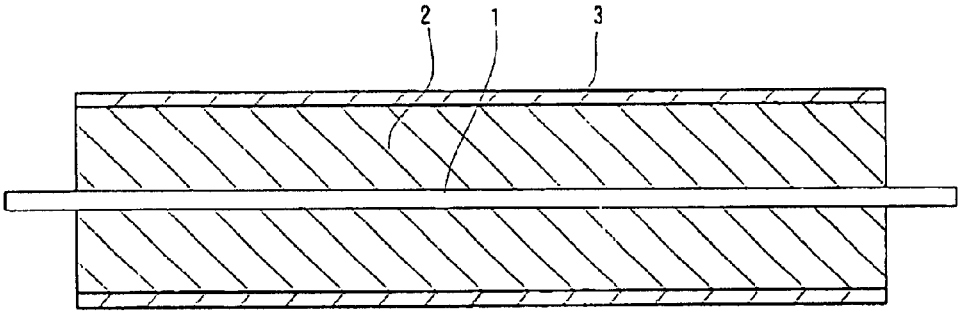
Fig. 1-B
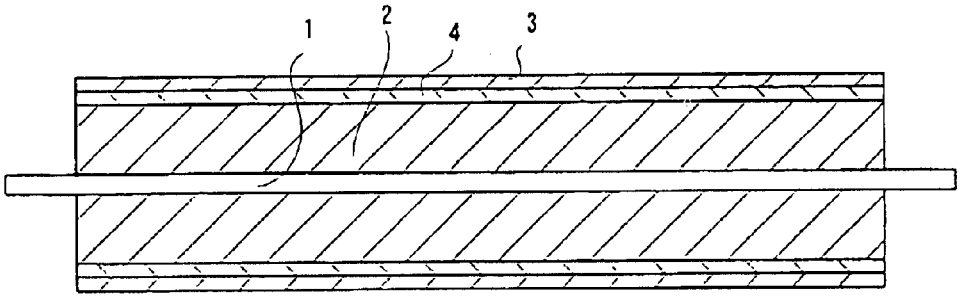

CONDUCTIVE MEMBER AND ELECTROPHOTOGRAPHIC APPARATUS INCORPORATING THE CONDUCTIVE MEMBER

BACKGROUND OF THE INVENTION

The present invention relates to a conductive member used for a charging unit, a development unit, a transfer unit, and a cleaning unit, which are used for electrophotographic apparatus or an electrostatic recording process, and an electrophotographic apparatus including a charging unit, a development unit, a transfer unit, and a cleaning unit, each of which uses the conductive member.

An electrophotographic apparatus or an electrostatic recording apparatus, such as a copying machine, a facsimile, or a printer is operated in accordance with a printing method, which includes a charging step of uniformly charging the surface of a photosensitive body, an electrostatic latent image forming step of projecting an image from an optical system to the photosensitive body, to erase charges in a portion irradiated with light, thereby forming an electrostatic latent image, a development step of sticking toner on the latent image, to form a toner image, and a transfer step of transferring the toner image to a recording medium such as a paper sheet.

In this printing process, the initial step of charging a photosensitive body has been generally performed by using a corona discharging method. The corona discharging method, however, is undesirable from the viewpoints of safety and maintenance of the apparatus because the corona discharging method needs the supply of a high voltage such as 6 to 10 kV. The corona discharging method also presents an environmental problem because a hazardous substance such as ozone or NOx occurs during discharge of corona.

To solve the above problems, various attempts have been made to develop a new charging method capable of performing charging at a voltage lower than that required for the corona discharging method and suppressing occurrence of a hazardous substance such as ozone. For example, a contact type charging method shown in FIG. 3 has been proposed as an alternative to the corona charging method. Referring to FIG. 3, a roller-shaped charging member (charging roller) 14, to which a voltage has been applied from a power source 16, is brought into contact with a body 15 to be charged such as a photosensitive body at a specific pressure, to thereby charge the body 15 to be charged.

With respect to the development step, as a development method of supplying a non-magnetic one-component developer to a photosensitive drum or the like on which a latent image has been formed, to stick the developer to the latent image on the photosensitive drum, thereby visualizing the latent image, a pressure development method has been known, for example, from U.S. Pat. Nos. 3,152,012 and 3,731,146. This pressure development method can eliminate the need of use of any magnetic material, and is thereby advantageous in simplifying the structure of the apparatus and easily reducing the size of the apparatus, and further easily realizing development using a plurality of kinds of colored toner.

Referring to FIG. 2, the pressure development method is performed by bringing a development roller 6, on which toner (non-magnetic one-component developer) has been supported, into contact with a latent image support 5 such as a photosensitive drum on which an electrostatic latent image has been formed, to stick the toner to the latent image on the latent image support 5, thereby developing the latent image. Accordingly, the development roller 6 must be rotated while certainly holding the state that the development roller 6 is brought into close-contact with the latent image support 5 such as a photosensitive drum, and therefore, the development roller 6 is required to be made from a conductive elastic body.

A transfer unit, used in the transfer step, for transferring a toner image, which has been developed with toner for visualization, from a latent image support to a transfer medium such as a paper sheet, has been generally configured to transfer a toner image to a transfer medium by charging the transfer medium with the use of a corona charger. The corona discharge, however, has the above-described problems associated with occurrence of ozone and the need of a high voltage power source. To solve such problems, there has been known a transfer unit shown in FIG. 2, wherein a transfer medium 8 is charged by using a bias roller (transfer roller) 9 made from a conductive rubber. In this method, to enhance the transfer efficiency and obtain a uniform transfer image, it is required to set a specific nip width between the transfer roller 9 and a photosensitive drum 5 and reduce a pressure applied between the roller and the drum, and to meet such a requirement, a very soft conductive rubber must be used as the material forming the transfer roller 9. It is to be noted that, as shown in FIG. 2, the toner image transferred to the transfer medium 8 is heated by a fixing unit 13 to be thus fixed to the transfer medium 8.

After transfer of a toner image, toner remaining on a photosensitive drum is removed by a cleaning unit. Such a cleaning unit has been generally configured to scrape toner by an edge of a blade made from a urethane rubber or the like pressed on a photosensitive body. The use of the blade, however, has a problem that since a large frictional force occurs against a photosensitive body, a drive force becomes large, the photosensitive drum is liable to be damaged by the edge of the blade, and in the worst case, the cleaning operation becomes impossible because of damage of the rubber blade. To solve such a problem, a cleaning unit 12 using a cleaning roller 11 to which a voltage is applicable (see FIG. 2) has been proposed, wherein residual toner is directly removed from the surface of the photosensitive drum 5 by the cleaning roller 11. Alternatively, a cleaner-less method has been proposed, in which toner is forcibly charged and then recovered by a development roller or the like. In the case of adopting the cleaning method using the cleaning unit 12, the cleaning roller 11 constituting the cleaning unit 12 also requires the same characteristics as those required for the transfer roller.

The above-described charging roller, development roller, transfer roller, or cleaning roller has been configured as a conductive member obtained by forming a resin layer on the surface of an elastic layer such as a rubber material or a urethane form. The formation of the resin layer is for ensuring a surface smoothness, adjusting a surface resistance, and improving a charging characteristic. The resin layer is typically formed by coating the elastic layer with a solution of a resin selected from an acrylic resin, a urethane resin, nylon, a polyethylene resin, an epoxy resin, a polyester resin, a polyether resin, a polystyrene resin, a phenol resin, an ABS resin, a polyamide resin, and a urethane modified acrylic resin by a dipping method or a spraying method.

The above-described conventional conductive member, however, has the following problems:

Initial Fog/Fog after Repeated Printing

In the recent electrophotographic field, there have been strong demands to enhance the image quality, lower the cost (lower the voltage or reduce the size of a member), increase the operational speed, and improve the durability, and to meet such demands, attempts have been made to improve electrophotographic apparatuses. These apparatuses thus improved to meet the above-described demands, however, may often cause a problem associated with initial image defects (such as initial fog) and image defects after repeated printing (such as fog after repeated printing) due to the effect of a conductive member used for a charging roller, a development roller, a transfer roller, or a cleaning roller. The reason why the image defects such as fog occur due to the effect of the conductive member, however, has not been basically revealed, and at the present time, any countermeasure capable of sufficiently solving such a problem has not been proposed yet.

Adhesiveness to Photosensitive Body (OPC)

A conductive member used for a charging roller, a development roller, a transfer roller, or a cleaning roller is put for a long time in the state being in contact with a photosensitive body represented by an organic photoconductor (OPC), so that adhesion (stickiness) may occur between the photosensitive body and the surface of the conductive member, resulting in peeling of a coating film from the surface of the conductive member or contamination of the photosensitive body. In particular, to meet the recent requirement for electrophotographic apparatuses to be usable in various environments, it has been strongly required to develop a conductive member (particularly, a resin layer on the surface thereof) excellent in anti-adhesiveness to a photosensitive body, that is, relesability from the photosensitive body even under a severe condition in terms of temperature and humidity.

Trace of Contact Portion (Nip Mark)

Since a conductive member is put for a long time in the state being in contact with a photosensitive body as described above, a trace of the contact portion (nip mark) therebetween may remain on the conductive member under a severe condition in terms of temperature and humidity, to cause a problem that the trace may appear in an image periodically in the rotation direction of the conductive member. In particular, the problem becomes significant for a charging roller used for the contact type charging method.

SUMMARY OF THE INVENTION

In view of the foregoing, the present invention has been made, and an object of the present invention is to provide a conductive member capable of solving the above-described problems associated with the [initial fog/fog after repeated printing], [adhesiveness to OPC], and [nip mark], thereby certainly performing, even under a severe condition, desirable charging, development, transfer, and cleaning operations to stably obtain desirable images, and to provide an electrophotographic apparatus using the conductive member.

The present inventors have studied to develop a conductive member used for a charging roller, a development roller, a transfer roller, or a cleaning roller, which member is capable of achieving the above object, and found that the above object can be achieved, as will be described below, by providing a conductive member including an elastic layer and at least one resin layer formed on the elastic layer, wherein the surface charge potential characteristic of the outermost resin layer is specified as follows: namely, when the surface of the outermost resin layer being in a state not containing any conductive agent is charged due to corona discharge generated by applying a voltage of 8 kV to a corona discharger disposed with a gap of 1 mm put therebetween, a surface potential after an elapse of 0.3 sec is in a range of 50 V or less and a surface potential after an elapse of 10 sec is in a range of 5 V or less.

Initial Fog/Fog after Repeated Printing

As a result of examination made by the present inventors, it has been found that the above-described [initial fog/fog after repeated printing] is mainly dependent on the resin layer of the conductive member, particularly, on the outermost resin layer. In particular, it has been found that the occurrence of the [initial fog] can be significantly prevented by specifying the surface charge potential characteristic of the outermost resin layer such that the surface potential after an elapse of 0.3 sec is in a range of 50 V or less and the surface potential after an elapse of 10 sec is in a range of 5 V or less. It is to be noted that the measurement of the surface charge potential characteristic is, as described above, performed by charging the surface of the outermost resin layer (which is in a state not containing any conductive agent) due to corona discharge generated by applying a voltage of 8 kV to a corona discharger disposed with a gap of 1 mm put therebetween. With respect to the [fog after repeated printing], it has been found that in the case where the occurrence of initial fog is prevented, although occurrence of fog after repeated printing cannot be perfectly prevented, the degree of fog after repeated printing becomes significantly smaller than that in the case where the initial fog occurs.

Meanwhile, it has been also found that, to prevent occurrence of the [fog after repeated printing], not only the above surface charge potential characteristic but also the toner adhesion property and friction property of the outermost resin layer of the conductive member become important. To be more specific, if the degree of adhesion of toner on the conductive member such as a charging roller, a development roller, a transfer roller, or a cleaning roller becomes large or if the toner adhering on the conductive member is less removed, a film-like toner layer is formed on the conductive member or the toner is fused thereon, to damage the surface of the conductive member, thereby leading to fog. On the other hand, if the friction property of the outermost resin layer is high, a shear stress between a photosensitive body and the outermost resin layer becomes excessively large, to damage the surface of the outermost resin layer by sagging, wrinkle, or piercing, thereby leading to occurrence of fog. From this viewpoint, the present inventors have further examined and found that the occurrence of the [fog after repeated printing] can be significantly effectively suppressed by specifying the friction property of the conductive member such that a friction coefficient of the conductive member is in a range of 1 or less, wherein the friction coefficient is measured by bringing the conductive member in press-contact with a cloth of 70 mesh containing 100% of cellulose (density: 30 g/m$^2$) at a load of 100 gf and sliding the conductive member against the cloth.

By the way, the reason why the surface potential characteristic using corona discharge is taken as an index for evaluating the degree of fog is as follows. The phenomenon "fog", which is a so-called image defect, occurs due to a mechanical, environmental, or electrical failure, or a failure of a charging roller, a development roller, a transfer roller, or a cleaning roller. Of these causes, the major one common to all of the rollers is an electrical failure due to surface remaining charges. To be more specific, each of these rollers plays a role when a voltage is applied thereto, and if charges remain on the roller in a state that no voltage is applied to the roller, electrical ununiformity may occur on the roller when a voltage is next applied to the roller. The electrical ununiformity on the conductive roller may cause critical image defect, that is, fog such as "a white spot", "a black spot", "a lateral streak", or "longitudinal streak". Accordingly, it is required to make charges remaining on the surface of the roller as small as possible. For this reason, the ability of preventing occurrence of the "fog" can be evaluated by using the surface charge attenuation characteristic accompanied by surface potential measurement using corona discharge, and according to the present invention, such a surface charge attenuation characteristic is evaluated and adjusted.

In general, a voltage is applied to a charging roller by supplying the voltage to a shaft of the charging roller, and in this case, it is required that at the moment of supplying the voltage, charges migrate to the surface of the charging roller, to charge a photosensitive body. If such an ability is insufficient, the photosensitive body cannot be sufficiently charged, to cause an image defect, particularly, fog. This charging ability has a relation with an electrostatic capacity and resistance of the roller, but it cannot be sufficiently correlated therewith. As a result of examination of such a charging ability, made by the present inventors, it has been found that the charging ability can be substantially linearly evaluated by measuring a responsiveness to charges on the surface of a charging roller, that is, a surface potential due to corona discharge.

The reason why the charge potential characteristic is evaluated in the state that the outermost resin layer does not contain any conductive agent is as follows. In general, a conductive roller such as a charging roller, a development roller, a transfer roller, or a cleaning roller has a resistance distribution that the resistance becomes higher in the direction from the shaft to the outer layer, and such a resistance distribution has a relation with an anti-leakage performance, a charging performance of toner, and the like. Accordingly, the charge permeability of surface charges of the roller is substantially dependent on only the surface layer. By the way, the surface layer of the roller often contains a conductive agent. In this case, the conductive agent may contribute to the removal of the surface charges to some extent; however, if the conductive agent is a filler in the form of particles, the particles of the filler are little in contact with each other from the microscopic viewpoint, with a result that the stay of the charges in a resin of the surface layer cannot be perfectly eliminated. Eventually, unless the resin of the surface layer has an excellent charge permeability, a perfect state with no residual charges cannot be obtained by the presence of the filler. On the other hand, if the conductive agent is an ionic conductive agent, since a concentration gradient of the ionic conductive agent occurs in the resin of the surface layer, the surface layer has portions in which the ionic conductive agent is little present. Eventually, like the case of using a filler as a conductive agent, the charge permeability of the resin of the surface layer becomes important. Accordingly, the charge permeability of the resin of the outermost resin layer becomes the most important parameter, and therefore, it becomes reasonable to evaluate the surface potential characteristic in the state that the outermost resin layer does not contain any conductive agent.

With respect to the charging operation, as a result of examination made by the present inventors, it has come to be revealed that the image characteristic, particularly, fog is greatly dependent on the charging characteristic of a charging roller, particularly, on the charging characteristic of the outermost resin layer of the charging roller. In this case, it is reasonable to evaluate the charging characteristic of a resin of the outermost resin layer formed on the surface of the charging roller. In other words, it is undesirable to evaluate the charging characteristic of the outermost resin layer containing other components such as a conductive agent. In this way, the charge potential characteristic must be evaluated in the state that the outermost resin layer does not contain any conductive agent.

The reason why the charging potential after an elapse of 10 sec since charging by corona discharge is evaluated is as follows. In this evaluation test, a large voltage such as 8 kV generated by corona discharge is supplied to the surface of a conductive roller by corona discharge (note: the voltage applied to the conductive roller is regarded to be smaller than 8 kV); however, in general, such a large voltage is not supplied to the conductive roller of an actual apparatus. In this evaluation test, the above-described large voltage is supplied to the conductive roller from the viewpoints of measurement accuracy, repeatability, and measurement method. Taking into account the above circumstances, according to the present invention, the surface potential after an elapse of 10 sec, which is required to release the charges given by applying such a large voltage, is evaluated. Additionally, experience has showed that this evaluation is reasonable.

Adhesiveness to OPC

The problem associated with the [adhesiveness to OPC] can be solved, as described above, by enhancing the releasability of a conductive member, and as a result of examination made by the present inventors, it has been found that it is possible to effectively solve the problem associated with the [adhesiveness to OPC] and hence to effectively prevent occurrence of inconveniences such as peeling of a film and contamination of a photosensitive body by setting the contact angle between the surface of a conductive member, that is, the surface of the outermost resin layer and water to a value in a range of 90° or more.

Nip Mark

The problem associated with the [nip mark] is greatly dependent on a dynamic characteristic of the outermost resin layer forming the surface of a conductive member, and as a result of examination of this point, it has been found that the problem associated with the [nip mark] can be solved by optimizing the physical characteristic of the outermost resin layer forming the surface of the conductive member. Specifically, it has been found that the problem associated with the [nip mark] can be solved by setting the physical characteristic of the outermost resin layer such that after the outermost resin layer is stretched to a length being 1.5 times the original length under an environment with a temperature of 40° C. and a humidity of 95% RH and is left for one day in such a state, a residual elongation of the outermost resin layer is in a range of 50% or less.

Accordingly, the present invention provides a conductive member used for an electrophotographic apparatus, including an elastic layer and at least one resin layer formed on the elastic layer, wherein when the surface of the outermost resin layer of the at least one resin layer, which outermost resin layer is in a state not containing any conductive agent, is charged due to corona discharge generated by applying a voltage of 8 kV to a corona discharger disposed with a gap of 1 mm put between the surface of the outermost resin layer and the corona discharger, a surface potential of the outermost resin layer after an elapse of 0.3 sec is in a range of 50 V or less and a surface potential of the outermost resin layer after an elapse of 10 sec is in a range of 5 V or less.

The present invention also provides, as preferable embodiments of the above-described conductive member, the following members (1) to (3):

(1) a conductive member, wherein a friction coefficient of the conductive member, which is measured by bringing the conductive member in press-contact with a cloth of 70 mesh containing 100% of cellulose (density: 30 g/m$^2$) at a load of 100 gf and sliding the conductive member against the cloth, is in a range of 1 or less, particularly, 0.5 or less;

(2) a conductive member, wherein a contact angle between the surface of the outermost resin layer and water is in a range of 90° or more; and (3) a conductive member, wherein a residual elongation of the resin material forming the outermost resin layer is specified such that when a film made from the resin material and having the same thickness as that of the outermost resin layer is stretched to a length being 1.5 times the original length under an environment with a temperature of 40° C. and a humidity of 95% RH and is left for one day in such a state, a residual elongation of the film is in a range of 50% or less.

The present invention also provides, as electrophotographic apparatuses using the above-described conductive member, the following electrophotographic apparatuses (1) to (4):

(1) an electrophotographic apparatus including a charging unit including a charging member to be brought into contact with a body to be charged for charging the body to be charged, and means for applying a voltage between the body to be charged and the charging member, wherein the charging member of the charging unit is configured as the conductive member of the present invention:

(2) an electrophotographic apparatus including a development unit operated to support a developer on the surface of the conductive member of the present invention so as to form a thin film of the developer, and bring the conductive member into contact with a latent image support on the surface of which an electrostatic latent image has been formed so as to stick the developer on the electrostatic latent image formed on the surface of the latent image support, thereby visualizing the electrostatic latent image;

(3) an electrophotographic apparatus including a transfer unit operated to charge a transfer medium by using the conductive member of the present invention, visualize an electrostatic latent image by a developer, and transfer the developer from the visualized electrostatic latent image to the transfer medium; and (4) an electrophotographic apparatus including a cleaning unit operated to remove a developer remaining on a latent image support by using the conductive member of the present invention.

BRIEF DESCRIPTION OF THE DRAWINGS

FIG. 1-A is a schematic sectional view showing one example of a conductive member according to the present invention;

FIG. 1-B is a schematic sectional view showing another example of the conductive member according to the present invention;

DETAILED DESCRIPTION OF THE INVENTION

Figure 2:
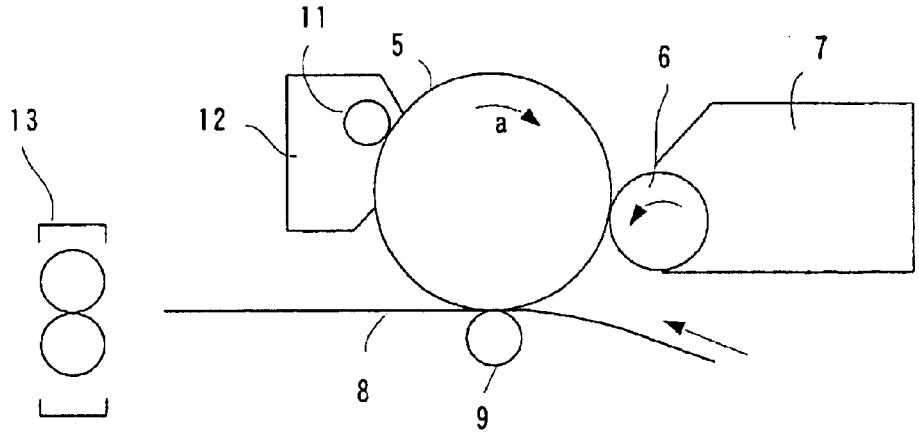
FIG. 2 is a schematic view showing one example of an electrophotographic apparatus according to the present invention.

The present invention will be hereinafter described in more detail.

The conductive member of the present invention includes, as described above, an elastic layer and at least one resin layer formed on the elastic layer. The conductive member can be formed into a shape selected from a roll shape, a plate shape, a block shape, a spherical shape, a brush shape, and the like, and in general, the conductive member is preferably formed into a roll shape. The conductive member formed into a roll shape is exemplified by those shown in FIGS. 1(A) and 1(B), wherein the conductive member is produced by forming an elastic layer 2 around the outer periphery of a shaft 1, and forming one or two or more resin layers (in this embodiment, the layer 3 or the layers 3 and 4) on the outer side of the elastic layer 2. The shaft 1 may be made from a metal or plastic material. It is to be noted that the shaft 1 can be omitted depending on the application and configuration of the conductive member and on the mechanism of an apparatus including the conductive member.

An elastic body for forming the elastic layer 2 may be, while not particularly limited thereto, any elastic body capable of ensuring a good contact state with a counterpart such as a photosensitive drum or a transfer paper sheet. For example, the elastic body may be a known rubber, a known resin, or a foaming body (hereinafter, referred to as "foam") thereof. More specifically, the elastic body is exemplified by a rubber composition containing a basic rubber component such as polyurethane, silicone rubber, butadiene rubber, isoprene rubber, chloroprene rubber, styrene-butadiene rubber, ethylene-propylene rubber, ethylene-propylene diene rubber, polynorbornene rubber, styrene-butadiene-styrene rubber, epichlorohydrin rubber, acrylic rubber, nitrile rubber, butyl rubber, or natural rubber. Among these rubber components, while not particularly limited thereto, a preferable rubber is polyurethane, and a more preferable rubber is a polyurethane foam having a foaming magnification of 1.5 to 5 times. In the case of using a polyurethane foam, the density thereof is preferably in a range of 0.05 to 0.9 g/cm$^3$.

The resistance of the elastic layer 2 can be set to a specific value by imparting conductivity to the elastic layer 2 or adjusting the conductivity of the elastic layer 2. The impartment or adjustment of the conductivity may be made by adding a conductive agent to the elastic layer 2. The conductive agent is not particularly limited but may be selected from cationic surface active agents, anionic surface active agents, amphoteric surface active agents, anti-static agents, ionic conductive agents, carbon materials, metals and metal oxides, and conductive polymers. Examples of the cationic surface active agents include quaternary ammonium salts such as a perchlorate, a chlorate, a hydroborofluoride, a sulfate, an ethosulfate, a benzyl halide (for example, benzyl bromide or benzyl chloride) of lauryl trimethylammonium, stearyl trimethylammonium, octadodecyl trimethylammonium, dodecyl trimethylammonium, hexadecyl trimethylammonium, or modified fatty acid-dimethylethylammonium. Examples of the anionic surface active agents include an aliphatic sulfonate, a higher alcohol sulfate, a higher alcohol sulfate added with ethylene oxide, a higher alcohol phosphate, and a higher alcohol phosphate added with ethylene oxide. Examples of the amphoteric surface active agents include various betaines. Examples of the anti-static agents include non-ionic anti-static agents such as a higher alcohol ethylene oxide, a polyethyleneglycol fatty acid ester, and a polyhydric alcohol fatty acid ester. Examples of the ionic conductive agents include a salt of a group I metal such as $Li^+$, $Na^+$, or $K^+$, for example, $LiCF_3SO_3$, $NaClO_4$, $LiAsF_6$, $LiBF_4$, NaSCN, KSCN, or NaCl; an electrolyte composed of a salt such as $NH_4^+$; a salt of a group II metal such as $Ca^{2+}$ or $Ba^{2+}$, for example, $Ca(ClO_4)_2$; the above metal salt or electrolyte having one or more of a hydroxyl group, a carboxyl group, or a primary or secondary amine group containing active hydrogen reacting with isocyanate; a complex of the above metal salt or electrolyte and a polyhydric alcohol (for example, 1,4-butanediol, ethylene glycol, polyethylene glycol, propylene glycol, or the like) or its derivative; and a complex of the above metal salt or electrolyte and a monool such as ethyleneglycol monomethylether, or ethyleneglycol monoethylether. Examples of the conductive carbon materials include a conductive carbon material such as ketchen black or acetylene black; a rubber carbon material such as SAF, ISAF, HAF, FEF, GPF, SRF, FT or MT; and oxidized carbon for color (ink), pyrolytic carbon, natural graphite, or artificial graphite. Examples of the metals and metal oxides include tin oxide doped with antimony, titanium oxide, zinc oxide, nickel, copper, silver, and germanium. Examples of the conductive polymers include polyaniline, polypyrrole and polyacetylene. The content of the conductive agent is not particularly limited but may be suitably selected depending on the kind of the composition or the conductive agent, and in general, the content of the conductive agent may be adjusted such that the volume resistivity of the elastic layer 2 is in a range of $1\times10^0$ to $1\times10^8$ Ω·cm, preferably, in a range of $1\times10^2$ to $1\times10^6$ Ω·cm.

The thickness of the elastic layer 2 is not particularly limited but may be suitably set depending on the kind and configuration, size and layer structure of the conductive member; however, in the case of using the roll-shaped conductive member shown in FIGS. 1(A) and 1(B), the thickness of the elastic layer 2 may be set in a range of 2 to 30 mm, preferably, about 3 to 20 mm.

The conductive member of the present invention is produced by forming at least one resin layer (in this embodiment, the layer 3 or the layers 3 and 4) on the outer side of the elastic layer 2. Of these resin layers 3 and 4, the outermost resin layer 3 forming the surface of the conductive member is made from a resin having a property not imparting contamination or causing adhesion to a counterpart being in contact therewith. Examples of the resins used for forming the outermost resin layer 3 include a polyester resin, a polyether resin, a fluororesin, a fluorine compound, an epoxy resin, an amino resin, a polyamide resin, an acrylic resin, a urethane modified acrylic resin, an acrylic silicon resin, a urethane resin, an alkyd resin, a phenol resin, a melamine resin, an urea resin, a silicone resin, a polyvinylbutyral resin, a fluorine-containing acrylic monomer, and a polysiloxane. These materials may be used singly or in combination of two kinds or more.

A crosslinking structure may be introduced in the outermost resin layer 3, as needed, in order to improve the dynamic strength and durability of the outermost resin layer 3. The crosslinking agent may be suitably selected depending on the resin molecular structure of the resin layer 3. Concretely, melamine, isocyanate, epoxy, carbodiimide, or oxazoline may be used as the crosslinking agent. Various other additives may be further added to the outermost resin layer 3 in a suitable amount, as needed.

The resin material suitable for forming the outermost resin layer 3 may be selected from, while not particularly limited to, those having the following compositions:

(A) a resin material containing, as a basis resin component, a resin containing 0.05 to 80 wt % of fluorine-containing acrylic monomers;

(B) a resin material containing 50 wt % or more of a polyamide resin and 50 wt % or less of a polysiloxane component;

(C) a resin material containing 50 wt % or more of a urethane modified acrylic resin and 50 wt % or less of a fluororesin component and/or a fluorine compound component;

(D) a resin material containing 50 wt % or more of a urethane resin and 50 wt % or less of a fluororesin component and/or a fluorine compound component;

(E) a resin material containing 50 wt % or more of an acrylic resin and 50 wt % or less of a fluororesin component and/or a fluorine compound component; and (G) a resin material containing 50 wt % or more of a urethane resin and 50 wt % or less of a polysiloxane component.

The resin materials (A) to (G) will be described in detail below.

Resin Material (A): Resin Material Containing as Basic Resin Component, Resin Containing 0.05 to 80 wt % of Fluorine-containing Acrylic Monomers The outermost resin layer made from the resin material (A) is suitable for a conductive member such as a charging roller, a development roller, a transfer roller, or a cleaning roller. To be more specific, the conductive member including the outermost resin layer made from the resin material (A) is advantageous in exhibiting a low hardness and a desirable anti-adhesive property, eliminating occurrence of an inconvenience such as sticking or contamination to a counterpart such as a photosensitive body, reducing the degree of adhesion of toner at the time of non-operation in which no voltage is applied to the roller, and exhibiting a low surface friction coefficient, thereby obtaining a high quality image without uneven density and fog, and further keeping the high image quality even for a long-term service.

Examples of the basic resin components of the resin materials (A) include resins such as an acrylic resin, a urethane resin, nylon, a polyethylene resin, an epoxy resin, a polyester resin, a polyether resin, a polystyrene resin, a phenol resin, a polyamide resin, an ABS resin, a urethane modified acrylic resin, wherein the resin is bonded with fluorine containing acrylic monomers, for example, by treatment such as grafting, copolymerization, or bonding using an active hydrogen group and an isocyanate group. The content of the fluorine-containing acrylic monomers is set to be in a range of 0.05 to 80 wt %, preferably, 1 to 40 wt %. If the content of the fluorine-containing acrylic monomers is less than 0.05 wt %, it fails to sufficiently obtain effects of reducing friction, preventing adhesion of the conductive member to a counterpart, and reducing adhesion of toner to the conductive member, and hence it fails to achieve the object of the present invention. Meanwhile, if the content is more than 80 wt %, the effects are already saturated and rather inconveniences such as non-compatibility and brittleness such as "cracking and/or breakage" may occur.

Of the above-described basic resin components, while not particularly limited thereto, a urethane modified acrylic resin containing fluorine-containing acrylic monomers is preferably used. In this case, the content of the acrylic resin component in the urethane modified acrylic resin may be set in a range of 5 to 80 wt %, preferably, 30 to 70 wt %. Further, it may be preferable that 1 to 90 wt %, particularly, 2 to 80 wt % of the acrylic monomers in the acrylic resin component be fluorine-containing acrylic monomers.

The fluorine-containing acrylic monomer is exemplified by a fluorine modified acrylate obtained by bonding a fluoroalkyl group or the like to a terminal of a methacrylate, for example, perfluorooctylethyl methacrylate, 2,2,3,4,4,4-hexafluorobutyl methacrylate, 2,2,3,3-tetrafluoropropyl methacrylate, trifluoroethyl methacrylate.

As a method of producing the above urethane modified acrylic resin by modifying an acrylic resin with a urethane component, there is preferably adopted a method of chemically bonding a urethane resin to an acrylic resin component from the viewpoint of compatibility, liquid stability, film flexibility, and the like. Specifically, the urethane modified acrylic resin may be synthesized by reaction between a polymer obtained by introducing a hydroxyl group in an acrylic polymer and a urethane pre-polymer having an isocyanate group in a molecular terminal. Here, the acrylic polymer is exemplified by 2-hydroxypropyl (meth)acrylate or 2-hydroxyethyl (meth)acrylate. The urethane modified acrylic resin may be also synthesized by reaction shown in the following chemical formula (1), that is, by reaction between an acrylic component having a hydroxyl group in a molecular terminal (single terminal or both-terminal) and a urethane pre-polymer having an isocyanate group in a molecular terminal. In the chemical formula (1), character A indicates a monomer or oligomer of methacrylic acid or methacrylate. In this case, the urethane pre-polymer is exemplified by a polyether, polyester, or a polyolefine based pre-polymer. In the polymer thus obtained, a urethane chain and an acrylic chain may be bonded to each other in the form of a block type or a graft type

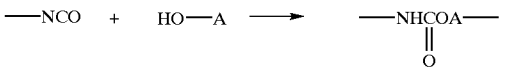

(1)

Alternatively, the urethane modified acrylic resin may be synthesized by producing a urethane pre-polymer as a main chain portion using several kinds of polyols and di-functionality isocyanate (for example, HDI: hexamethylenediisocyanate), incorporating a mercapto group in a side chan portion of the urethane pre-polymer, and grafting acrylic monomers to the urethane portion by using the acrylic monomers combined with a radical accelerator and simultaneously polymerizing the acrylic monomers.

The urethane modified acrylic resin is not limited to those obtained by the above-described methods but may be obtained by a method of adding diisocyanate to an acryl/diol mixture, or a method of adding a both-terminal or single-terminal isocyanate polyester or polyether to acrylic monomers and polymerizing or copolymerizing the resultant urethane acrylate. A glass transition temperature Tg of the acrylic resin component used for the above-described synthesis is preferably set in a range of room temperature to about 80° C. Such an acrylic resin component is not limited to the above-described 2-hydroxyethyl methacrylate or the like, but may be a (meth)acrylate such as methyl (meth) acrylate, ethyl (meth)acrylate, isobutyl phase-separation may occur, or the adjustment of the glass transition temperature (Tg) of the acrylic portion may become impossible.

The urethane modified acrylic resin may be used, while not particularly limited thereto, in the form that it contains an active hydrogen group in a terminal or a side chain and is crosslinked with a polyisocyanate compound or the like. Examples of the polyisocyanate compounds include tolylenediisonatate (TDI), diphenylmethanediisocyanate (MDI), naphthalenediisocyanate (NDI), tolidinediisocyanate (TODI), hexamethylenediisocyanate (HDI), isophoronediisocyanate (IPDI), phenylenediisocyanate, xylylenediisocyanate (XDI), tetramethylxylylenediisocyanate (TMXDI), cyclohexanediisocyanate, lysineestertriisocyanate, undecanetriisocyanate, hexamethylenetriisocyanate, and triphenylmethanetriisocyanate. Alternatively, a polymer, a derivative, a modified material, or a hydrogenated material of the above isocyanate compound may be used. Of these materials, an aliphatic or alicyclic isocyanate such as hexamethylenediisocyanate or isophoronediisocyanate, or a polymer, a derivative, or a modified material thereof is preferably used in terms of excellent ozone resistance and heat resistance.

A silicone component may be incorporated in the urethane modified acrylic resin in order to improve the anti-stickiness to a counterpart. Concretely, a silicone component-containing urethane modified acrylic resin can be synthesized by reaction between a urethane pre-polymer using, as a row material, polyol containing a silicon chain and an acrylic component. In this case, the content of the silicone component in the urethane pre-polymer is preferably set in a range of 1 to 90 wt %, particularly, 5 to 85 wt. % Meanwhile, the content of the silicon component in the resultant urethane modified acrylic resin is preferably set in a range of 0.5 to 60 wt %, particularly, 1 to 50 wt %. If the silicon component is excessively small, the silicon component adding effect is little obtained, and if the (meth)acrylate, n-butyl (meth)acrylate, or glycidyl (meth)acrylate; or acrylonitrile or acrylamide. As the acrylic resin component, the above (meth)acrylate or the like may be further copolymerized with a polymeric monomers such as styrene, vinyl acetate, vinyl chloride, maleic acid, or a derivative thereof.

The content of the acrylic resin component in the urethane modified acrylic resin is preferably set in a range of 5 to 80 wt %, particularly, 30 to 70 wt %. If the acrylic resin component is less than 5 wt %, the sticking and frictional properties of a coating film of the resin (outermost resin layer) may become large, and if the content is more than 80 wt %, the surface characteristic, electric characteristic, and flexibility of the coating film may be degraded.

Since the urethane modified acrylic resin is obtained by chemically bonding the urethane component to the acrylic resin, various properties such as the hardness, stickiness, and friction coefficient can be freely adjusted by changing the mixing ratio of the urethane component and the acrylic component. This is an advantage of the urethane modified acrylic resin, as compared with other resin or elastomer materials.

In the resin material (A), as described above, the fluorine-containing urethane modified acrylic resin produced, for example, by grafting the fluorine-containing acrylic resin to the urethane modified acrylic resin is used as the basic resin component. In this case, the content of fluorine is dependent on the content of the fluorine-containing acrylic resin in the urethane modified acrylic resin, and the content of the fluorine-containing acrylic resin is, as described above, preferably set in a range of 1 to 90 wt %, particularly, 2 to 80 wt % on the basis of the whole content of the acrylic portion. If the content of the fluorine-containing acrylic resin is less than 1 wt %, it fails to sufficiently obtain the fluorine-introducing effect, and if the content is more than 90 wt %, the turbidness and content is excessively large, the performance is not improved so much. Further, if the content of the silicon component is excessively large, there arises an inconvenience that the reaction less proceeds upon synthesis of the urethane modified acrylic resin or phase-separation occurs.

Resin Material (B). Resin Material Containing 50 wt % or more of Polyamide Resin and 50 wt % or less of Polysiloxane Component The configuration of a polyamide resin used for this resin material may be any one selected from an aliphatic-aliphatic configuration via amide-bonding, an aromatic-aromatic configuration via amide-bonding, and an aliphatic-aromatic configuration via amide-bonding insofar as the resin material can obtain the above-described charging potential characteristic by corona discharge.

The polyamide resin has good electrical characteristics and is thereby advantageous as a material for forming the surface layer of a conductive member, but has a high stickiness and a high friction coefficient and is thereby disadvantageous as a material for forming the surface layer of a conductive member. In this regard, the resin material (B) is configured to solve the problem of the polyamide resin in terms of stickiness and friction coefficient while keeping good electrical characteristics of the polyamide resin by adding a polysiloxane component to the polyamide resin.

Examples of the polysiloxane components include dimethyl silicone, methyl phenyl silicone, methyl hydrogen silicone, alkyl modified silicone, fluorine modified silicone, polyether modified silicone, alcohol modified silicone, amino modified silicone, epoxy modified silicone, epoxy-polyether silicone, phenyl modified silicone, and carboxy modified silicone. This polysiloxane component can be used in the form of oil or resin.

The resin material (B) contains the polyamide resin and the polysiloxane component as a resin component. In this case, the content of the polyamide resin may be set in a range of 50 wt % or more, preferably, 55 to 99 wt %, more preferably, 60 to 99 wt %, and the content of the polysiloxane component may be set in a range of 50 wt % or less, preferably, 1 to 50 wt %, more preferably, 1 to 40 wt %. If the content of the polyamide resin is less than 50 wt %, it may fail to obtain good electrical and dynamic characteristics of the polyamide resin. Meanwhile, if the content of the polysiloxane component is excessively small, the anti-stickiness effect cannot be sufficiently obtained, and if the content is excessively large, the anti-stickiness effect is saturated and rather a problem associated with phase-separation may occur.

The polyamide resin and the polysiloxane component may be simply blended, or may be chemically bonded to each other by means of grafting or bonding via a crosslinking agent such as isocyanate.

Resin Material (C): Resin Material Containing 50 wt % or more of Urethane Modified Acrylic Resin and 50 wt % or less of Fluororesin Component and/or Fluorine Compound Component A urethane modified acrylic resin used for this resin material (C) is an acrylic resin modified with a urethane component, and may be the same as that used in the resin material (A). In this resin material (C), however, unlike the resin material (A), the acrylic component in the urethane modified acrylic resin does not necessarily contain the fluorine-containing acrylic monomers.

Like the urethane modified acrylic resin in the resin material (A), the urethane modified acrylic resin in the resin material (C) may contain a silicone component to improve the anti-stickiness to a counterpart. Concretely, a silicone component-containing urethane modified acrylic resin can be synthesized by reaction between a urethane pre-polymer using, as a row material, polyol containing a silicon chain and an acrylic component. In this case, for the urethane modified acrylic resin in the resin material (C), the content of the silicone component in the urethane pre-polymer is preferably set in a range of 2 to 80 wt %, particularly, 5 to 50 wt %. Meanwhile, the content of the silicon component in the resultant urethane modified acrylic resin is preferably set in a range of 1 to 60 wt %, particularly, 3 to 30 wt %.

The urethane modified resin has good electrical and dynamic characteristics and is thereby advantageous as a material for forming the surface layer of a conductive member, but has a high stickiness and a high friction coefficient and is thereby disadvantageous as a material for forming the surface layer of a conductive member. In this regard, the resin material (C) is configured to solve the problem of the urethane modified acrylic resin in terms of stickiness and friction coefficient while keeping good electrical and dynamic characteristics of the urethane modified acrylic resin by adding a fluororesin component and/or a fluorine compound component to the urethane modified acrylic resin.

Examples of the fluororesin components include polytetrafluoroethylene, tetrafluoroethylene-perfluoroalkyl vinyl ether copolymer, tetrafluoroethylene-hexafluoropropylene-perfluoroalkyl vinyl ether copolymer, tetrafluoroethylene-ethylene copolymer, polychlorotrifluoroethylene, chlorotrifluoroethylene-ethylene copolymer, tetrafluoroethylene-vinylidene fluoride copolymer, polyvinylidene fluoride, vinylidene fluoride copolymer, and vinylidene fluoride-hexafluoropropylene copolymer. These materials may be used singly or in combination of two kinds or more.

The fluororesin component and the urethane modified acrylic resin may be simply blended, or may be chemically bonded to each other by means of grafting or bonding via a crosslinking agent such as isocyanate.

Examples of the fluorine compound components include perfluorooctylethyl methacrylate, 2,2,3,4,4,4-hexafluorobutyl methacrylate, 2,2,3,3-tetrafluoropropyl methacrylate, trifluoroethyl methacrylate, fluorine modified acrylate with a fluoroalkyl group bonded to a terminal of polyol, and fluorine modified polyamide with a fluoroalkyl group bonded to a terminal of polyamide. These materials may be used singley or in combination of two kinds or more.

The fluoroalkyl group $C_nF_{2n+1}$ in the fluorine compound may be specified, while not particularly limited thereto, such that "n" is in a range of 6 or more. If "n" is 5 or less, the property of the fluoroalkyl group in terms of reducing the surface energy of the resin material cannot be sufficiently exhibited, and if "n" is more than 6, the property can be significantly exhibited, to contribute to reduction in friction coefficient and adhesiveness of the resin material.

The fluorine compound component and the urethane modified acrylic resin may be simply blended, or may be chemically bonded to each other by means of grafting or bonding via a crosslinking agent such as isocyanate. The reason for this is that if the molecular weight of the fluorine compound is low, there may occur bleed-out of the fluorine compound, to cause contamination of a photosensitive body and reduce the durability of the resin layer. Another reason is as follows. From the viewpoints of the function and effect, the outermost resin layer is desirable to have a component density gradient that the density of the fluorine component is high on the outer side and the density of the urethane modified acrylic component is high on the inner side, and in this regard, if the fluorine compound is bonded to the urethane modified acrylic resin, since the polarity of the fluorine compound is low, the fluorine compound is liable to be shifted on the air side, that is, on the outermost side. In this way, the bonding of the fluorine compound component to the urethane modified acrylic resin does not particularly become disadvantageous in terms of obtaining the above-described component density gradient of the outermost resin layer.

In the resin material (C), the fluorine compound component can be used in combination with the above-described fluororesin component.

As described above, the resin material (C) contains, as the resin component, the urethane modified acrylic resin and the fluororesin component and/or the fluorine compound component. In this case, the content of the urethane modified acrylic resin may be set in a range of 50 wt % or more, preferably, 50 to 99.9 wt %, more preferably, 60 to 99 wt %, and the content of the fluororesin component and/or the fluorine compound component may be set in a range of 50 wt % or less, preferably, 0.1 to 50 wt %, more preferably, 1 to 40 wt %. If the content of the urethane modified acrylic component is less than 50 wt %, the good electrical and dynamic characteristics of the urethane modified acrylic resin may be degraded. Meanwhile, if the content of the fluororesin component and/or the fluorine compound component is excessively small, the anti-stickiness effect cannot be sufficiently obtained, and if the content is excessively large, the anti-stickiness effect is saturated and rather an inconvenience associated with phase-separation or degradation of the electrical characteristics may occur.

Resin Material (D): Resin Material Containing 50 wt % or more of Urethane Resin and 50 wt % or less of Fluroresin Component and/or Fluorine Compound Component A urethane resin used for this resin material (D) may be selected from various urethane resins, for example, a polyether based, polyester based, a polyolefine based, and polyether-ester based urethane resins.

The urethane resin may be used, while not particularly limited thereto, in the form that it contains an active hydrogen group in a terminal or a side chain and is crosslinked by using a polyisocyanate compound or the like. Examples of the polyisocyanate compounds include tolylenediisonatate (TDI), diphenylmethanediisocyanate (MDI), naphthalenediisocyanate (NDI), tolidinediisocyanate (TODI), hexamethylenediisocyanate (HDI), isophoronediisocyanate (IPDI), phenylenediisocyanate, xylylenediisocyanate (XDI), tetramethylxylylenediisocyanate (TMXDI), cyclohexanediisocyanate, lysineestertriisocyanate, undecanetriisocyanate, hexamethylenetriisocyanate, and triphenylmethanetriisocyanate. Alternatively, a polymer, a derivative, a modified material, or a hydrogenated material of the above isocyanate compound may be used. Of these materials, an aliphatic or alicyclic isocyanate such as hexamethylenediisocyanate or isophoronediisocyanate, or a polymer, a derivative, or a modified material thereof is preferably used in terms of excellent ozone resistance and heat resistance.

The urethane resin has good electrical and dynamic characteristics and is thereby advantageous as a material for forming the surface layer of a conductive member, but has a high stickiness and a high friction coefficient and is thereby disadvantageous as a material for forming the surface layer of a conductive member. In this regard, the resin material (D) is configured to solve the problem of the urethane resin in terms of stickiness and friction coefficient while keeping good electrical and dynamic characteristics of the urethane resin by adding a fluororesin component and/or a fluorine compound component to the urethane resin.

Each of the fluororesin component and the fluorine compound component may be the same as that used in the resin material (C). The urethane resin and the fluororesin component may be simply blended, or may be chemically bonded to each other by means of grafting or bonding via a crosslinking agent such as isocyanate. The urethane resin and the fluorine compound component may be simply blended, and for the same reason described in the item of the resin material (C), they are preferably chemically bonded to each other by means of grafting or bonding via a crosslinking agent such as isocyanate. In this resin material (D), the fluororesin component and the fluorine compound component may be used in combination.

As described above, the resin material (D) contains, as the resin component, the urethane resin and the fluororesin component and/or the fluorine compound component. In this case, the content of the urethane resin may be set in a range of 50 wt % or more, preferably, 50 to 99.9 wt %, more preferably, 60 to 99 wt %, and the content of the fluororesin component and/or the fluorine compound component may be set in a range of 50 wt % or less, preferably, 0.1 to 50 wt %, more preferably, 1 to 40 wt %. If the content of the urethane component is less than 50 wt %, it may fail to obtain good electrical and dynamic characteristics of the urethane resin. Meanwhile, if the content of the fluororesin component and/or the fluorine compound component is excessively small, it may fail to obtain a sufficient low friction characteristic, a low adhesiveness, and a low adhesion characteristic of toner, and if the content is excessively large, there may occur inconveniences associated with occurrence of phase-separation in the solution, degradation of the surface characteristic of the resin layer, and occurrence of cracking and the like.

Resin Material (E): Resin Material Containing 50 wt % or more of Acrylic Resin and 50 wt % or less of Fluororesin Component and/or Fluorine Compound Component The outermost resin layer made from the resin material (E) is suitable for a conductive member such as a charging member. To be more specific, the charging member including the outermost resin layer made from the resin material (E) is advantageous in adjusting the relative dielectric constant of the outermost resin layer at a low value to thereby effectively suppress occurrence of noise upon charging operation due to application of a voltage to the charging member, reducing the degree of the adhesiveness (stickiness) of the member to a photosensitive body and lowering the friction coefficient of the member, preventing adhesion of toner to the member, and enhancing the durability of the member, thereby certainly obtaining desirable images.

An acrylic resin used for this resin material (E) is not particularly limited insofar as the acrylic resin has film formability on the elastic layer, but it may be specified to have a glass transition temperature (Tg) in a range of −60 to 50° C., preferably, −60 to 45° C., more preferably, −60 to 40° C. The acrylic resin is of any type selected from a thermoplastic type, a self-crosslinked type, and a crosslinked type using a melamine crosslinking agent, an isocyanate crosslinking agent, or the like.

The resin material (E) contains the acrylic resin as a main component. The acrylic resin has a property of high friction and stickiness, and therefore, if an outermost resin layer is made from a resin material composed of only the acrylic resin, it is easier to cause an image defect due to adhesion of the resin layer to a photosensitive body or the like or toner filming, and/or an image defect due to damages such as wrinkle and opening of the resin layer, and further, since the relative dielectric constant of the outermost resin layer is not sufficiently low, it becomes impossible to sufficiently prevent occurrence of noise upon charging operation.

To cope with the above problems, the resin material (E) is configured to further lower the relative dielectric constant of the outermost resin layer and solve the problems associated with friction and adhesiveness by adding a fluororesin component and/or a fluorine compound component having a low dielectric constant to the acrylic resin.

Each of the fluororesin component and the fluorine compound component may be the same as those used for the resin material (C). The acrylic resin and the fluororesin component may be simply blended, or may be chemically bonded to each other by means of grafting or bonding via a crosslinking agent such as isocyanate. The acrylic resin and the fluorine compound component may be simply blended, and for the same reason described in the item of the resin material (C), they are preferably chemically bonded to each other by means of grafting or bonding via a crosslinking agent such as isocyanate. In this resin material (E), the fluororesin component and the fluorine compound component may be used in combination.

As described above, the resin material (E) contains, as the resin component, the acrylic resin and the fluororesin component and/or the fluorine compound component. In this case, the content of the acrylic resin may be set in a range of 50 wt % or more, preferably, 50 to 99 wt %, more preferably, 60 to 90 wt %. Meanwhile, the content of the fluororesin component and/or the fluorine compound component may be set in a range of 50 wt % or less, preferably, 1 to 50 wt %, more preferably, 10 to 40 wt %. If the content of the acrylic component is less than 50 wt %, it may fail to obtain good film formability, durability and electrical characteristics of the acrylic resin component. On the other hand, if the content of the fluororesin component and/or the fluorine compound component is excessively small, the anti-stickiness effect cannot be sufficiently obtained, and if the content is excessively large, the anti-stickiness effect is saturated and rather an inconvenience associated with phase-separation or degradation of the electrical characteristics may occur. In the case of using a fluoroalkyl group containing polymer compound as the fluorine compound, the content thereof may be set, while not particularly limited thereto, in a range of 30 wt % or less.

The relative dielectric constant of the outermost resin layer can be adjusted at a low value by using the resin material (E) as a material forming the outermost resin layer. The relative dielectric constant of the outermost resin layer being in a state not containing any conductive agent is preferably set in a range of 7.5 or less, more preferably, 5.5 or less. Further, the relative dielectric constant of the outermost resin layer being in a state with its volume resistivity adjusted to a value of $1\times10^8$ Ω·cm by adding a conductive agent thereto may be set, while not particularly limited thereto, in a range of 35 or less, preferably, 20 or less. By using the outermost resin layer satisfying these conditions of relative dielectric constant, it is possible to effectively prevent occurrence of noise upon charging operation or the like.

Resin Material (F): Resin Material Containing 50 wt % or more of Polyamide Resin and 50 wt % or less of Fluororesin Component and/or Fluorine Compound Component A polyamide resin used for this resin material (F) may be the same as that used for the resin material (B). As described above, the polyamide resin has good electrical characteristics and is thereby advantageous as a material for forming the surface layer of a conductive member, but has a high stickiness and a high friction coefficient and is thereby disadvantageous as a material for forming the surface layer of a conductive member. To improve the disadvantageous properties of the polyamide resin, the resin material (B) is configured to use the polysiloxane component in combination with the polyamide resin. On the other hand, the resin material (F) is configured to use a fluororesin component and/or a fluorine compound component in combination with the polyamide resin, to thereby solve the problems associated with stickiness and friction while keeping the good electrical properties of the polyamide resin.

Each of the fluororesin component and the fluorine compound component may be the same as those used for the resin material (C). The polyamide resin and the fluororesin component may be simply blended, or may be chemically bonded to each other by means of grafting or bonding via a crosslinking agent such as isocyanate. The polyamide resin and the fluorine compound component may be simply blended, and for the same reason described in the item of the resin material (C), they are preferably chemically bonded to each other by means of grafting or bonding via a crosslinking agent such as isocyanate. Even in this resin material (F), the fluororesin component and the fluorine compound component may be used in combination.

As described above, the resin material (F) contains, as the resin component, the polyamide resin and the fluororesin component and/or the fluorine compound component. In this case, the content of the polyamide resin may be set in a range of 50 wt % or more, preferably, 50 to 99.9 wt %, more preferably, 60 to 99 wt %. Meanwhile, the content of the fluororesin component and/or the fluorine compound component may be set in a range of 50 wt % or less, preferably, 0.1 to 50 wt %, more preferably, 1 to 40 wt %. If the content of the polyamide resin component is less than 50 wt %, it may fail to obtain good electrical and dynamic characteristics of the polyamide resin. On the other hand, if the content of the fluororesin component and/or the fluorine compound component is excessively small, the anti-stickiness effect cannot be sufficiently obtained, and if the content is excessively large, the anti-stickiness effect is saturated and rather an inconvenience associated with phase-separation or degradation of the electrical characteristics may occur.

Resin Material (G): Resin Material Containing 50 wt % or more of Urethane Resin and 50 wt % or less of Polysiloxane Component A urethane resin used for this resin material (G) may be the same as that used for the resin material (D). As described above, the urethane resin has good electrical and dynamic characteristics and is thereby advantageous as a material for forming the surface layer of a conductive member, but has a high stickiness and a high friction coefficient and is thereby disadvantageous as a material for forming the surface layer of a conductive member. To improve the disadvantageous properties of the urethane resin, the resin material (D) is configured to use the fluororesin component and/or the fluorine compound component in combination with the urethane resin. On the other hand, the resin material (G) is configured to use a polysiloxane component (in place of the fluororesin component and/or the fluorine compound component) in combination with the urethane resin, to thereby solve the problems associated with stickiness and friction while keeping the good electrical properties of the urethane resin. The polysiloxane component may be the same as those used for the resin material (B).

As described above, the resin material (G) contains, as the resin component, the urethane resin and the polysiloxane component. The content of the urethane resin may be set in a range of 50 wt % or more, preferably, 50 to 99 wt %, more preferably, 50 to 95 wt %. Meanwhile, the content of the polysiloxane component may be set in a range of 50 wt % or less, preferably, 1 to 50 wt %, more preferably, 5 to 50 wt %. If the content of the urethane component is less than 50 wt %, it may fail to obtain good electrical and dynamic characteristics of the urethane resin. On the other hand, if the content of the polysiloxane component is excessively small, the effect of preventing adhesion to OPC and fusion of toner cannot be sufficiently obtained, and if the content is excessively large, the above effect is saturated and rather a problem associated with phase-separation may occur.

Each of the resin materials (A) to (G) and other resin materials used for forming the outermost resin layer 3 of the conductive member of the present invention may contain, while not particularly limited thereto, a powder of silica. The addition of a powder of silica contributes to reduction of the contact area, thereby improving the anti-adhesion (anti-stickiness) to a photosensitive body.

Each of these resin materials may contain a conductive agent, as needed, in order to adjust the resistance of the resin material to a specific value. The conductive agent is not particularly limited but may be selected from various electronic conductive agents and various ionic conductive agents. Concretely, the same conductive agent as that used for the elastic layer 2 can be used. In particular, a conductive powder such as a powder of carbon is preferably used as the conductive agent contained in the resin material for forming the outermost resin layer 3. In addition, the electric resistance of the outermost resin layer is not particularly limited but may be suitably set depending on the application of the conductive member and the required electric characteristics of the conductive member, and in general, it may be set in a range of $1\times10^{5}$ to $1\times10^{15}$ Ω·cm, particularly, $1\times10^{7}$ to $1\times10^{13}$ Ω·cm.

The resin material for forming the outermost resin layer 3 may further contain, in addition to the above-described components, various additives such as a crosslinking agent, a thickener, a thixotropy imparting agent, and structural viscosity imparting agent.

The thickness of the outermost resin layer 3 is not particularly limited but may be suitably set depending on the form of the outermost resin layer, and in general, it may be set in a range of 50 μm or less, preferably, 2 to 30 μm. If the thickness is more than 50 μm, the flexibility of the outermost resin layer may be degraded.

The method of forming the outermost resin layer 3 on a conductive member is not particularly limited but is preferably performed by preparing a paint containing the resin material and then coating the conductive member with the resin material by a dipping method or a spraying method. In the case of coating the elastic layer 2 with the paint of the resin material to form the outermost resin layer 3, the paint is dissolved in a solvent. The solvent can be suitably selected depending on the composition of the resin material, and may be a water-based solvent or any other solvent.

The residual elongation of the outermost resin layer 3 may be specified, while not particularly limited thereto, such that when a film made from the same resin material as that of the outermost resin layer 3 and having the same thickness as that of the outermost resin layer 3 is stretched to a length being 1.5 times the original length under an environment with a temperature of 40° C. and a humidity of 95% RH and is left for one day in such a state, a residual elongation of the film is in a range of 50% or less. By using a conductive member including such an outermost resin layer 3, it is possible to effectively solve the above-described problem associated with nip mark.

The conductive member of the present invention is produced by forming the outermost resin layer 3 constituting the surface of the member on the elastic layer 2, and if needed, as shown in FIG. 1(B), the conductive member may be further provided with an intermediate resin layer 4 between the elastic layer 2 and the outermost resin layer 3. In this case, a resin forming the intermediate resin layer 4 is not particularly limited but is preferably configured as a water based resin. The water based resin may be of any type selected from a water-soluble type, an emulsion type, and a suspension type insofar as water is used as a solvent. In particular, the water based resin may be desirable to have active hydrogen such as a carboxyl group, a hydroxyl group, or an amide group, and is exemplified by a hot water soluble type resin such as a polyester resin, an acrylic resin, a urethane resin, or polydioxolane. Of these resins, an acrylic resin is preferably used. The reason for this is that the dielectric constant of an acrylic resin is smaller than that of each of a urethane resin and nylon having been generally used as a resin for forming a conductive member, and correspondingly, an electrostatic capacity of the acrylic resin becomes smaller, to reduce electrical attraction/repulsion between the conductive member and a photosensitive drum when an AC voltage is applied therebetween, thereby suppressing occurrence of charging noise. In particular, a soap-free emulsion type acrylic resin having a glass transition temperature (Tg) ranging from −50 to 10° C. and containing a carboxyl group and a hydroxyl group in an amount of 2 to 5 wt % is preferably used because the acrylic resin exhibits a high crosslinking effect and a low hardness.

A conductive agent may be added to the intermediate resin layer 4 to impart conductivity thereto or adjust the conductivity thereof. The conductive agent may be the same as that used for the elastic layer 2. In particular, carbon is preferably used. Further, carbon used here as a conductive agent may be specified such that the oxygen content is in a range of 5% or more, preferably, 7% or more, more preferably, 9% or more, and pH (hydrogen-ion concentration) is in a range of 5 or more, preferably, 6 or more, more preferably, 7 or more. The reason for this is as follows. The oxygen content of an ordinary carbon material is in a range of about 0.1 to 3%. An oxidized carbon material is known; however, for such an oxidized carbon material, as the oxygen content becomes slightly increased, pH is shifted to the acidic side, and in the case of adding such an acidic carbon material in a water based resin, stability of the carbon-containing water based resin may be degraded. On the contrary, the carbon material used here is kept in a neutral or alkali state although it contains a large amount of oxygen, and can be stably added to a water based resin. Concretely, there is preferably used a carbon material, wherein a function group such as a carboxyl group, a hydroxyl group or a ketone group is added to the surface of the carbon material and part of hydrogen contained in the group is substituted for an alkali metal such as sodium. It is to be noted that the carbon material having a specific oxygen content and a specific pH value is preferably used as carbon to be added to a resin material used as a water-based paint for forming the outermost resin layer 3.

The intermediate resin layer 4 may further contain, if needed, suitable additives such as a film formation assistant, a pigment dispersant, thickener, a leveling agent, a thixotropy imparting agent, and a structural viscosity imparting agent in a suitable amount without departing from the scope of the present invention.

Although the intermediate resin layer 4 is desirable to be made from a water-based resin as described above, the water-based resin may contain another resin. Also, the intermediate resin layer 4 may be configured to have a multi-layer structure.

A method of forming the intermediate resin layer 4 is not particularly limited but may be freely selected from known methods such as a dipping method, a spraying method, and an extrusion method. In general, the intermediate resin layer 4 is preferably formed by a method of dissolving or dispersing a resin material in a solvent, to prepare a paint, and coating the elastic layer with the paint by dipping.

As described above, the conductive member of the present invention is produced by forming the outermost resin layer 3 on the elastic layer 2 directly or indirectly via the intermediate resin layer 2. In this case, irrespective of the layer configuration and the application of the conductive member, to obtain desirable images, the volume resistivity of the conductive member is preferably set in a range of $1\times10^5$ to $1\times10^{11}$ Ω·cm, more preferably, $1\times10^6$ to $1\times10^{10}$ Ω·cm. Further, if the surface of the conductive member is irregular, toner may be buried in the irregularities, to cause a image defect, so that the surface of the conductive member is desirable to be as smooth as possible. Concretely, the surface roughness Rz (ten point average roughness specified in JIS) may be set in a range of 4 μm or less, preferably, 3 μm or less, more preferably, 2 μm or less.

The charging potential characteristic of the conductive member of the present invention is specified such that when the surface of an outermost resin layer being in a state not containing any conductive agent (that is, an outermost resin layer being the same as the outermost resin layer of the conductive agent except for the conductive agent), is charged due to corona discharge generated by applying a voltage of 8 kV to a corona discharger disposed with a gap of 1 mm put between the surface of the outermost resin layer and the corona discharger, the maximum value of the surface potential of the outermost resin layer after an elapse of 0.3 sec is in a range of 50 V or less, particularly, 35 V or less and the surface potential of the outermost resin layer after an elapse of 10 sec is in a range of 5 V or less, particularly, 3.5 V or less. By specifying the charging potential characteristic of the conductive member as described above, it is possible to certainly prevent occurrence of the above-described "fog", particularly, "initial fog". Such a charging potential characteristic of the outermost resin layer 3 can be obtained by adjusting the composition of the outermost resin layer 3, for example, by forming the outermost resin layer 3 using each of the resin materials (A) to (G).

Figure 5:
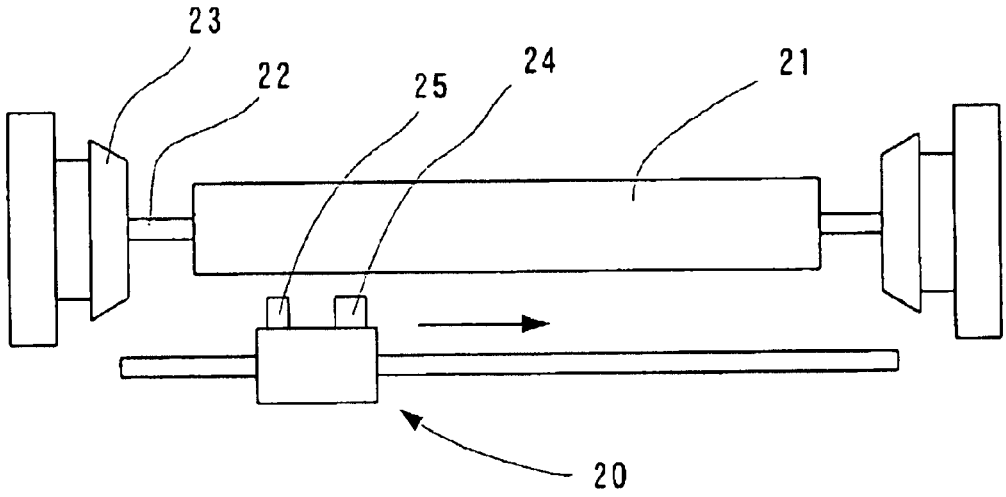
FIG. 5 is a schematic view showing one example of a measurement unit for measuring a surface charge potential characteristic of a conductive member.

The concrete method of evaluating the above charging potential characteristic of a conductive member by measuring a surface potential of the conductive member may be carried out by using a charge roller test system (trade name: CRT2000, produced by Quality Engineering Associates, Inc.) shown in FIG. 5. Referring to FIG. 5, a conductive member (depicted as a charging roller in the figure) including the outermost resin layer is taken as a test roller 21. Both end portions of a shaft 22 of the test roller 21 are fixed by chucks 23. A measuring unit 20, which has a small-sized Scorotron type discharger 24 and a surface electrometer 25 separated from the discharger 24 by a specific distance, is disposed opposite to the surface of the test roller 21 with a gap of 1 mm put therebetween. With the test roller 21 immobile, the measurement unit 20 is moved at a specific speed from one end to the other end of the test roller 21, and in such a movement state, the measurement unit 20 imparts surface charges to the test roller 21 and detects the surface potential of the test roller 21. In this case, the "surface potential after 0.3 sec" and the "surface potential after 10 sec" are measured by adjusting the movement speed of the measurement unit 20. It is to be noted that since the surface potential is dependent on temperature and humidity, the measurement is performed under a standard condition with 22° C./50% RH. In addition, corona charges imparted from the Scorotron type discharger 24 to the test roller 21 are taken as negative charges, and the applied voltage is set to 8 kV as described above.

The friction resistance of the surface of the conductive member of the present invention is desirable to be as small as possible. More specifically, the friction coefficient of the conductive member is desirable to be in a range of 1 or less, particularly, 0.5 or less, wherein the friction coefficient is measured by bringing the conductive member in press-contact with a cloth of 70 mesh containing 100% of cellulose (density: 30 g/m$^2$) at a load of 100 gf and sliding the conductive member against the cloth. By using the conductive member including the outermost resin layer with its friction coefficient specified as described above, it is possible to more certainly prevent occurrence of fog, particularly, fog after repeated printing. The surface friction characteristic of the outermost resin layer can be obtained by adjusting the composition of the outermost resin layer, for example, by forming the outermost resin layer using each of the resin materials (A) to (G).

Figure 4:
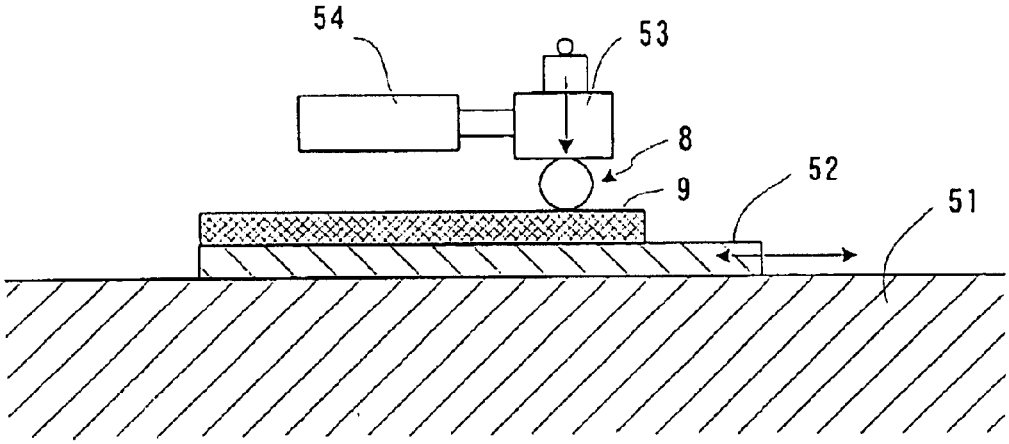
FIG. 4 is a schematic view showing one example of a measurement unit for measuring a friction coefficient of the surface of a conductive member.

The above friction coefficient can be measured by using a measurement unit shown in FIG. 4. Referring to this figure, a cloth (BEMCOT LINTFREE) 18 containing 100% of cellulose (opening: 70 mesh, density: 30 g/m$^2$) is fixed to a movable stage 52 provided on a base 51. An inventive conductive member 17 to be evaluated is disposed on the cloth 18 in a state being in contact therewith. A load of 100 gf is applied to the conductive member 17 by a pressing means 53, to bring the conductive member 17 into press-contact with the cloth 18. In such a state, the movable stage 52 is reciprocated for frictional motion of the conductive member 17 against the cloth 18 at a frictional speed of 100 mm/min, and a friction resistance is detected by a load cell 54. The friction coefficient of the conductive member 17 against the cloth (BEMCOT LINTFREE) 18 can be obtained on the basis of the measured friction resistance value. The reason why the cloth (BEMCOT LINTFREE) containing 100% of cellulose (opening: 70 mesh, density: 30 g/m$^2$) is selected as a counterpart in the above-described test is that the testing using the cloth as a counterpart has the highest correlation with the surface characteristic of the conductive member used as a charging member, a development member, a transfer member, or a cleaning member, and that the measurement range of the friction coefficient obtained by the testing using the cloth as a counterpart is reasonable.

The contact angle between the surface of the conductive member of the present invention, that is, the surface of the outermost resin layer of the conductive member and water may be set, while not particularly limited thereto, in a range of 90° or more, particularly, 95° or more. By using the conductive member with its contact angle specified as described above, it is possible to more certainly solve the problems associated with peeling of a coating film and contamination of a counterpart such as a photosensitive body caused by adhesion to the counterpart.

The conductive member of the present invention can be suitably used, for example, as (1) a charging member disposed in contact with a body to be charged such as a photosensitive drum and operated to charge the body to be charged when a voltage is applied between the body to be charged and the charging member, (2) a development member operated to support a developer on the surface thereof so as to form a thin film of the developer, and to be brought into contact with a latent image support on the surface of which an electrostatic latent image has been formed so as to stick the developer on the electrostatic latent image formed on the surface of the latent image support, thereby visualizing the electrostatic latent image, (3) a transfer member operated to charge a transfer medium, and transfer a developer from an electrostatic latent image having been visualized by the developer to the transfer medium, and (4) a cleaning unit operated to remove a developer remaining on a latent image support.

Figure 3:
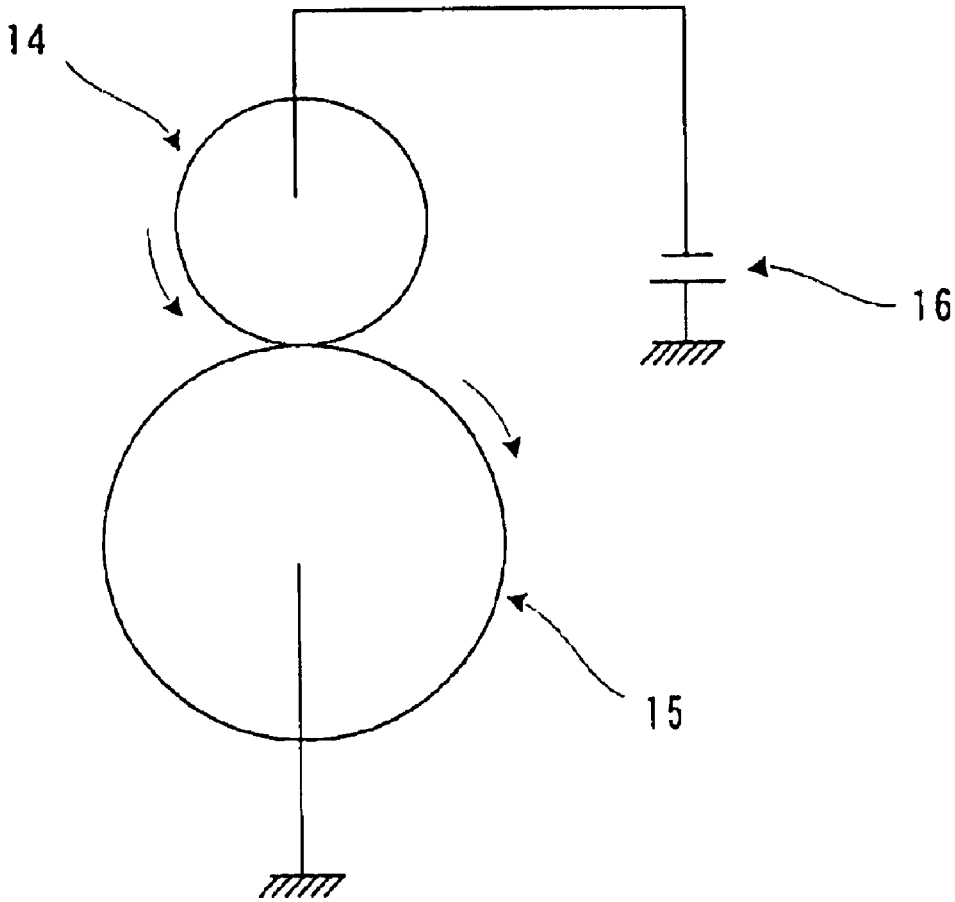
FIG. 3 is a schematic view showing one example of a charging unit according to the present invention.

In this case, a charging unit using the conductive member of the present invention as a charging member can be configured, as described in FIG. 3, such that a charging member 14 composed of the conductive member of the present invention is brought into press-contact with a body 15 to be charged such as a photosensitive drum at a specific pressure, and a voltage supplied from a voltage applying means 16 is applied between the charging member 14 and the body 15 to be charged. The present invention, however, is not limited thereto. For example, the shapes of the body 15 to be charged and the charging member 14 and also the voltage applying method by the voltage applying means 16 may be suitably changed.

The electrophotographic apparatus using the conductive member of the present invention as each of the development member, transfer member, and cleaning member can be configured as shown in FIG. 2; however, the electrophotographic apparatus of the present invention is not limited thereto but may be suitably changed.

EXAMPLES

The present invention will be more fully described by way of the following inventive examples and comparative examples, although the present invention is not limited thereto.

Inventive Example 1

Charging Member

A charging roller was produced by forming an intermediate resin layer 1 (thickness: 100 $\mu$m) on the surface of an elastic layer made from a conductive urethane foam (thickness: 3 mm, volume resistivity: $3\times10^4$ Ω·cm, Asker C hardness: 35), and forming an outermost resin layer 2 (thickness: 10 $\mu$m) thereon.

Intermediate Resin Layer 1

The intermediate resin layer 1 was formed by coating the elastic layer with a paint composed of a water-based acrylic resin containing carbon. The volume resistivity of the layer 1was adjusted to $5\times10^7$ Ω·cm.

Outermost Resin Layer 2

The outermost resin layer 2 was formed from a resin material, which material was prepared by dissolving a fluororesin (trade name: Kynar 2751, produced by Elf Atochem Japan) in MEK (methyl ethyl ketone) as a solvent and adding carbon as a conductive agent thereto. The resistance of the roller thus produced was $9.0\times10^6$ Ω.

A roller was produced in the same manner as that described above except that any carbon was not added to the outermost resin layer 2. The surface potential of the roller was measured by the above-described surface potential measuring method. The result showed that the surface potential after 0.3 sec was 5 V and the surface potential after 10 sec was 0.31 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Inventive Example 2

Charging Member

A charging roller was produced by forming the same intermediate resin layer 1 (thickness: 100 $\mu$m) as that described in Inventive Example 1 on the surface of an elastic layer made from a conductive urethane foam (thickness: 3 mm, volume resistivity: $3\times10^4$ Ω·cm, Asker C hardness: 35), and forming the following outermost resin layer 3 (thickness: 10 $\mu$m) thereon.

Outermost Resin Layer 3

The outermost resin layer 3 was formed from a resin material, which material was prepared by dissolving a fluororesin (trade name: Kynar SuperFlex, produced by Elf Atochem Japan) in MEK (methyl ethyl ketone) as a solvent and adding carbon as a conductive agent thereto. The resistance of the roller thus produced was $7.0\times10^6$ Ω.

A roller was produced in the same manner as that described above except that any carbon was not added to the outermost resin layer 3. The surface potential of the roller was measured by the above-described surface potential measuring method. The result showed that the surface potential after 0.3 sec was 5 V and the surface potential after 10 sec was 0.25 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Comparative Example 1

Charging Member

A charging roller was produced by forming the same intermediate resin layer 1 as that described in Example 1 on the surface of an elastic layer made from a conductive urethane foam (thickness: 3 mm, volume resistivity: $3\times10^4$ Ω·cm, Asker C hardness: 35), and forming the following outermost resin layer 4 (thickness: 10 $\mu$m) thereon.

Outermost Resin Layer 4

The outermost resin layer 4 was formed from a resin material, which material was prepared by dissolving a fluororesin (trade name: LF200, produced by Asahi Glass Company) in MEK (methyl ethyl ketone) as a solvent, and adding carbon as a conductive agent and an isocyanate crosslinking agent thereto. The resistance of the roller thus produced was $1.0\times10^6$ Ω.

A roller was produced in the same manner as that described above except that any carbon was not added to the outermost resin layer 4. The surface potential of the roller was measured by the above-described surface potential measuring method. The result showed that the surface potential after 0.3 sec was 400 V and the surface potential after 10 sec was 200 V.

The charging roller was incorporated in a printer cartridge. The printer cartridge was operated for image formation at an AC voltage Vpp of 1800 V and a DC voltage Vdc of −650 V, with a result that "fog" was slightly observed. The printer cartridge was also operated for image formation at a DC voltage Vdc of −1260 V, with a result that "fog" was occurred.

Comparative Example 2

Charging Member

A charging roller was produced by forming the same intermediate resin layer 1 as that described in Example 1 on the surface of an elastic layer made from a conductive urethane foam (thickness: 3 mm, volume resistivity: $3\times10^4$ Ω·cm, Asker C hardness: 35), and forming the following outermost resin layer 5 (thickness: 10 μm thereon.

Outermost Resin Layer 5

The outermost resin layer 5 was formed from a resin material, which material was prepared by dissolving a fluororesin (trade name: Kynar 7201, produced by Elf Atochem Japan) in MEK (methyl ethyl ketone) as a solvent, and adding carbon as a conductive agent thereto. The resistance of the roller thus produced was $1.0\times10^6$ Ω.

A roller was produced in the same manner as that described above except that any carbon was not added to the outermost resin layer 5. The surface potential of the roller was measured by the above-described surface potential measuring method. The result showed that the surface potential after 0.3 sec was 350 V and the surface potential after 10 sec was 150 V.

The charging roller was incorporated in a printer cartridge. The printer cartridge was operated for image formation at an AC voltage Vpp of 1800 V and a DC voltage Vdc of −650 V, with a result that "fog" was slightly observed. The printer cartridge was also operated for image formation at a DC voltage Vdc of −1260 V, with a result that "fog" occurred.

Inventive Example 3

Charging Member

A charging roller was produced by forming the same intermediate resin layer 1 as that described in Inventive Example 1 on the surface of an elastic layer made from a conductive NBR (nitrile rubber) (thickness: 3 mm, volume resistivity: $5\times10^4$ Ω·cm, Asker C hardness: 75), and forming the following outermost resin layer 6 (thickness: 10 μm) thereon.

Outermost Resin Layer 6

The outermost resin layer 6 was formed from a resin material, which material was prepared by dissolving a fluororesin (trade name: DP307, produced by Sanyo Chemical Industries, Ltd.) in MEK (methyl ethyl ketone) as a solvent, and adding ions of a quaternary ammonium salt as a conductive agent and an isocyanate crosslinking agent thereto. The resistance of the roller thus produced was $2.3\times10^6$ Ω.

A roller was produced in the same manner as that described above except that any ions of a quaternary ammonium salt were not added to the outermost resin layer 6. The surface potential of the roller was measured by the above-described surface potential measuring method. The result showed that the surface potential after 0.3 sec was 2 V and the surface potential after 10 sec was 0.25 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Inventive Example 4

Charging Member

A charging roller was produced by forming the same intermediate resin layer 1 as that described in Inventive Example 1 on the surface of an elastic layer made from a conductive NBR (nitrile rubber) (thickness: 3 mm, volume resistivity: $5\times10^4$ Ω·cm, Asker C hardness: 75), and forming the following outermost resin layer 7 (thickness: 10 μm) thereon.

Outermost Resin Layer 7

The outermost resin layer 7 was formed from a resin material, which material was prepared by dissolving a urethane resin (trade name: XN304, produced by Sanyo Chemical Industries, Ltd.) in MEK (methyl ethyl ketone) as a solvent and adding a single terminal alcohol modified silicone oil (trade name: X-22-176F, produced by Shin-Etsu Chemical Co., Ltd.) thereto in an amount of 10 parts by weight on the basis of 100 parts by weight of the urethane resin, and further adding carbon as a conductive agent and an isocyanate crosslinking agent thereto. The resistance of the roller thus produced was $3.1\times10^6$ Ω.

A roller was produced in the same manner as that described above except that any carbon was not added to the outermost resin layer 7. The surface potential of the roller was measured by the above-described surface potential measuring method. The result showed that the surface potential after 0.3 sec was 38 V and the surface potential after 10 sec was 2.62 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Inventive Example 5

Charging Member

A charging roller was produced by forming the same intermediate resin layer 1 as that described in Inventive Example 1 on the surface of an elastic layer made from a conductive urethane foam (thickness: 3 mm, volume resistivity: $3\times10^4$ Ω·cm, Asker C hardness: 35), and forming the following outermost resin layer 8 (thickness: 10 μm) thereon.

Outermost Resin Layer 8

The outermost resin layer 8 was formed from a resin material, which material was prepared by dissolving a urethane modified acrylic resin in MEK (methyl ethyl ketone) as a solvent, and adding carbon as a conductive agent and an isocyanate crosslinking agent thereto. The urethane modified acrylic resin contains an acrylic component and a urethane component at a weight ratio of 5:5, wherein the glass transition temperature Tg of the acrylic portion is 100° C. The resistance of the roller thus produced was $1.3\times10^6$ Ω.

A roller was produced in the same manner as that described above except that any carbon was not added to the outermost resin layer 8. The surface potential of the roller was measured by the above-described surface potential measuring method. The result showed that the surface potential after 0.3 sec was 7 V and the surface potential after 10 sec was 0.56 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Inventive Example 6

Charging Member

A charging roller was produced by forming the same intermediate resin layer 1 as that described in Inventive Example 1 on the surface of an elastic layer made from a conductive urethane foam (thickness: 3 mm, volume resistivity: $3\times10^4$ Ω·cm, Asker C hardness: 35), and forming the following outermost resin layer 9 (thickness: 10 μm) thereon.

Outermost Resin Layer 9

The outermost resin layer 9 was formed from a resin material, which material was prepared by dissolving a urethane modified acrylic resin in MEK (methyl ethyl ketone) as a solvent, and adding carbon as a conductive agent and an isocyanate crosslinking agent thereto. The urethane modified acrylic resin was produced by grafting, in a urethane pre-polymer, an acrylic polymer obtained by polymerizing acrylic monomers containing 80 wt % of fluorine-containing acrylic monomers. The resistance of the roller thus produced was $1.4\times10^6$ Ω.

A roller was produced in the same manner as that described above except that any carbon was not added to the outermost resin layer 9. The surface potential of the roller was measured by the above-described surface potential measuring method. The result showed that the surface potential after 0.3 sec was 2 V and the surface potential after 10 sec was 0.14 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Inventive Example 7

Charging Member

A charging roller was produced by forming the same intermediate resin layer 1 as that described in Inventive Example 1 on the surface of an elastic layer made from a conductive urethane foam (thickness: 3 mm, volume resistivity: $3\times10^4$ Ω·cm, Asker C hardness: 35), and forming the following outermost resin layer 10 (thickness: 10 μm) thereon.

Outermost Resin Layer 10

The outermost resin layer 10 was formed from a resin material, which material was prepared by dissolving a polyamide resin (trade name: H1060, produced by Sanyo Chemical, Industries, Ltd.) in ethanol as a solvent, and adding carbon as a conductive agent and a melamine crosslinking agent thereto. The resistance of the roller thus produced was $1.1\times10^6$ Ω.

A roller was produced in the same manner as that described above except that any carbon was not added to the outermost resin layer 10. The surface potential of the roller was measured by the above-described surface potential measuring method. The result showed that the surface potential after 0.3 sec was 5 V and the surface potential after 10 sec was 0.58 V.

The charging roller was incorporated in a printer cartridge. The printer cartridge was operated for image formation at an AC voltage Vpp of 1800 V and a DC voltage Vdc of −650 V, with a result that desirable images were obtained. The printer cartridge was also operated for image formation at a DC voltage Vdc of −1260 V, with a result that desirable images were obtained.

Comparative Example 3

Charging Member

A charging roller was produced by forming the following outermost resin layer 11(thickness: 10 μm) on the surface of an elastic layer made from a conductive urethane foam (thickness: 3 mm, volume resistivity: $3\times10^4$ Ω·cm, Asker C hardness: 35).

Outermost Resin Layer 11

The outermost resin layer 11 was formed by coating the elastic layer with a paint obtained by adding carbon to a water-based acrylic resin (trade name: SuperFlex 420, produced by Dai-ichi Kogyo Seiyaku Co., Ltd.). The resistance of the roller thus produced was $1.5\times10^6$ Ω.

A roller was produced in the same manner as that described above except that any carbon was not added to the outermost resin layer 11. The surface potential of the roller was measured by the above-described surface potential measuring method. The result showed that the surface potential after 0.3 sec was 800 V and the surface potential after 10 sec was 500 V.

The charging roller was incorporated in a printer cartridge. The printer cartridge was operated for image formation at an AC voltage Vpp of 1800 V and a DC voltage Vdc of −650 V, with a result that "fog" occurred. The printer cartridge was also operated for image formation at a DC voltage Vdc of −1260 V, with a result that "fog" occurred.

Comparative Example 4

Charging Member

A charging roller was produced by forming the same intermediate resin layer 1 as that described in Inventive Example 1 on the surface of an elastic layer made from a conductive urethane foam (thickness: 3 mm, volume resistivity: $3\times10^4$ Ωcm, Asker C hardness: 35), and forming the following outermost resin layer 12 (thickness: 10 μm) thereon.

Outermost Resin Layer 12

The outermost resin layer 12 was formed from a resin material, which material was prepared by dissolving a polyamide resin (trade name: X1850, produced by Sanyo Chemical, Industries, Ltd.) in ethanol as a solvent, and adding carbon as a conductive agent and a melamine crosslinking agent thereto. The resistance of the roller thus produced was $1.5\times10^6$ Ω.

A roller was produced in the same manner as that described above except that any carbon was not added to the outermost resin layer 12. The surface potential of the roller was measured by the above-described surface potential measuring method. The result showed that the surface potential after 0.3 sec was 220 V and the surface potential after 10 sec was 90 V.

The charging roller was incorporated in a printer cartridge. The printer cartridge was operated for image formation at an AC voltage Vpp of 1800 V and a DC voltage Vdc of −650 V, with a result that "fog" slightly occurred. The printer cartridge was also operated for image formation at a DC voltage Vdc of −1260 V, with a result that "fog" occurred.

Inventive Example 8

Development Member

A paint 13 was prepared by dissolving a fluorine-containing urethane modified acrylic resin (Tg: 80° C.) in MEK (methyl ethyl ketone) as a solvent and adding an isocyanate crosslinking agent thereto with an NCO index set to 1.5. In the fluorine-containing urethane modified acrylic resin, the content of an acrylic component is 50 wt %, and 30 wt % of acrylic monomers of the acrylic component are fluorine-containing acrylic monomers.

An isoprene rubber roller was produced by forming an elastic layer (thickness: 6 mm, volume resistivity: $10^7$ Ω·cm) around the outer periphery of a metal shaft. The elastic layer was made from an isoprene rubber with its resistance adjusted by adding a conductive agent (carbon black) thereto. The isoprene rubber roller was dipped in the above paint 13, followed by drying, to form an outermost resin layer 13 having a thickness of about 10 μm on the isoprene rubber elastic layer of the roller. A development roller having the same layer configuration as that shown in FIG. 1(A) was thus produced.

The surface roughness of the development roller was 3.7 μm in Rz (ten point average roughness specified in JIS). The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.41.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.21 V.

Inventive Example 9

Development roller

A paint 14 was prepared by dissolving a fluorine-containing urethane modified acrylic resin (Tg: 27° C.) in MEK as a solvent and adding a powder of a silica in an amount of 30 parts by weight on the basis of 100 parts by weight of the urethane resin, and further adding an isocyanate crosslinking agent thereto with an NCO index set to 1.5. In the fluorine-containing urethane modified acrylic resin, the content of an acrylic component is 60 wt %, and 40 wt % of acrylic monomers of the acrylic component are fluorine-containing acrylic monomers.

The same isoprene rubber roller as that in Inventive Example 8 was dipped in the above paint 14, followed by drying, to form an outermost resin layer 14 having a thickness of about 10 μm on the isoprene rubber elastic layer of the roller. A development roller having the same layer configuration as that shown in FIG. 1(A) was thus produced.

The surface roughness of the development roller was 6.5 μm in Rz (ten point average roughness specified in JIS). The roller was then subjected to friction testing using a cloth of 70 mesh containing 100% of cellulose (density: 30 g/m$^2$) by the measurement instrument shown in FIG. 4 under a condition with a temperature of 22° C. and a humidity of 50% RH. The result showed that the friction coefficient of the roller was 0.31.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.55 V.

Comparative Example 5

Development roller

A paint 15 was prepared by dissolving a urethane modified acrylic resin (Tg of acrylic portion: 27° C.) in MEK as a solvent, and adding an isocyanate crosslinking agent thereto with an NCO index set to 1.5. In the urethane modified acrylic resin, the content of an acrylic component is 50 wt %, and acrylic monomers of the acrylic component do not contain fluorine at all.

The same isoprene rubber roller as that in Inventive Example 8 was dipped in the above paint 15, followed by drying, to form an outermost resin layer 15 having a thickness of about 10 μm on the isoprene rubber elastic layer of the roller. A development roller having the same layer configuration as that shown in FIG. 1(A) was thus produced.

The surface roughness of the development roller was 3.2 μm in Rz (ten point average roughness specified in JIS). The roller was then subjected to friction testing using a cloth of 70 mesh containing 100% of cellulose (density: 30 g/m$^2$) by the measurement instrument shown in FIG. 4 under a condition with a temperature of 22° C. and a humidity of 50% RH. The result showed that the friction coefficient of the roller was 2.15.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sec was 0.11 V.

Comparative Example 6

Development roller

A paint 16 was prepared by dissolving a urethane modified acrylic resin (Tg of acrylic portion: 50° C.) in MEK as a solvent and adding a powder of silica in an amount of 30 parts by weight on the basis of 100 parts by weight of the urethane modified acrylic resin, and further adding an isocyanate crosslinking agent thereto with an NCO index set to 1.5. In the urethane modified acrylic resin, the content of an acrylic component is 50 wt %, and acrylic monomers of the acrylic component do not contain fluorine at all.

The same isoprene rubber roller as that in Inventive Example 8 was dipped in the above paint 16, followed by drying, to form an outermost resin layer 16 having a thickness of about 10 μm on the isoprene rubber elastic layer of the roller. A development roller having the same layer configuration as that shown in FIG. 1(A) was thus produced.

The surface roughness of the development roller was 7.2 μm in Rz (ten point average roughness specified in JIS). The roller was then subjected to friction testing using a cloth of 70 mesh containing 100% of cellulose (density: 30 g/m$^2$) by the measurement instrument shown in FIG. 4 under a condition with a temperature of 22° C. and a humidity of 50% RH. The result showed that the friction coefficient of the roller was 1.07.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V an d the surface potential of the roller after 10 sec was 0.12 V.

Each of the development rollers in Inventive Examples 8 and 9 and Comparative Examples 5 and 6 was evaluated, in terms of adhesiveness (stickiness) to a photosensitive body, contamination of the photosensitive body, charging performance of toner, carrying performance of toner, image fog after repeated printing, and wear of the development roller, by the following methods. The results are shown in Table 1.

Adhesiveness (Stickiness) to Photosensitive Body and Contamination of Photosensitive Body A roller to be tested was incorporated as a development roller in the printer cartridge shown in FIG. 2 and was left for two weeks under an environment with a temperature of 40° C. and a humidity of 80% RH, and the adhesiveness of the development roller to a photosensitive drum and the contamination of the photosensitive drum caused by the development roller were examined.

Charging Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Image Fog After Repeated Printing

A roller to be tested was incorporated as a development roller in the printer cartridge shown in FIG. 2, and the printer cartridge was operated for image formation in a reversal manner by rotating the development roller at a linear velocity (circumferential speed) of 150 mm/sec. In this printing, a non-magnetic one-component toner having an average particle of 7 $\mu$m was used, and the development bias voltage was set to 350 V. The printing operation was repeated, to form images of white solid, half-tone, and black solid on 5,000 pieces of sheets. Each of the images of white solid, half-tone, and black solid was evaluated in terms of image quality (the presence or absence and the degree of fog).

Wear of Development Roller

The roller to be tested was taken out of the printer cartridge after the above endurance test, and the surface of the roller was observed by a video microscope, to evaluate the degree of damage and wear of the surface of the roller.

TABLE 1

| | Inventive Example 8 | Inventive Example 9 | Comparative Example 5 | Comparative Example 6 |
|---|---|---|---|---|
| Adhesiveness to OPC | ○ | ○ | x | Δx |
| Initial Image Fog | ○ | ○ | x | Δx |
| Charging Performance of Toner | ○ | ○ | Δx | Δ |
| Carrying Performance of Toner | ○ | ○ | x | Δx |
| Fog After Repeated Printing | ○ | ○ | x | Δx |
| Wear of Development Roller | ○ | ○ | x | x |

Criteria for Evaluation
○: very good
○Δ: good
○: ordinary
Δx: slightly poor
x: poor As shown in Table 1, each of the development rollers produced in Inventive Examples 8 and 9, in which the outermost resin layer was formed from the urethane modified acrylic resin containing fluorine-containing acrylic monomers, does not cause the contamination of the photosensitive body and the adhesiveness to the photosensitive body, being excellent in charging performance of toner and carrying performance of toner, and is capable of certainly obtaining desirable images without occurrence of fog, and further, the development roller has an excellent durability allowing excellent performances to be kept for a long-period without occurrence of wear of the roller. On the contrary, each of the development rollers produced in Comparative Examples 5 and 6 is liable to cause the contamination of the photosensitive body and the adhesiveness to the photosensitive body, and tends to cause filming because of less release of toner from the surface of the roller and hence to degrade the charging performance of toner and the carrying performance of toner, resulting in defective images, and further, the development roller causes wear of the roller because it has a large friction coefficient.

Inventive Example 10

Transfer Member

A paint 17 was prepared by dissolving a fluorine-containing urethane modified acrylic resin (Tg: 80° C.) in MEK as a solvent and adding an isocyanate crosslinking agent thereto with an NCO index set to 1.5. In the fluorine-containing urethane modified acrylic resin, the content of an acrylic component is 50 wt %, and 30 wt % of acrylic monomers of the acrylic component are fluorine-containing acrylic monomers.

A urethane foam roller was produced by forming an elastic layer (thickness: 6 mm, volume resistivity: $1\times10^7$ Ω·cm) around the outer periphery of a metal shaft. The elastic layer was made from a urethane foam with its resistance adjusted by adding a conductive agent (carbon black) thereto. The urethane foam roller was dipped in the above paint 17, followed by drying, to form an outermost resin layer 17 having a thickness of about 10 $\mu$m on the urethane foam elastic layer. A transfer roller having the same layer configuration as that shown in FIG. 1(A) was thus produced.

The transfer roller was subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.48.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.54 V.

Comparative Example 7

Transfer Member

A paint 18 was prepared by dissolving a urethane modified acrylic resin (Tg: 50° C.) in MEK as a solvent and adding an isocyanate crosslinking agent thereto with an NCO index set to 1.5. In the urethane modified acrylic resin, the content of an acrylic component is 40 wt %, and acrylic monomers of the acrylic component do not contain fluorine at all.

The same urethane foam roller as that in Inventive Example 10 was dipped in the above paint 18, followed by drying, to form an outermost resin layer 18 having a thickness of about 10 $\mu$m on the urethane foam elastic layer of the roller. A transfer roller having the same layer configuration as that shown in FIG. 1(A) was thus produced.

The transfer roller was subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.55.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.48 V.

Each of the transfer rollers in Inventive Example 10 and Comparative Example 7 was pressed to a photosensitive drum at a load of 1 kg, and was left for two weeks under an environment with a temperature of 50° C. and a humidity of 85% RH. As a result, the roller in Inventive Example 10 did not cause any problem, while the roller in Comparative Example 7 caused adhesion and contamination between the roller and the photosensitive drum. Each of the transfer rollers in Inventive Example 10 and Comparative Example 7 was then incorporated in a laser printer, and the printer was operated to print images on 5,000 pieces of sheets. As a result, the roller in Inventive Example 10 did not cause any problem, while the roller in Comparative Example 7 caused spot omissions of characters in images and contamination of the back surfaces of transfer sheets due to toner contamination on the surface of the roller.

The surface glossiness of the surface of each of the transfer rollers in Inventive Example 10 and Comparative Example 7 before and after the above image formation was measured by the following method. As a result that, the difference in glossiness of the roller in Inventive Example 10 between before and after the image formation was 3.7, while the difference in glossiness of the roller in Comparative Example 7 between before and after the image formation was 15.2. In this way, for the roller in Comparative Example 7, the glossiness was significantly reduced due to adhesion of toner on the surface of the roller.

Method of Measuring Glossiness

The length of the roller was adjusted to 10 cm, and the roller was fixedly fitted in a black fixing base. The roller was then disposed in a measurement port of a haze/gloss meter (produced by Byk Gardner, Inc.) in such a manner that the surface of the roller was taken as a measurement plane. The surface glossiness of the roller was measured by means of light made incident on the surface of the roller at an incident light angle of 85° (measurement area: 8×60 mm) by the haze/gloss meter. The surface glossiness of the roller thus measured was expressed as a relative value determined with a reflectance index 1.567 of a black glass standard board taken as 100 (specified in DIN67 530).

Inventive Example 11

Cleaning Member

A cleaning roller having the same layer configuration as that shown in FIG. 1(B) was produced by forming an elastic layer (thickness: 3 mm, volume resistivity: $1\times10^5$ Ω·cm) made from a conductive urethane foam around the outer periphery of a metal shaft, forming the following intermediate resin layer 19 having a thickness of 100 $\mu$m on the surface of the elastic layer, and forming the following outermost resin layer 20 having a thickness of 10 $\mu$m thereon.

Intermediate Resin Layer 19

The intermediate resin layer 19 was formed by coating the elastic layer with a paint G prepared by adding carbon to a water-based acrylic resin by a dipping method. The volume resistivity was adjusted to $5\times10^7$ Ω·cm.

Outermost Resin Layer 20

A paint 20 was prepared by dissolving a fluorine-containing urethane modified acrylic resin (Tg of an acrylic portion: 80° C.) in MEK as a solvent and adding an isocyanate crosslinking agent thereto with an NCO index set to 1.5. In the fluorine-containing urethane modified acrylic resin, the content of an acrylic component is 60 wt %, and 30 wt % of acrylic monomers of the acrylic component are fluorine-containing acrylic monomers. The intermediate resin layer 19 was coated with the paint 20 by a dipping method, to form the outermost resin layer 20.

The surface roughness of the cleaning roller was 0.7 $\mu$m in Rz (ten point average roughness specified in JIS). The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.30.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 8 V and the surface potential of the roller after 10 sec was 0.95 V.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed. Like Inventive Example 10 and Comparative Example 7, the surface glossiness of the roller before and after the image formation was measured. As a result, the surface glossiness of the roller before the image formation was 58.0 and the surface glossiness of the roller after the image formation was 55.3. In this way, the surface glossiness of the roller was little changed before and after the image formation. This means that adhesion of tone on the surface of the roller little occurs.

Comparative Example 8

Cleaning Member

A cleaning roller having the same layer configuration as that shown in FIG. 1(B) was produced by forming the same intermediate resin layer 19 as that in Inventive Example 11 on the surface of the same elastic layer as that in Inventive Example 11, and forming the following outermost resin layer 21 having a thickness of 10 μm thereon.

Outermost Resin Layer 21

A paint 21 was prepared by dissolving a urethane modified acrylic resin (Tg: 27° C.) in MEK as a solvent and adding an isocyanate crosslinking agent thereto with an NCO index set to 1.5. In the urethane modified acrylic resin, the content of an acrylic component is 50 wt %, and acrylic monomers of the acrylic component do not contain fluorine at all. The intermediate resin layer 19 was coated with the paint 21 by a dipping method, to form the outermost resin layer 21.

The surface roughness of the cleaning roller was 0.7 μm in Rz (ten point average roughness specified in JIS). The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.5.

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.21 V.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation. Like Inventive Example 3 and Comparative Example 3, the surface glossiness of the roller before and after the image formation was measured. As a result, the surface glossiness of the roller before the image formation was 51.0 and the surface glossiness of the roller after the image formation was 27.9. In this way, the surface glossiness of the roller was significantly reduced after the image formation due to adhesion of tone on the surface of the roller.

Inventive Example 12

Charging Member

A charging roller having the same layer configuration as that shown in FIG. 1(B) was produced by forming an elastic layer (thickness: 3 mm, volume resistivity: $1\times10^3$ Ω·cm) made from a conductive urethane foam on the outer periphery of a metal shaft, forming the following intermediate resin layer 22 having a thickness of 100 μm on the surface of the elastic layer, and forming the following outermost resin layer 23 having a thickness of 10 μm thereon.

Intermediate Resin Layer 22

The intermediate resin layer 22 was formed by coating the elastic layer with a paint prepared by adding carbon to a water-based acrylic resin by a dipping method. The volume resistivity was adjusted to $5\times10^7$ Ω·cm.

Outermost Resin Layer 23

A paint was prepared by dissolving a polyamide resin (trade name: L203, produced by Sanyo Chemical Industries, Ltd.) in ethanol as a solvent and adding a pre-polymer obtained from a both-terminal alcohol modified silicone oil (trade name: FZ-3711, produced by Japan Yunika Co., Ltd.) by means of di-functionality isocyanate in an amount of 40 parts by weight on the basis of 100 parts by weight of the polyamide resin, and further adding an isocyanate crosslinking agent thereto with an NCO index set to 1.0. The intermediate resin layer 22 was coated with the paint by a dipping method, to form the outermost resin layer 23.

The resistance of the roller thus produced was $7\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sec was 0.10 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.25.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 13

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 24 having a thickness of 10 μm thereon.

Outermost Resin Layer 24

A paint was prepared by dissolving a polyamide resin (trade name: H1060, produced by Sanyo Chemical Industries, Ltd.) in ethanol as a solvent and adding an epoxy modified silicone oil (trade name: SF8411, produced by Toray-Dow Corning Silicone Corp.) in an amount of 5 parts by weight on the basis of 100 parts by weight of the polyamide resin, and further adding a melamine crosslinking agent in an amount of 5 parts by weight thereto on the basis of 100 parts by weight of the polyamide resin. The intermediate resin layer 22 was coated with the paint by a dipping method, to form the outermost resin layer 24.

The resistance of the roller thus produced was $5\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 7 V and the surface potential of the roller after 10 sec was 0.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.32.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 14

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 25 having a thickness of 10 μm thereon.

Outermost Resin Layer 25

A paint was prepared by dissolving a polyamide resin (trade name: A90, produced by Toray Industries, Inc.) in ethanol as a solvent and adding a single-terminal alcohol modified silicone oil (trade name: X-22-176F, produced by Shin-Etsu Chemical Co., Ltd.) in an amount of 3 parts by weight on the basis of 100 parts by weight of the polyamide resin, and further adding a melamine crosslinking agent in an amount of 5 parts by weight thereto on the basis of 100 parts by weight of the polyamide resin. The intermediate resin layer 22 was coated with the paint by a dipping method, to form the outermost resin layer 25.

The resistance of the roller thus produced was $2\times10^7$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.12 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.22.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 15

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 26 having a thickness of 10 μm thereon.

Outermost Resin Layer 26

A paint was prepared by dissolving a polyamide resin (trade name: Harmide 3228, produced by Harima Chemical, Inc.) in toluene as a solvent and adding a silicone resin (trade name: SR2306, produced by Toray-Dow Corning Silicone Corp.) in an amount of 40 parts by weight on the basis of 100 parts by weight of the polyamide resin, and further adding carbon as a conductive agent in an amount of 15 parts by weight on the basis of 100 parts by weight of the polyamide resin and an isocyanate crosslinking agent thereto with an NCO index set to 1.0. The intermediate resin layer 22 was coated with the paint by a dipping method, to form the outermost resin layer 26.

The resistance of the roller thus produced was $1\times10^6$ Ω. A charging roller was produced in the same manner as described above except that carbon as a conductive agent was not added to the outermost resin layer 26, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 25 V and the surface potential of the roller after 10 sec was 2.73 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.27.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Comparative Example 9

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 27 having a thickness of 10 μm thereon.

Outermost Resin Layer 27

A paint was prepared by dissolving a silicone resin (trade name: SR2306, produced by Toray-Dow Corning Silicone Corp.) in toluene as a solvent and adding carbon as a conductive agent thereto. The intermediate resin layer 22 was coated with the paint by a dipping method, to form the outermost resin layer 27.

The resistance of the roller thus produced was $1.8\times10^6$ Ω. A charging roller was produced in the same manner as described above except that carbon as a conductive agent was not added to the outermost resin layer 27, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 320 V and the surface potential of the roller after 10 sec was 180 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.15.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog was only slightly observed, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. Even after continuous printing on 8,000 pieces of sheets, quality of images was not improved.

Comparative Example 10

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 28 having a thickness of 10 μm thereon.

Outermost Resin Layer 28

A paint was prepared by dissolving a polyamide resin (trade name: H1060, produced by Sanyo Chemical Industries, Ltd.) in ethanol as a solvent and adding a melamine crosslinking agent thereto. The intermediate resin layer 22 was coated with the paint by a dipping method, to form the outermost resin layer 28.

The resistance of the roller thus produced was $5\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.73 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.88.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which initial image fog was not observed. At this time, the charging roller was taken out of the printer cartridge and was wiped, as a result of which a large amount of residual toner on the roller was observed. After continuous printing on 8,000 pieces of sheets, fog occurred due to adhesion of toner and deterioration of the surface layer.

Comparative Example 11

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 29 having a thickness of 10 μm thereon.

Outermost Resin Layer 29

A paint was prepared by dissolving a polyamide resin (trade name: X1850, produced by Sanyo Chemical Industries, Ltd.) in ethanol as a solvent, and adding a carbon as a conductive agent in an amount of 25 parts by weight and a melamine crosslinking agent in an amount of 5 parts by weight on the basis of 100 parts by weight of the polyamide resin. The intermediate resin layer 22 was coated with the paint by a dipping method, to form the outermost resin layer 29.

The resistance of the roller thus produced was $1.5\times10^6$ Ω. A charging roller was produced in the same manner as that described above except that carbon as a conductive agent was not added to the outermost resin layer 29, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 220 V and the surface potential of the roller after 10 sec was 90 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.07.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which fog slightly occurred, and the printer cartridge was also operated for image formation at a DC voltage Vdc=−1260 V, as a result of which fog occurred. At this time, the charging roller was taken out of the printer cartridge and was wiped, as a result of which a large amount of residual toner on the roller was observed. After continuous printing on 8,000 pieces of sheets, the degree of fog became worse.

Comparative Example 12

Charging Member

A charging roller having the same layer configuration as that shown in FIG. 1(B) was produced by forming the same intermediate resin layer 22 as that in Inventive Example 12 on the surface of the same elastic layer as that in Inventive Example 12, and forming the following outermost resin layer 30 having a thickness of 10 μm thereon.

Outermost Resin Layer 30

A paint was prepared by dissolving a polyamide resin (trade name: X1850, produced by Sanyo Chemical Industries, Ltd.) in ethanol as a solvent and adding a polyether modified silicone oil (trade name: SF8427, produced by Toray-Dow Corning Silicon Corp.) in an amount of 5 parts by weight on the basis of 100 parts by weight of the polyamide resin, and further adding a carbon as a conductive agent in an amount of 10 parts by weight and a melamine crosslinking agent in an amount of 5 parts by weight on the basis of 100 parts by weight of the polyamide resin. The intermediate resin layer 22 was coated with the paint by a dipping method, to form the outermost resin layer 30.

The resistance of the roller thus produced was $1.5\times10^6$ Ω. A charging roller was produced in the same manner as that described above except that carbon as a conductive agent was not added to the outermost resin layer 30, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 250 V and the surface potential of the roller after 10 sec was 100 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.44.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog slightly occurred, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. After continuous printing on 8,000 pieces of sheets, quality of images was not improved.

The results of evaluating the charging rollers in Inventive Examples 12 to 15 and Comparative Examples 9 to 12 are shown in Table 2.

TABLE 2

| Items to be | Inventive Examples | | | | Comparative Examples | | | |
|---|---|---|---|---|---|---|---|---|
| Evaluated | 12 | 13 | 14 | 15 | 9 | 10 | 11 | 12 |
| Initial Fog | ○ | ○ | ○Δ | ○ | Δx | ○ | x | x |
| Adhesiveness to OPC | ○ | ○Δ | ○ | ○ | ○ | x | x | ○ |
| Adhesion of Toner | ○ | ○Δ | ○ | ○ | ○ | x | x | ○ |
| Fog After Repeated Printing | ○ | ○Δ | ○Δ | ○ | x | Δx | x | x |

Criteria for Evaluation
○: very good
○Δ: good
Δ: ordinary
Δx: slightly poor
x: poor Inventive Example 16

Development Member

A paint 31 was prepared by dissolving a polyamide resin (trade name: A90, produced by Toray Industries, Inc.) in ethanol as a solvent and adding an epoxy modified silicone oil (trade name: SF8411, produced by Toray-Dow Corning Silicone Corp.) in an amount of 10 parts by weight on the basis of 100 parts by weight of the polyamide resin, and further adding a melamine crosslinking agent thereto.

An isoprene rubber roller was produced by forming an elastic layer (thickness: 6 mm, volume resistivity: $1\times10^5$ Ω·cm) around the outer periphery of a metal shaft. The elastic layer was made from a isoprene rubber with its resistance adjusted by adding a conductive agent (carbon black) thereto. The isoprene rubber roller was dipped in the above paint 31, followed by drying, to form an outermost resin layer 31 having a thickness of about 10 μm on the isoprene rubber elastic layer of the roller. A development roller having the same layer configuration as that shown in FIG. 1(A) was thus produced.

The surface roughness of the development roller was 3.4 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sec was 0.15 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.27.

Inventive Example 17

Development Member

A paint 32 was prepared by dissolving a polyamide resin (trade name: Harmide 3228, produced by Harima Chemical, Inc.) in toluene as a solvent and adding a pre-polymer obtained from a both-terminal alcohol modified silicone oil (trade name: FZ-3711, produced by Japan Yunika Co., Ltd.) by means of di-functionality isocyanate in an amount of 30 parts by weight on the basis of 100 parts by weight of the polyamide resin, and further adding a powder of silica in an amount of 20 parts by weight on the basis of 100 parts by weight of the polyamide resin and an isocyanate crosslinking agent thereto with an NCO index set to 1.0.

The same isoprene rubber roller as that in Inventive Example 16 was dipped in the above paint 32, followed by drying, to form an outermost resin layer 32 having a thickness of about 10 μm on the isoprene rubber elastic layer of the roller. A development roller having the same layer configuration as that shown in FIG. 1(A) was thus produced.

The surface roughness of the development roller was 6.7 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.29 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.17.

Inventive Example 18

Development Member

A paint 33 was prepared by dissolving a polyamide resin (trade name: Harmide 3228, produced by Harima Chemical, Inc.) in toluene as a solvent and adding a silicone resin (trade name: SR2306, produced by Toray-Dow Corning Silicone Corp.) in an amount of 40 parts by weight on the basis of 100 parts by weight of the polyamide resin, and further adding a powder of silica in an amount of 20 parts by weight and a melamine crosslinking agent in an amount of 10 parts by weight on the basis of 100 parts by weight of the polyamide resin.

A silicone rubber roller was produced by forming an elastic layer (thickness: 6 mm, volume resistivity: $1\times10^7$ Ω·cm) around the outer periphery of a metal shaft. The elastic layer was made from a silicone rubber with its resistance adjusted by adding a conductive agent (carbon black) thereto. The silicone rubber was dipped in the above paint 33, followed by drying, to form an outermost resin layer 33 having a thickness of about 10 μm on the silicone rubber elastic layer of the roller. A development roller having the same layer configuration as that shown in FIG. 1(A) was thus produced.

The surface roughness of the development roller was 4.1 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 22 V and the surface potential of the roller after 10 sec was 2.35 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.13.

Comparative Example 13

Development Member

A paint 34 was prepared by dissolving a polyamide resin (trade name: H1060, produced by Sanyo Chemical, Ltd.) in ethanol as a solvent and adding a melamine crosslinking agent in an amount of 5 parts by weight on the basis of 100 parts by weight of the polyamide resin.

The same isoprene rubber roller as that in Inventive Example 16 was dipped in the above paint 34, followed by drying, to form an outermost resin layer 34 having a thickness of about 10 μm on the isoprene rubber elastic layer of the roller. A development roller having the same layer configuration as that shown in FIG. 1(A) was thus produced.

The surface roughness of the development roller was 3.3 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.26 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.02.

Comparative Example 14

Development Member

A paint 35 was prepared by dissolving a polyamide resin (trade name: X1860, produced by Dai-ichi Kogyo Seiyaku Co., Ltd.) in ethanol as a solvent and adding a melamine crosslinking agent in an amount of 5 parts by weight on the basis of 100 parts by weight of the polyamide resin.

The same isoprene rubber roller as that in Inventive Example 16 was dipped in the above paint 35, followed by drying, to form an outermost resin layer 35 having a thickness of about 10 μm on the isoprene rubber elastic layer of the roller. A development roller having the same layer configuration as that shown in FIG. 1(A) was thus produced.

The surface roughness of the development roller was 3.4 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 270 V and the surface potential of the roller after 10 sec was 120 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.87.

Comparative Example 15

Development Member

A paint 36 was prepared by dissolving a polyamide resin (trade name: X1860, produced by Dai-ichi Kogyo Seiyaku Co., Ltd.) in ethanol as a solvent and adding a dimethyl silicone oil (trade name: SH200, produced by Toray-Dow Corning Silicone Corp.) in an amount of 4 parts by weight on the basis of 100 parts by weight of the polyamide resin.

The same isoprene rubber roller as that in Inventive Example 16 was dipped in the above paint 36, followed by drying, to form an outermost resin layer 16 having a thickness of about 10 μm on the isoprene rubber elastic layer of the roller. A development roller having the same layer configuration as that shown in FIG. 1(A) was thus produced.

The surface roughness of the development roller was 7.8 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 320 V and the surface potential of the roller after 10 sec was 140 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.35.

Each of the development rollers in Inventive Examples 16 to 18 and Comparative Examples 13 to 15 was evaluated, in terms of adhesiveness (stickiness) to an OPC, initial image fog, carrying performance of toner, charging performance of toner, image fog after repeated printing, and wear of the development roller, by the following methods. The results are shown in Table 3.

Adhesiveness (Stickiness) to OPC

A roller to be tested was incorporated as a development roller in the printer cartridge shown in FIG. 2 and was left for one week under an environment with a temperature of 40° C. and a humidity of 80% RH, and the adhesiveness of the development roller to a photosensitive drum was examined.

Initial Image Fog

A roller to be tested was incorporated as a development roller in the printer cartridge shown in FIG. 2, and the printer cartridge was operated for image formation in a reversal manner by rotating the development roller at a linear velocity (circumferential speed) of 60 mm/sec. In this printing, a non-magnetic one-component toner having an average particle of 7 μm was used, and the development bias voltage was set to 400 V. For each of images of white solid, half-tone, and black solid formed in the initial stage, the image quality (the presence or absence and the degree of fog) was evaluated.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Charging Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Image Fog After Repeated Printing

After the test for evaluating initial image fog, an endurance test was performed. In this endurance test, the printing operation was repeated to print images on 10,000 pieces of sheets, and for each of images, the same image evaluation as that for initial image fog was performed.

Wear of Development Roller

The roller to be tested was taken out of the printer cartridge after the above endurance test, and the surface of the roller was observed by a video microscope, to evaluate the degree of damage and wear of the surface of the roller.

TABLE 3

| | Inventive Example 16 | Inventive Example 17 | Inventive Example 18 | Comparative Example 13 | Comparative Example 14 | Comparative Example 15 |
|---|---|---|---|---|---|---|
| Adhesiveness to OPC | ○ | ○ | ○ | x | x | ○ |
| Initial Image Fog | ○ | ○ | ○ | ○ | x | x |
| Carrying Performance of Toner | ○ | ○ | ○ | x | x | x |
| Charging Performance of Toner | ○ | ○ | ○ | ○ | x | x |
| Fog After Repeated Printing | ○ | ○ | ○ | Δx | x | x |
| Wear of Development Roller | ○ | ○ | ○ | x | x | Δ |

Criteria for Evaluation
○: very good
○Δ: good
Δ: ordinary
Δx: slightly poor
x: poor Inventive Example 19

Transfer Member

A paint 37 was prepared by dissolving a polyamide resin (trade name: L203, produced by Sanyo Chemical Industries, Ltd.) in ethanol as a solvent and adding an epoxy modified silicone oil (trade name: SF8411, produced by Toray-Dow Coming Silicone Corp.) in an amount of 10 parts by weight on the basis of 100 parts by weight of the polyamide resin, further adding powder of carbon in a suitable amount, and adding a melamine crosslinking agent in an amount of 5 parts by weight on the basis of 100 parts by weight of the polyamide resin.

A urethane foam roller was produced by forming an elastic layer (thickness: 5 mm, volume resistivity: $1\times10^5$ Ω·cm) around the outer periphery of a metal shaft. The elastic layer was made from a urethane foam with its resistance adjusted by adding a conductive agent (carbon) thereto. The urethane foam roller was dipped in the above paint 37, followed by drying, to form an outermost resin layer 37 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 37. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.38 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.21.

Comparative Example 16

Transfer Member

A paint 38 was prepared by dissolving a polyamide resin (trade name: X1850, produced by Sanyo Chemical Industries, Ltd.) in ethanol as a solvent, and adding carbon as a conductive agent in an amount of 25 parts by weight and a melamine crosslinking agent in an amount of 5 parts by weight on the basis of 100 parts by weight of the polyamide resin.

The same urethane foam roller as that in Inventive Example 19 was dipped in the above paint 38, followed by drying, to form an outermost resin layer 38 having a thickness of about 10 μm on the urethane foam elastic layer of the roller. A development roller having the same layer configuration as that shown in FIG. 1(A) was thus produced.

A transfer roller was produced in the same manner as that described above except that carbon as a conductive agent was not added to the outermost resin layer 38. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 250 V and the surface potential of the roller after 10 sec was 120 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.85.

Each of the transfer rollers in Inventive Example 19 and Comparative Example 16 was pressed to a photosensitive drum at a load of 1 kg, and was left for two weeks under an environment with a temperature of 50° C. and a humidity of 85% RH. As a result, the roller in Inventive Example 19 did not cause any problem, while the roller in Comparative Example 16 caused adhesion and contamination between the roller and the photosensitive drum. Each of the transfer rollers in Inventive Example 19 and Comparative Example 16 was then incorporated in a laser printer, and the printer was operated to print images on 5,000 pieces of sheets. As a result, the roller in Inventive Example 19 did not cause any problem, while the roller in Comparative Example 16 caused spot omissions of characters in images and contamination of the back surfaces of transfer sheets due to toner contamination on the surface of the roller.

Inventive Example 20

Cleaning Member

A cleaning roller having the same layer configuration as that shown in FIG. 1(B) was produced by forming an elastic layer (thickness: 3 mm, volume resistivity: $1\times10^3$ Ω·cm) made from a conductive urethane foam around the outer periphery of a metal shaft, forming the following intermediate resin layer 39 having a thickness of 100 μm on the surface of the elastic layer, and forming the following outermost resin layer 40 having a thickness of 10 μm thereon.

Intermediate Resin Layer 39

The intermediate resin layer 39 was formed by coating the elastic layer with a paint 39 prepared by adding carbon to a water-based acrylic resin by a dipping method. The volume resistivity was adjusted to $5\times10^7$ Ω·cm.

Outermost Resin Layer 40

A paint 40 was prepared by dissolving a polyamide resin (trade name: Harmide 3228, produced by Harima Chemical, Inc.) in toluene as a solvent and adding a pre-polymer obtained from a both-terminal alcohol modified silicone oil (trade name: FZ-3711, produced by Japan Yunika Co., Ltd.) by means of di-functionality isocyanate in an amount of 35 parts by weight on the basis of 100 parts by weight of the polyamide resin, and further adding an isocyanate crosslinking agent thereto. The intermediate resin layer 39 was coated with the paint 40 by a dipping method, to form the outermost resin layer 40.

The surface roughness of the cleaning roller was 0.8 pm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 5 V and the surface potential of the roller after 10 sec was 0.28 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.22.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed.

Comparative Example 17

Cleaning Member

A cleaning roller having the same layer configuration as that shown in FIG. 1(B) was produced by forming the same intermediate resin layer 19 as that in Inventive Example 20 on the surface of the same elastic layer as that in Inventive Example 20, and forming the following outermost resin layer 41 having a thickness of 10 m thereon.

Outermost Resin Layer 41

A paint 41 was prepared by dissolving a polyamide resin (trade name: X1850, produced by Sanyo Chemical, Ltd.) in ethanol as a solvent, and adding a powder of carbon in an amount of 20 parts by weight and a melamine crosslinking agent in an amount of 5 parts by weight on the basis of 100 parts by weight of the polyamide. The intermediate resin layer 39 was coated with the paint 41 by a dipping method, to form the outermost resin layer 41.

The surface roughness of the cleaning roller was 0.8 $\mu$m in Rz (ten point average roughness specified in JIS). A cleaning roller was produced in the same manner as that described above except that carbon as a conductive agent was not added to the outermost resin layer 41, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 220 V and the surface potential of the roller after 10 sec was 100 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.21.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation.

Inventive Example 21

Charging Member

A charging roller having the same layer configuration as that shown in FIG. 1(B) was produced by forming an elastic layer (thickness: 3 mm, volume resistivity: $1\times10^6$ Ω·cm) made from a conductive urethane foam on the outer periphery of a metal shaft, forming the following intermediate resin layer 42 having a thickness of 100 $\mu$m on the surface of the elastic layer, and forming the following outermost resin layer 43 having a thickness of 10 $\mu$m thereon.

Intermediate Resin Layer 42

The intermediate resin layer 42 was formed by coating the elastic layer with a paint prepared by adding carbon to a water-based acrylic resin by a dipping method. The volume resistivity was adjusted to $5\times10^7$ Ω·cm.

Outermost Resin Layer 43

A paint was prepared by dissolving a urethane modified acrylic resin (trade name: EAU137B, produced by Asia Industries, Inc.) in MEK (methyl ethyl ketone) as a solvent and adding a fluorine-acryl block copolymer (trade name: Modiper F200, produced by NOF Corporation) in an amount of 5 parts by weight on the basis of 100 parts by weight of the urethane modified acrylic resin, and further adding an isocyanate crosslinking agent with an NCO index set to 1.5. The intermediate resin layer 42 was coated with the paint by a dipping method, to form the outermost resin layer 43.

The resistance of the roller thus produced was $4\times10^7$ Ω. The contact angle between the outermost resin layer 43 and water was 101°. A film made from the same material as that for the outermost resin layer 43 was produced. The film was left for one day in a state being stretched to a length being 1.5 times the original length under an environment with a temperature of 40° C. and a humidity of 95% RH, and a residual elongation was examined. The result showed that the residual elongation of the film was 31%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.18.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 22

Charging Member

A charging roller having the same layer configuration as that shown in FIG. 1(B) was produced by forming the above intermediate resin layer 42 having a thickness of 100 $\mu$m on the surface of the same elastic layer as that in Inventive Example 21, and forming the following outermost resin layer 44 having a thickness of 10 $\mu$m thereon.

Outermost Resin Layer 44

A paint was prepared by dissolving a urethane modified acrylic resin (trade name: EAU65B, produced by Asia Industries, Inc.) in MEK as a solvent and adding a fluororesin (trade name: LF200, produced by Asahi Glass Company) in an amount of 40 parts by weight on the basis of 100 parts by weight of the urethane modified acrylic resin, and further adding carbon in an amount of 20 parts by weight and a powder of silica in an amount of 30 parts by weight on the basis of 100 parts by weight of the urethane modified arylic resin and an isocyanate crosslinking agent with an NCO index set to 2.5. The intermediate resin layer 42 was coated with the paint by a dipping method, to form the outermost resin layer 44.

The resistance of the roller thus produced was $9\times10^5$ Ω. The contact angle between the outermost resin layer 44 and water was 91°. A film made from the same material as that for the outermost resin layer 44 was produced. The film was left for one day in a state being stretched to a length being 1.5 times the original length under an environment with a temperature of 40° C. and a humidity of 95% RH, and a residual elongation was examined. The result showed that it the residual elongation of the film was 23%. A charging roller was produced in the same manner as that described above except that carbon as a conductive agent was not added to the outermost resin layer 44, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 15 V and the surface potential of the roller after 10 sec was 0.89 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.49.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 23

Charging Member

A charging roller having the same layer configuration as that shown in FIG. 1(B) was produced by forming the above intermediate resin layer 42 having a thickness of 100 μm on the surface of the same elastic layer as that in Inventive Example 21, and forming the following outermost resin layer 45 having a thickness of 10 μm thereon.

Outermost Resin Layer 45

A paint was prepared by dissolving a urethane modified acrylic resin in MEK as a solvent and adding an isocyanate crosslinking agent with an NCO index set to 1.5. The urethane modified acrylic resin was produced by grafting, in a urethane pre-polymer, an acrylic polymer obtained by porimerizing acrylic monomers containing 80 wt % of fluorine-containing acrylic monomers. The intermediate resin layer 42 was coated with the paint by a dipping method, to form the outermost resin layer 45.

The resistance of the roller thus produced was $7\times10^7$ Ω. The contact angle between the outermost resin layer 45 and water was 98°. A film made from the same material as that for the outermost resin layer 45 was produced. The film was left for one day in a state being stretched to a length being 1.5 times the original length under an environment with a temperature of 40° C. and a humidity of 95% RH, and a residual elongation was examined. The result showed that the residual elongation of the film was 25%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.34 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.41.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Comparative Example 18

Charging Member

A charging roller having the same layer configuration as that shown in FIG. 1(B) was produced by forming the above intermediate resin layer 42 having a thickness of 100 μm on the surface of the same elastic layer as that in Inventive Example 21, and forming the following outermost resin layer 46 having a thickness of 10 μm thereon.

Outermost Resin Layer 46

A paint was prepared by adding 35 parts by weight of carbon to 100 parts by weight of a fluororesin (trade name: LF200, produced by Asahi Glass Company). The intermediate resin layer 42 was coated with the paint by a dipping method, to form the outermost resin layer 46.

The resistance of the roller thus produced was $1\times10^6$ Ω. The contact angle between the outermost resin layer 46 and water was 95°. A film made from the same material as that for the outermost resin layer 46 was produced. The film was left for one day in a state being stretched to a length being 1.5 times the original length under an environment with a temperature of 40° C. and a humidity of 95% RH, and a residual elongation was examined. The result showed that the residual elongation of the film was 70%. A charging roller was produced in the same manner as that described above except that carbon as a conductive agent was not added to the outermost resin layer 46, and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 400 V and the surface potential of the roller after 10 sec was 200 V. The roller was then subjected to friction testing using a cloth of 70 mesh containing 100% of cellulose (density: 30 g/m$^2$) by a measurement instrument shown in FIG. 4 under a condition with a temperature of 22°

C. and a humidity of 50% RH. The result showed that the friction coefficient of the roller was 0.25.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog was only slightly observed but a streak due to a nip mark was observed periodically in the running direction of the charging roller, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. Even after continuous printing on 8,000 pieces of sheets, quality of images was not improved.

Comparative Example 19

Charging Member

A charging roller having the same layer configuration as that shown in FIG. 1(B) was produced by forming the above intermediate resin layer 42 having a thickness of 100 μm on the surface of the same elastic layer as that in Inventive Example 21, and forming the following outermost resin layer 47 having a thickness of 10 μm thereon.

Outermost Resin Layer 47

A paint was prepared by dissolving a urethane modified acrylic resin (trade name: EAU65B, produced by Asia Industries, Inc.) in MEK as a solvent and adding an isocyanate crosslinking agent with an NCO index set to 1.5. The intermediate resin layer 42 was coated with the paint by a dipping method, to form the outermost resin layer 47.

The resistance of the roller thus produced was $2\times10^7$ Ω. The contact angle between the outermost resin layer 47 and water was 84°. A film made from the same material as that for the outermost resin layer 47 was produced. The film was left for one day in a state being stretched to a length being 1.5 times the original length under an environment with a temperature of 40° C. and a humidity of 95% RH, and a residual elongation was examined. The result showed that the residual elongation of the film was 15%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sea was 0.23 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.87.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which initial image fog was not observed and also any periodical nip mark in the rotational direction of the charging roller was not observed. At this time, the charging roller was taken out of the printer cartridge and was wiped, as a result of which a large amount of residual toner on the roller was observed. After continuous printing on 8,000 pieces of sheets, fog occurred due to adhesion of toner and deterioration of the surface layer of the roller.

The results of evaluating the charging rollers in Inventive Examples 21 to 23 and Comparative Examples 18 and 19 are shown in Table 4.

TABLE 4

| Items to be Evaluated | Inventive Examples 21 | 22 | 23 | Comparative Examples 18 | 19 |
|---|---|---|---|---|---|
| Initial Fog | ○ | ○Δ | ○ | x | ○ |
| Adhesiveness to OPC | ○Δ | ○ | ○ | ○ | x |
| Adhesion of Toner | ○Δ | ○Δ | ○ | ○ | x |
| Nip Mark | ○ | ○ | ○ | x | ○ |
| Fog After Repeated Printing | ○Δ | ○Δ | ○ | x | Δx |

Criteria for Evaluation
○: very good
○Δ: good
Δ: ordinary
Δx: slightly poor
x: poor Inventive Example 24

Development Member

A paint 48 was prepared by dissolving a urethane modified acrylic resin (trade name: EAU137B, produced by Asia Industries, Inc.) in MEK (methyl ethyl ketone) as a solvent and adding a fluororesin composed of a fluorine-acryl block copolymer (trade name: Modiper F200, produced by NOF Corporation) in an amount of 10 parts by weight on the basis of 100 parts by weight of the urethane modified acrylic resin, and further adding an isocyanate crosslinking agent with an NCO index set to 1.5. A sheet was formed by drying the paint 48. The contact angle between the sheet and water was measured, the result of which was 110°.

An isoprene rubber roller was produced by forming an elastic layer (thickness: 6 mm, volume resistivity: $1\times10^5$ Ω·cm) around the outer periphery of a metal shaft. The elastic layer was made from an isoprene rubber with its resistance adjusted by adding a conductive agent (carbon black) thereto. The isoprene rubber roller was dipped in the above paint 48, followed by drying, to form an outermost resin layer 48 having a thickness of about 10 μm on the isoprene rubber elastic layer of the roller. A development roller having the same layer configuration as that shown in FIG. 1(A) was thus produced.

The surface roughness of the development roller was 4.1 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.35 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.16.

Inventive Example 25

Development Member

A paint 49 was prepared by dissolving a urethane modified acrylic resin (trade name: EAU137B, produced by Asia Industries, Inc.) in MEK as a solvent and adding a fluororesin (trade name: Kynar 7201, produced by Elf Atochem Japan) in an amount of 30 parts by weight on the basis of 100 parts by weight of the urethane modified acrylic resin, and further adding an isocyanate crosslinking agent with an NCO index set to 1.5. A sheet was formed by drying the paint 49. The contact angle between the sheet and water was measured, the result of which was 96°.

The same isoprene rubber roller as that in Inventive Example 24 was dipped in the above paint 49, followed by drying, to form an outermost resin layer 49 having a thickness of about 10 μm on the isoprene rubber elastic layer of the roller. A development roller having the same layer configuration as that shown in FIG. 1(A) was thus produced.

The surface roughness of the development roller was 4.7 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 19 V and the surface potential of the roller after 10 sec was 1.37 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.31.

Inventive Example 26

Development Member

A paint 50 was prepared by dissolving a urethane modified acrylic resin in MEK as a solvent, and adding an isocyanate crosslinking agent thereto with an NCO index set to 1.5. The urethane modified acrylic resin was produced by grafting, in a urethane pre-polymer, an acrylic polymer obtained by polymerizing acrylic monomers containing 80 wt % of fluorine-containing acrylic monomers. A sheet was formed by drying the paint 50. The contact angle between the sheet and water was measured, the result of which was 96°.

The same isoprene rubber roller as that in Inventive Example 24 was dipped in the above paint 50, followed by drying, to form an outermost resin layer 50 having a thickness of about 10 μm on the isoprene rubber elastic layer of the roller. A development roller having the same layer configuration as that shown in FIG. 1(A) was thus produced.

The surface roughness of the development roller was 3.7 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 5 V and the surface potential of the roller after 10 sec was 0.57 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.28.

Comparative Example 20

Development Member

A paint 51 was prepared by dissolving a urethane modified acrylic resin (trade name: EAU65B, produced by Asia Industries, Inc.) in MEK as a solvent, and adding an isocyanate crosslinking agent thereto with an NCO index set to 1.5. A sheet was formed by drying the paint 51. The contact angle between the sheet and water was measured, the result of which was 84°.

The same isoprene rubber roller as that in Inventive Example 24 was dipped in the above paint 51, followed by drying, to form an outermost resin layer 51 having a thickness of about 10 μm on the isoprene rubber elastic layer of the roller. A development roller having the same layer configuration as that shown in FIG. 1(A) was thus produced.

The surface roughness of the development roller was 3.3 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.17 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.52.

Comparative Example 21

Development Member

A paint 52 was prepared by dissolving a fluororesin (trade name: LF710, produced by Asahi Glass Company) in MEK as a solvent, and adding an isocyanate crosslinking agent thereto with an NCO index set to 1.5. A sheet was formed by drying the paint 52. The contact angle between the sheet and water was measured, the result of which was 98°.

The same isoprene rubber roller as that in Inventive Example 24 was dipped in the above paint 52, followed by drying, to form an outermost resin layer 52 having a thickness of about 10 μm on the isoprene rubber elastic layer of the roller. A development roller having the same layer configuration as that shown in FIG. 1(A) was thus produced.

The surface roughness of the development roller was 3.8 μm in Rz (ten point average roughness specified in JIS).

The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 600 V and the surface potential of the roller after 10 sec was 420 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.31.

Each of the development rollers in Inventive Examples 24 to 26 and Comparative Examples 20 and 21 was evaluated, in terms of adhesiveness (stickiness) to an OPC, initial image fog, carrying performance of toner, charging performance of toner, image fog after repeated printing, and wear of the development roller, by the following methods. The results are shown in Table 5.

Adhesiveness (Stickiness) to OPC

A roller to be tested was incorporated as a development roller in the printer cartridge shown in FIG. 2 and was left for one week under an environment with a temperature of 40° C. and a humidity of 80% RH, and the adhesiveness of the development roller to a photosensitive drum was examined.

Initial Image Fog

A roller to be tested was incorporated as a development roller in the printer cartridge shown in FIG. 2, and the printer cartridge was operated for image formation in a reversal manner by rotating the development roller at a linear velocity (circumferential speed) of 60 mm/sec. In this printing, a non-magnetic one-component toner having an average particle of 7 $\mu$m was used, and the development bias voltage was set to 400 V. For each of images of white solid, half-tone, and black solid formed in the initial stage, the image quality (the presence or absence and the degree of fog) was evaluated.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Charging Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Image Fog After Repeated Printing

After the test for evaluating initial image fog, an endurance test was performed. In this endurance test, the printing operation was repeated to print images on 10,000 pieces of sheets, and for each of images, the same image evaluation as that for initial image fog was performed.

Wear of Development Roller

The roller to be tested was taken out of the printer cartridge after the above endurance test, and the surface of the roller was observed by a video microscope, to evaluate the degree of damage and wear of the surface of the roller.

Inventive Example 27

Transfer Member

A paint 53 was prepared by dissolving a urethane modified acrylic resin (trade name: EAU53B, produced by Asia Industries, Inc.) in MEK as a solvent and adding a fluororesin composed of a fluorine-acryl block copolymer (trade name: Modiper F200, produced by NOF Corporation) in an amount of 15 parts by weight on the basis of 100 parts by weight of the urethane modified acrylic resin, and further adding a powder of carbon in an amount of 10 parts by weight on the basis of 100 parts by weight of the urethane modified acrylic resin and an isocynate crosslinking agent with an NCO index set to 1.5. A sheet was formed by drying the paint 53. The contact angle between the sheet and water was measured, the result of which was 98°.

A urethane foam roller was produced by forming an elastic layer (thickness: 6 mm, volume resistivity: $1\times10^7$ Ω·cm) around the outer periphery of a metal shaft. The elastic layer was made from a urethane foam with its resistance adjusted by adding a conductive agent (carbon black) thereto. The urethane foam roller was dipped in the above paint 53, followed by drying, to form an outermost resin layer 53 having a thickness of about 10 $\mu$m on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 53. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.29 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.17.

TABLE 5

| | Inventive Example 24 | Inventive Example 25 | Inventive Example 26 | Comparative Example 20 | Comparative Example 21 |
|---|---|---|---|---|---|
| Adhesiveness to OPC | ○ | ○ | ○ | x | ○ |
| Initial Image Fog | ○ | ○ | ○ | ○ | x |
| Carrying Performance of Toner | ○Δ | ○Δ | ○ | x | x |
| Charging Performance of Toner | ○ | ○Δ | ○ | Δ | x |
| Fog After Repeated Printing | ○ | ○Δ | ○ | Δx | x |
| Wear of Development Roller | ○Δ | ○ | ○ | x | ○ |

Criteria for Evaluation

○: very good

○Δ: good

Δ: ordinary

Δx: slightly poor x: poor

Comparative Example 22

Transfer Member

A paint 54 was prepared by suitably adjusting the concentration of a urethane modified acrylic resin (trade name: EAU65B, produced by Asia Industries, Inc.) and adding a powder of carbon in an amount of 8 parts by weight on the basis of 100 parts by weight of the urethane modified acrylic resin, and further adding an isocyanate crosslinking agent with an NCO index set to 1.5. A sheet was produced by drying the paint 54. The contact angle between the sheet and water was measured, the result of which was 87°.

The same urethane foam roller as that in Inventive Example 27 was dipped in the above paint 54, followed by drying, to form an outermost resin layer 54 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 54. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.31 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.88.

Each of the transfer rollers in Inventive Example 27 and Comparative Example 22 was pressed to a photosensitive drum at a load of 1 kg, and was left for two weeks under an environment with a temperature of 50° C. and a humidity of 85% RH. As a result, the roller in Inventive Example 27 did not cause any problem, while the roller in Comparative Example 22 caused adhesion and contamination between the roller and the photosensitive drum. Each of the transfer rollers in Inventive Example 27 and Comparative Example 22 was then incorporated in a laser printer, and the printer was operated to print images on 5,000 pieces of sheets. As a result, the roller in Inventive Example 27 did not cause any problem, while the roller in Comparative Example 22 caused spot omissions of characters in images and contamination of the back surfaces of transfer sheets due to toner contamination on the surface of the roller.

Inventive Example 28

Cleaning Member

A cleaning roller having the same layer configuration as that shown in FIG. 1(B) was produced by forming an elastic layer (thickness: 3 mm, volume resistivity: $1\times10^3$ Ω·cm) made from a conductive urethane foam around the outer periphery of a metal shaft, forming the following intermediate resin layer 55 having a thickness of 100 μm on the surface of the elastic layer, and forming the following outermost resin layer 56 having a thickness of 10 μm thereon.

Intermediate Resin Layer 55

The intermediate resin layer 55 was formed by coating the elastic layer with a paint prepared by adding carbon to a water-based acrylic resin by a dipping method. The volume resistivity was adjusted to $5\times10^7$ Ω·cm.

Outermost Resin Layer 56

A paint 56 was prepared by dissolving a urethane modified acrylic resin (trade name: EAU53B, produced by Asia Industries, Inc.) in MEK as a solvent and adding a fluororesin (trade name: LF200, produced by Asahi Glass Company) in an amount of 50 parts by weight on the basis of 100 parts by weight of the urethane modified acrylic resin, and further adding a powder of carbon in an amount of 30 parts by weight on the basis of 100 parts by weight of the urethane modified acrylic resin and an isocyanate crosslinking agent with an NCO index set to 1.5. The intermediate resin layer 55 was then coated with the paint 56 by a dipping method, to form the outermost resin layer 56. A sheet was produced by drying the paint 56. The contact angle between the sheet and water was measured, the result of which was 93°.

The surface roughness of the cleaning roller was 1.0 μm in Rz (ten point average roughness specified in JIS). A roller was produced in the same manner as that described above except that carbon as a conductive agent was not added to the outermost resin layer 56 and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 21 V and the surface potential of the roller after 10 sec was 1.88 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.28.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed.

Comparative Example 23

Cleaning Member

A cleaning roller having the same layer configuration as that shown in FIG. 1(B) was produced by forming the same intermediate resin layer 55 as that in Inventive Example 28 on the surface of the same elastic layer as that in Inventive Example 28, and forming the following outermost resin layer 57 having a thickness of 10 μm thereon.

Outermost Resin Layer 57

A paint 57 was prepared by dissolving a urethane modified acrylic resin (trade name: EAU151B, produced by Asia Industries, Inc.) in MEK as a solvent and adding an isocyanate crosslinking agent with an NCO index set to 1.5. The intermediate resin layer 55 was coated with the paint 57 by a dipping method, to form the outermost resin layer 57. A sheet was produced by drying the paint 57. The contact angle between the sheet and water was measured, the result of which was 85°.

The surface roughness of the cleaning roller was 0.5 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.23 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.21.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation.

Inventive Example 29

Charging Member

A charging roller having the same layer configuration as that shown in FIG. 1(B) was produced by forming an elastic layer (thickness: 3 mm, volume resistivity: $1\times10^6$ Ω·cm) made from a conductive urethane foam on the outer periphery of a metal shaft, forming the following intermediate resin layer 58 having a thickness of 100 μm on the surface of the elastic layer, and forming the following outermost resin layer 59 having a thickness of 10 μm thereon.

Intermediate Resin Layer 58

The intermediate resin layer 58 was formed by coating the elastic layer with a paint prepared by adding carbon to a water-based acrylic resin by a dipping method. The volume resistivity was adjusted to $5\times10^7$ Ω·cm.

Outermost Resin Layer 59

A paint was prepared by dissolving a urethane resin (trade name: DP307, produced by Sanyo Chemical Industries, Ltd.) in MEK (methyl ethyl ketone) as a solvent and adding a fluorine-acryl block copolymer (trade name: Modiper F200, produced by NOF Corporation) in an amount of 15 parts by weight on the basis of 100 parts by weight of the urethane resin, and further adding an isocyanate crosslinking agent in an amount of 10 parts by weight on the basis of 100 parts by weight of the urethane resin. The intermediate resin layer 58 was coated with the paint by a dipping method, to form the outermost resin layer 59.

The resistance of the roller thus produced was $3\times10^7$ Ω. The contact angle between the outermost resin layer 59 and water was 93°. A film made from the same material as that for the outermost resin layer 59 was produced. The film was left for one day in a state being stretched to a length being 1.5 times the original length under an environment with a temperature of 40° C. and a humidity of 95% RH, and a residual elongation was examined. The result showed that the residual elongation of the film was 19%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.25 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.35.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 30

Charging Member

A charging roller having the same layer configuration as that shown in FIG. 1(A) was produced by forming the following outermost resin layer 60having a thickness of 10 μm on the surface of the same elastic layer as that in Inventive Example 29.

Outermost Resin Layer 60

A paint was prepared by adding 10 parts by weight of a fluorine-acryl block copolymer (trade name: Modiper F200, produced by NOF Corporation) to 100 parts by weight of a water-based urethane resin (trade name: E2000, produced by Dai-ichi Kogyo Seiyaku Co., Ltd.). The elastic layer was coated with the paint by a dipping method, to form the outermost resin layer 60.

The resistance of the roller thus produced was $6\times10^5$ Ω. The contact angle between the outermost resin layer 60 and water was 92°. A film made from the same material as that for the outermost resin layer 60 was produced. The film was left for one day in a state being stretched to a length being 1.5 times the original length under an environment with a temperature of 40° C. and a humidity of 95% RH, and a residual elongation was examined. The result showed that the residual elongation of the film was 25%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4.1 V and the surface potential of the roller after 10 sec was 0.23 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.46.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 31

Charging Member

A charging roller having the same layer configuration as that shown in FIG. 1(B) was produced by forming the above-described intermediate resin layer 58 having a thickness of 100 Am on the surface of the same elastic layer as that in Inventive Example 29, and forming the following outermost resin layer 61 having a thickness of 10 μm thereon.

Outermost Resin Layer 61

A paint was prepared by dissolving a urethane resin (trade name: XN304, produced by Sanyo Chemical Industries, Ltd.) in MEK as a solvent and adding a fluororesin (trade name: Kynar 7201, produced by Elf Atochem Japan) in an amount of 30 parts by weight on the basis of 100 parts by weight of the urethane resin, and further adding carbon as a conductive agent in an amount of 30 parts by weight and an isocyanate crosslinking agent in an amount of 5 parts by weight on the basis of 100 parts by weight of the urethane resin. The intermediate resin layer 58 was coated with the paint by a dipping method, to form the outermost resin layer 61.

The resistance of the roller thus produced was $1\times10^6$ Ω. The contact angle between the outermost resin layer 61 and water was 99°. A film made from the same material as that for the outermost resin layer 61 was produced. The film was left for one day in a state being stretched to a length being 1.5 times the original length under an environment with a temperature of 40° C. and a humidity of 95% RH, and a residual elongation was examined. The result showed that the residual elongation of the film was 29%. A charging roller was produced in the same manner as that described above except that carbon as a conductive agent was not added to the outermost resin layer 61. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 45 V and the surface potential of the roller after 10 sec was 3.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.29.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 32

Charging Member

A charging roller having the same layer configuration as that shown in FIG. 1(B) was produced by forming the above-described intermediate resin layer 58 having a thickness of 100 μm on the surface of the same elastic layer as that in Inventive Example 29, and forming the following outermost resin layer 62 having a thickness of 10 μm thereon.

Outermost Resin Layer 62

A paint was prepared by dissolving a urethane resin (trade name: DP307, produced by Sanyo Chemical Industries, Ltd.) in MEK as a solvent and adding a fluororesin (trade name: LF200, produced by Asahi Glass Company) in an amount of 60 parts by weight on the basis of 100 parts by weight of the urethane resin, and further adding carbon as a conductive agent in an amount of 30 parts by weight and an isocyanate crosslinking agent in an amount of 10 parts by weight on the basis of 100 parts by weight of the urethane resin. The intermediate resin layer 58 was coated with the paint by a dipping method, to form the outermost resin layer 62.

The resistance of the roller thus produced was $1.5\times10^6$ Ω. The contact angle between the outermost resin layer 62 and water was 91°. A film made from the same material as that for the outermost resin layer 62 was produced. The film was left for one day in a state being stretched to a length being 1.5 times the original length under an environment with a temperature of 40° C. and a humidity of 95% RH, and a residual elongation was examined. The result showed that the residual elongation of the film was 32%. A charging roller was produced in the same manner as that described above except that carbon as a conductive agent was not added to the outermost resin layer 62. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 32 V and the surface potential of the roller after 10 sec was 1.75 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.33.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed, and also any periodical nip mark in the rotational direction of the charging roller was not observed. At this time, the charging roller was taken out of the printer cartridge and was wiped, as a result of which any residual toner on the roller was not observed. Even after continuous printing on 8,000 pieces of sheets, degradation of images was not observed.

Comparative Example 24

Charging Member

A charging roller having the same layer configuration as that shown in FIG. 1(B) was produced by forming the above-described intermediate resin layer 58 having a thickness of 100 μm on the surface of the same elastic layer as that in Inventive Example 29, and forming the following outermost resin layer 63 having a thickness of 10 μm thereon.

Outermost Resin Layer 63

A paint 63 was prepared by adding 30 parts by weight of carbon to 100 parts by weight of a fluororesin (trade name: LF200, produced by Asahi Glass Company). The intermediate resin layer 58 was coated with the paint 63 by a dipping method, to form the outermost resin layer 63.

The resistance of the roller thus produced was $1\times10^6$ Ω. The contact angle between the outermost resin layer 63 and water was 95°. A film made from the same material as that for the outermost resin layer 63 was produced. The film was left for one day in a state being stretched to a length being 1.5 times the original length under an environment with a temperature of 40° C. and a humidity of 95% RH, and a residual elongation was examined. The result showed that the residual elongation of the film was 70%. A charging roller was produced in the same manner as that described above except that carbon as a conductive agent was not added to the outermost resin layer 63. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 400 V and the surface potential of the roller after 10 sec was 200 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.25.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog was only slightly observed but a streak due to a nip mark was observed periodically in the rotational direction of the charging roller, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. Even after continuous printing on 8,000 pieces of sheets, quality of images was not improved.

Comparative Example 25

Charging Member

A charging roller having the same layer configuration as that shown in FIG. 1(B) was produced by forming the above intermediate resin layer 58 having a thickness of 100 μm on the surface of the same elastic layer as that in Inventive Example 29, and forming the following outermost resin layer 64 having a thickness of 10 μm thereon.

Outermost Resin Layer 64

A paint was prepared by dissolving a urethane resin (trade name: DP307, produced by Sanyo Chemical Industries, Ltd.) in MEK as a solvent and adding an isocyanate crosslinking agent thereto. The intermediate resin layer 58 was coated with the paint by a dipping method, to form the outermost resin layer 64.

The resistance of the roller thus produced was $2\times10^7$ Ω. The contact angle between the outermost resin layer 64 and water was 80°. A film made from the same material as that for the outermost resin layer 64 was produced. The film was left for one day in a state being stretched to a length being 1.5 times the original length under an environment with a temperature of 40° C. and a humidity of 95% RH, and a residual elongation was examined. The result showed that the residual elongation of the film was 18%. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sec was 0.23 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.57.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which initial image fog was not observed and also any periodical nip mark in the rotational direction of the charging roller was not observed. At this time, the charging roller was taken out of the printer cartridge and was wiped, as a result of which a large amount of residual toner on the roller was observed. After continuous printing on 8,000 pieces of sheets, fog occurred due to adhesion of toner and deterioration of the surface layer of the roller.

Comparative Example 26

Charging Member

A charging roller having the same layer configuration as that shown in FIG. 1(A) was produced by forming the following outermost resin layer 65 having a thickness of 10 μm on the same elastic layer as that in Inventive Example 29.

Outermost Resin Layer 65

A paint was prepared by adding carbon to a water-based urethane resin (trade name: SuperFlex 420, produced by Dai-ichi Kogyo Seiyaku Co., Ltd.). The elastic layer was coated with the paint by a dipping method, to form the outermost resin layer 65.

The resistance of the roller thus produced was $1.5\times10^6$ Ω. The contact angle between the outermost resin layer 65 and water was 77°. A film made from the same material as that for the outermost resin layer 65 was produced. The film was left for one day in a state being stretched to a length being 1.5 times the original length under an environment with a temperature of 40° C. and a humidity of 95% RH, and a residual elongation was examined. The result showed that the residual elongation of the film was 30%. A charging roller was produced in the same manner as that described above except that carbon as a conductive agent was not added to the outermost resin layer 65. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 800 V and the surface potential of the roller after 10 sec was 500 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.91.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which fog occurred, and the printer cartridge was also operated for image formation at a DC voltage Vdc=−1260 V, as a result of which fog occurred. However, any periodical nip mark in the rotational direction of the charging roller was not observed. At this time, the charging roller was taken out of the printer cartridge and was wiped, as a result of which a slight amount of residual toner on the roller was observed. After continuous printing on 8,000 pieces of sheets, the degree of fog became worse.

Comparative Example 27

Charging Member

A charging roller having the same layer configuration as that shown in FIG. 1(A) was produced by forming the following outermost resin layer 66 having a thickness of 10 μm on the same elastic layer as that in Inventive Example 29.

Outermost Resin Layer 66

A paint was prepared by adding carbon to a water-based urethane resin (trade name: TPLS, produced by Sumitomo Bayer Urethane Co., Ltd.). The elastic layer was coated with the paint by a dipping method, to form the outermost resin layer 66.

The resistance of the roller thus produced was 8.5×10$^5$ Ω. The contact angle between the outermost resin layer 66 and water was 75°. A film made from the same material as that for the outermost resin layer 66 was produced. The film was left for one day in a state being stretched to a length being 1.5 times the original length under an environment with a temperature of 40° C. and a humidity of 95% RH, and a residual elongation was examined. The result showed that the residual elongation of the film was 90%. A charging roller was produced in the same manner as that described above except that carbon as a conductive agent was not added to the outermost resin layer 66. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 180 V and the surface potential of the roller after 10 sec was 20 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.05.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which fog slightly occurred and a periodical nip mark in the rotational direction of the charging roller was observed in the images. At this time, the charging roller was taken out of the printer cartridge and was wiped, as a result of which residual toner on the roller was observed. After continuous printing on 8,000 pieces of sheets, the degree of fog became worse.

The results of evaluating the charging rollers in Inventive Examples 29 to 32 and Comparative Examples 24 to 27 are shown in Table 6.

TABLE 6

| Items to be | Inventive Examples | | | | Comparative Examples | | | |
|---|---|---|---|---|---|---|---|---|
| Evaluated | 29 | 30 | 31 | 32 | 24 | 25 | 26 | 27 |
| Initial Fog | ○ | ○ | ○Δ | ○ | Δx | ○ | x | Δ |
| Adhesiveness to OPC | ○ | ○Δ | ○ | ○Δ | ○ | x | x | x |
| Adhesion of Toner | ○ | ○Δ | ○ | ○Δ | ○ | x | Δ | Δx |
| Nip Mark | ○ | ○ | ○ | ○ | x | ○ | ○ | x |
| Fog After Repeated Printing | ○ | ○Δ | ○Δ | ○ | x | Δx | x | x |

Criteria for Evaluation
○: very good
○Δ: good
Δ: ordinary
Δx: slightly poor
x: poor Inventive Example 33

Development Member

A paint 67 was prepared by dissolving a urethane resin (trade name: DP307, produced by Sanyo Chemical Industries, Ltd.) in MEK (methyl ethyl ketone) as a solvent and adding a fluororesin composed of a fluorine-acryl block copolymer (trade name: Modiper F200, produced by NOF Corporation) in an amount of 15 parts by weight on the basis of 100 parts by weight of the urethane resin, and further adding an isocyanate crosslinking agent with an NCO index set to 1.5. A sheet was formed by drying the paint 67. The contact angle between the sheet and water was measured, the result of which was 93°.

An isoprene rubber roller was produced by forming an elastic layer (thickness: 6 mm, volume resistivity: 1×10$^5$ Ω·cm) around the outer periphery of a metal shaft. The elastic layer was made from an isoprene rubber with its resistance adjusted by adding a conductive agent (carbon black) thereto. The isoprene rubber roller was dipped in the above paint A, followed by drying, to form an outermost resin layer 67 having a thickness of about 10 μm on the isoprene rubber elastic layer of the roller. A development roller having the same layer configuration as that shown in FIG. 1(A) was thus produced.

The surface roughness of the development roller was 3.8 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.25 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.29.

Inventive Example 34

Development Member

A paint 68 was prepared by dissolving a urethane resin (trade name: XN304, produced by Sanyo Chemical Industries, Ltd.) in MEK as a solvent and adding a fluororesin (trade name: Kynar 7201, produced by Elf Atochem Japan) in an amount of 30 parts by weight on the basis of 100 parts by weight of the urethane resin, and further adding an isocyanate crosslinking agent with an NCO index set to 1.5. A sheet was formed by drying the paint 68. The contact angle between the sheet and water was measured, the result of which was 95°.

The same isoprene rubber roller as that in Inventive Example 33 was dipped in the above paint 68, followed by drying, to form an outermost resin layer 68 having a thickness of about 10 μm on the isoprene rubber elastic layer of the roller. A development roller having the same layer configuration as that shown in FIG. 1(A) was thus produced.

The surface roughness of the development roller was 4.9 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 31 V and the surface potential of the roller after 10 sec was 1.57 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.18.

Comparative Example 28

Development Member

A paint 69 was prepared by dissolving a urethane resin (trade name: DP307, produced by Sanyo Chemical Industries, Ltd.) in MEK as a solvent, and adding an isocyanate crosslinking agent thereto with an NCO index set to 1.5. A sheet was formed by drying the paint 69. The contact angle between the sheet and water was measured, the result of which was 80°.

The same isoprene rubber roller as that in Inventive Example 33 was dipped in the above paint 69, followed by drying, to form an outermost resin layer 69 having a thickness of about 10 μm on the isoprene rubber elastic layer of the roller. A development roller having the same layer configuration as that shown in FIG. 1(A) was thus produced.

The surface roughness of the development roller was 3.0 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.18.

Comparative Example 29

Development Member

A paint 70 was prepared by suitably adjusting the concentration of a water-based urethane resin (trade name: SuperFlex 420, produced by Dai-ichi Kogyo Seiyaku Co., Ltd.). A sheet was formed by drying the paint 70. The contact angle between the sheet and water was measured, the result of which was 77°.

The same isoprene rubber roller as that in Inventive Example 33 was dipped in the above paint 70, followed by drying, to form an outermost resin layer 70 having a thickness of about 10 μm on the isoprene rubber elastic layer of the roller. A development roller having the same layer configuration as that shown in FIG. 1(A) was thus produced.

The surface roughness of the development roller was 3.2 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 500 V and the surface potential of the roller after 10 sec was 320 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.58.

Comparative Example 30

Development Member

A paint 71 was prepared by suitably adjusting the concentration of a water-based urethane resin (trade name: SuperFlex 420, produced by Dai-ichi Kogyo Seiyaku Co., Ltd.), and adding a fluororesin composed of a fluorine-acryl block copolymer (trade name: Modiper F200, produced by NOF Corporation) in an amount of 10 parts by weight on the basis of 100 parts by weight of the water-based urethane resin. A sheet was formed by drying the paint 71. The contact angle between the sheet and water was measured, the result of which was 90°.

The same isoprene rubber roller as that in Inventive Example 33 was dipped in the above paint 71, followed by drying, to form an outermost resin layer 71 having a thickness of about 10 μm on the isoprene rubber elastic layer of the roller. A development roller having the same layer configuration as that shown in FIG. 1(A) was thus produced.

The surface roughness of the development roller was 3.4 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 560 V and the surface potential of the roller after 10 sec was 340 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.44.

Each of the development rollers in Inventive Examples 33 and 34 and Comparative Examples 28 to 30 was evaluated, in terms of adhesiveness (stickiness) to an OPC, initial image fog, carrying performance of toner, charging performance of toner, image fog after repeated printing, and wear of the development roller, by the following methods. The results are shown in Table 7.

Adhesiveness (Stickiness) to OPC

A roller to be tested was incorporated as a development roller in the printer cartridge shown in FIG. 2 and was left for one week under an environment with a temperature of 40° C. and a humidity of 80% RH, and the adhesiveness of the development roller to a photosensitive drum was examined.

Initial Image Fog

A roller to be tested was incorporated as a development roller in the printer cartridge shown in FIG. 2, and the printer cartridge was operated for image formation in a reversal manner by rotating the development roller at a linear velocity (circumferential speed) of 60 mm/sec. In this printing, a non-magnetic one-component toner having an average particle of 7 $\mu$m was used, and the development bias voltage was set to 400 V. For each of images of white solid, half-tone, and black solid formed in the initial stage, the image quality (the presence or absence and the degree of fog) was evaluated.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Charging Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Image Fog After Repeated Printing

After the test for evaluating initial image fog, an endurance test was performed. In this endurance test, the printing operation was repeated to print images on 10,000 pieces of sheets, and for each of images, the same image evaluation as that for initial image fog was performed.

Wear of Development Roller

The roller to be tested was taken out of the printer cartridge after the above endurance test, and the surface of the roller was observed by a video microscope, to evaluate the degree of damage and wear of the surface of the roller.

TABLE 7

| | Inventive Example 33 | Inventive Example 34 | Comparative Example 28 | Comparative Example 29 | Comparative Example 30 |
|---|---|---|---|---|---|
| Adhesiveness to OPC | ○ | ○ | x | x | ○ |
| Initial Image Fog | ○ | ○ | ○ | x | x |
| Carrying Performance of Toner | ○ | ○ | x | x | Δx |
| Charging Performance of Toner | ○ | ○ | ○ | x | x |
| Fog After Repeated Printing | ○ | ○ | Δx | x | x |
| Wear of Development Roller | ○ | ○ | x | x | Δ |

Criteria for Evaluation
○: very good
○Δ: good
Δ: ordinary
Δx: slightly poor
x: poor Inventive Example 35

Transfer Member

A paint 72 was prepared by dissolving a urethane resin (trade name: DP307, produced by Sanyo Chemical Industries, Ltd.) in MEK as a solvent and adding a fluororesin composed of a fluorine-acryl block copolymer (trade name: Modiper F200, produced by NOF Corporation) in an amount of 30 parts by weight on the basis of 100 parts by weight of the urethane resin, and further adding a powder of carbon in an amount of 20 parts by weight on the basis of 100 parts by weight of the urethane resin and an isocynate crosslinking agent with an NCO index set to 1.5. A sheet was formed by drying the paint 72. The contact angle between the sheet and water was measured, the result of which was 93°.

A urethane foam roller was produced by forming an elastic layer (thickness: 5 mm, volume resistivity: $1\times10^5$ Ω·cm) around the outer periphery of a metal shaft. The elastic layer was made from a urethane foam with its resistance adjusted by adding a conductive agent (carbon black) thereto. The urethane foam roller was dipped in the above paint 72, followed by drying, to form an outermost resin layer 72 having a thickness of about 10 $\mu$m on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 72.

The surface potential of the roller thus produced was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 7 V and the surface potential of the roller after 10 sec was 1.19 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.19.

Comparative Example 31

Transfer Member

A paint 73 was prepared by suitably adjusting the concentration of a water-based urethane resin (trade name: SuperFlex 420, produced by Dai-ichi Kogyo Seiyaku Co., Ltd.) and adding a powder of carbon in an amount of 20 parts by weight on the basis of 100 parts by weight of the water-based urethane resin. A sheet was produced by drying the paint 73. The contact angle between the sheet and water was measured, the result of which was 79°.

The same urethane foam roller as that in Inventive Example 3 was dipped in the above paint 73, followed by drying, to form an outermost resin layer 73 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 73. The surface potential of the roller was measured by disposing a corona discharger with a gap of b 1mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 550 V and the surface potential of the roller after 10 sec was 340 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.78.

Each of the transfer rollers in Inventive Example 35 and Comparative Example 31 was pressed to a photosensitive drum at a load of 1 kg, and was left for two weeks under an environment with a temperature of 50° C. and a humidity of 85% RH. As a result, the roller in Inventive Example 35 did not cause any problem, while the roller in Comparative Example 31 caused adhesion and contamination between the roller and the photosensitive drum. Each of the transfer rollers in Inventive Example 35 and Comparative Example 31 was then incorporated in a laser printer, and the printer was operated to print images on 5,000 pieces of sheets. As a result, the roller in Inventive Example 35 did not cause any problem, while the roller in Comparative Example 31 caused spot omissions of characters in images and contamination of the back surfaces of transfer sheets due to toner contamination on the surface of the roller.

Inventive Example 36

Cleaning Member

A cleaning roller having the same layer configuration as that shown in FIG. 1(B) was produced by forming an elastic layer (thickness: 3 mm, volume resistivity: $1\times10^3$ Ω·cm) made from a conductive urethane foam around the outer periphery of a metal shaft, forming the following intermediate resin layer 74 having a thickness of 100 μm on the surface of the elastic layer, and forming the following outermost resin layer 75 having a thickness of 10 μm thereon.

Intermediate Resin Layer 74

The intermediate resin layer 74 was formed by coating the elastic layer with a paint prepared by adding carbon to a water-based acrylic resin by a dipping method. The volume resistivity was adjusted to $5\times10^7$ Ω·cm.

Outermost Resin Layer 75

A paint 75 was prepared by dissolving a urethane resin (trade name: DP307, produced by Sanyo Chemical Industries, Ltd.) in MEK as a solvent and adding a fluororesin (trade name: LF200, produced by Asahi Glass Company) in an amount of 50 parts by weight on the basis of 100 parts by weight of the urethane resin, and further adding a powder of carbon in an amount of 30 parts by weight on the basis of 100 parts by weight of the urethane resin and an isocyanate crosslinking agent with an NCO index set to 1.5. The intermediate resin layer 74 was then coated with the paint 75 by a dipping method, to form the outermost resin layer 75. A sheet was produced by drying the paint 75. The contact angle between the sheet and water was measured, the result of which was 91°.

The surface roughness of the cleaning roller was 0.9 μm in Rz (ten point average roughness specified in JIS). A roller was produced in the same manner as that described above except that carbon as a conductive agent was not added to the outermost resin layer 75 and the surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 34 V and the surface potential of the roller after 10 sec was 2.18 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.44.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed.

Comparative Example 32

Cleaning Member

A cleaning roller having the same layer configuration as that shown in FIG. 1(B) was produced by forming the same intermediate resin layer 74 as that in Inventive Example 36 on the surface of the same elastic layer as that in Inventive Example 36, and forming the following outermost resin layer 76 having a thickness of 10 μm thereon.

Outermost Resin Layer 76

A paint 76 was prepared by suitably adjusting the concentration of a water-based urethane resin (trade name: SuperFlex 420, produced by Dai-ichi Kogyo Seiyaku Co., Ltd.). The intermediate resin layer 74 was coated with the paint 76 by a dipping method, to form the outermost resin layer 76. A sheet was produced by drying the paint 76. The contact angle between the sheet and water was measured, the result of which was 77°.

The surface roughness of the cleaning roller was 0.5 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 590 V and the surface potential of the roller after 10 sec was 370 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.2.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation.

Inventive Example 37

Charging Member

A charging roller having the same layer configuration as that shown in FIG. 1(A) was produced by forming an elastic layer (thickness: 3 mm, volume resistivity: $1\times10^6$ Ω·cm) made from a conductive urethane foam on the outer periphery of a metal shaft, and forming the following outermost resin layer 77 having a thickness of 150 μm on the surface of the elastic layer.

Outermost Resin Layer 77

A paint was prepared by adding 10 parts by weight of a fluorine-acryl block copolymer (trade name: Modiper F220, produced by NOF Corporation) to 100 parts by weight of a water-based acrylic resin (Tg: 5° C.), and further adding carbon in an amount of 20 parts by weight on the basis of 100 parts by weight of the water-based acrylic resin. The elastic layer was coated with the paint by a dipping method, to form the outermost resin layer 77. The volume resistivity was adjusted to $1\times10^8$ Ω·cm.

A sheet was produced from a material being the same as that for forming the outermost resin layer 77 except that carbon was not added thereto. A relative dielectric constant of the sheet was 5.2. On the other hand, the relative dielectric constant of the outermost resin layer 77 with the volume resistivity adjusted to $1\times10^8$ Ω·cm by adding carbon was 18.8.

The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.31.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation under a condition with a DC voltage Vdc=−650 V, an AC voltage Vpp=1500 V, and a frequency f=500 Hz, as a result of which initial image fog was not observed. At the same time, charging noise was measured by a noise meter, as a result of which charging noise was 58.6 dB. At this time, the charging roller was taken out of the printer cartridge and was wiped, as a result of which any residual toner on the roller was not observed. Even after continuous printing on 8,000 pieces of sheets, degradation of images was not observed.

Inventive Example 38

Charging Member

A charging roller having the same layer configuration as that shown in FIG. 1(A) was produced by forming the following outermost resin layer 78 having a thickness of 100 μm on the surface of the same elastic layer as that in Inventive Example 37.

Outermost Resin Layer 78

A paint was prepared by dissolving an acrylic resin (Tg: 180C) containing HEMA (2-hydroxy ethyl methacrylate) in MEK (methyl ethyl ketone) as a solvent and adding a fluororesin (trade name: LF200, produced by Asahi Glass Company) in an amount of 40 parts by weight on the basis of 100 parts by weight of the acrylic resin, and further adding carbon as a conductive agent in an amount of 30 parts by weight on the basis of 100 parts by weight of the acrylic resin. The elastic layer was coated with the paint by a dipping method, to form the outermost resin layer 78. The volume resistivity was adjusted to $6\times10^8$ Ω·cm.

A sheet was produced from a material being the same as that for forming the outermost resin layer 78 except that carbon was not added thereto. A relative dielectric constant of the sheet was 6.2. On the other hand, the relative dielectric constant of the outermost resin layer 78 with the volume resistivity adjusted to $1\times10^8$ Ω·cm by adding carbon was 21.3.

The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.22.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation under a condition with a DC voltage Vdc=−650 V, an AC voltage Vpp=1500 V, and a frequency f=500 Hz, as a result of which initial image fog was not observed. At the same time, charging noise was measured by a noise meter, as a result of which charging noise was 59.3 dB. At this time, the charging roller was taken out of the printer cartridge and was wiped, as a result of which any residual toner on the roller was not observed. Even after continuous printing on 8,000 pieces of sheets, degradation of images was not observed.

Inventive Example 39

Charging Member

A charging roller having the same layer configuration as that shown in FIG. 1(B) was produced by forming the following intermediate resin layer 79 having a thickness of 50 μm on the surface of the same elastic layer as that in Inventive Example 37, and forming the following outermost resin layer 80 having a thickness of 100 μm thereon.

Intermediate Resin Layer 79

The intermediate resin layer 79 was formed by coating the elastic layer with a paint produced by adding an ion conductive agent (sodium perchlorate) to a water-based urethane resin. The volume resistivity was adjusted to $2\times10^7$ Ω·cm.

Outermost Resin Layer 80

A paint was prepared by dissolving an acrylic resin (Tg: 27° C.) containing HEMA in MEK as a solvent and adding a fluorine-acryl block copolymer (trade name: Modiper F200, produced by NOF Corporation) in an amount of 15 parts by weight on the basis of 100 parts by weight of the acrylic resin, and further adding carbon as a conductive agent in an amount of 20 parts by weight on the basis of 100 parts by weight of the acrylic resin. The intermediate resin layer 79 was coated with the paint by a dipping method, to form the outermost resin layer 80. The volume resistivity was adjusted to $2\times10^8$ Ω·cm.

A sheet was produced from a material being the same as that for forming the outermost resin layer 80 except that carbon was not added thereto. A relative dielectric constant of the sheet was 6.2. On the other hand, the relative dielectric constant of the outermost resin layer 80 with the volume resistivity adjusted to $1\times10^8$ Ω·cm by adding carbon was 21.3.

The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.17.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation under a condition with a DC voltage Vdc=−650 V, an AC voltage Vpp=1500 V, and a frequency f=500 Hz, as a result of which initial image fog was not obtained. At the same time, charging noise was measured by a noise meter, as a result of which charging noise was 58.9 dB. At this time, the charging roller was taken out of the printer cartridge and was wiped, as a result of which any residual toner on the roller was not observed. Even after continuous printing on 8,000 pieces of sheets, degradation of images was not observed.

Comparative Example 33

Charging Member

A charging roller having the same layer configuration as that shown in FIG. 1(A) was produced by forming the following outermost resin layer 81 having a thickness of 150 μm on the same elastic layer as that in Inventive Example 37.

Outermost Resin Layer 81

A paint was prepared by adding carbon as a conductive agent to a water-based urethane resin. The elastic layer was coated with the paint by a dipping method, to form the outermost resin layer 81. The volume resistivity was adjusted to $1\times10^8$ Ω·cm.

A sheet was produced from a material being the same as that for forming the outermost resin layer 81 except that carbon was not added thereto. A relative dielectric constant of the sheet was 8.5. On the other hand, the relative dielectric constant of the outermost resin layer 81 with the volume resistivity adjusted to $1\times10^8$ Ω·cm by adding carbon was 58.2.

The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.85.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the roller and the OPC, the printer cartridge was operated for image formation under a condition with a DC voltage Vdc=−650 V, an AC voltage Vpp=1500 V, and a frequency f=500 Hz, as a result of which initial image fog was not observed. At the same time, charging noise was measured by a noise meter, as a result of which charging noise was 65.7 dB. At this time, the charging roller was taken out of the printer cartridge and was wiped, as a result of which a large amount of residual toner on the roller was observed. After continuous printing on 8,000 pieces of sheets, fog occurred due to adhesion of toner and deterioration of the surface layer of the roller.

Comparative Example 34

Charging Member

A charging roller having the same layer configuration as that shown in FIG. 1(A) was produced by forming the following outermost resin layer 82 having a thickness of 150 μm on the same elastic layer as that in Inventive Example 37.

Outermost Resin Layer 82

A paint was prepared by adding carbon as a conductive agent to a water-based acrylic resin (Tg: 0° C.). The elastic layer was coated with the paint by a dipping method, to form the outermost resin layer 82. The volume resistivity was adjusted to $1\times10^8$ Ω·cm.

A sheet was produced from a material being the same as that for forming the outermost resin layer 82 except that carbon was not added thereto. A relative dielectric constant of the sheet was 7.8. On the other hand, the relative dielectric constant of the outermost resin layer 82 with the volume resistivity adjusted to $1\times10^8$ Ω·cm by adding carbon was 35.3.

The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.24.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the photosensitive body, the printer cartridge was operated for image formation under a condition with a DC voltage Vdc=−650 V, an AC voltage Vpp=1500 V, and a frequency f=500 Hz, as a result of which initial image fog was not observed. At the same time, charging noise was measured by a noise meter, as a result of which charging noise was 60.2 dB. At this time, the charging roller was taken out of the printer cartridge and was wiped, as a result of which residual toner on the roller was observed. After continuous printing on 8,000 pieces of sheets, fog occurred due to adhesion of toner and deterioration of the surface layer of the roller.

Comparative Example 35

Charging Member

A charging roller having the same layer configuration as that shown in FIG. 1(B) was produced by forming the following intermediate resin layer 83 having a thickness of 100 μm on the surface of the same elastic layer as that in Inventive Example 1, and forming the following outermost resin layer 84 having a thickness of 30 μm thereon.

Intermediate Resin Layer 83

The intermediate resin layer 83 was formed by coating the elastic layer with a paint prepared by adding carbon to a water-based urethane resin. The volume resistivity was adjusted to $8\times10^7$ Ω·cm.

Outermost Resin Layer 84

A paint was prepared by dissolving a urethane resin in MEK as a solvent, and adding a fluorine-acryl block copolymer (trade name: Modiper F200, produced by NOF Corporation) in an amount of 15 parts by weight on the basis of 100 parts by weight of the urethane resin, and further adding carbon in an amount of 20 parts by weight and an isocyanate in an amount of 3 parts by weight on the basis of 100 parts by weight of the urethane resin. The intermediate resin layer 83 was coated with the paint by a dipping method, to form the outermost resin layer 84. The volume resistivity was adjusted to $1\times10^9$ Ω·cm.

A sheet was produced from a material being the same as that for forming the outermost resin layer 84 except that carbon was not added thereto. A relative dielectric constant of the sheet was 9.1. On the other hand, the relative dielectric constant of the outermost resin layer 84 with the volume resistivity adjusted to $1\times10^8$ Ω·cm by adding carbon was 52.1.

The roller was then subjected to friction testing using a cloth of 70 mesh containing 100% of cellulose (density: 30 g/m$^2$) by a measurement instrument shown in FIG. 3 under a condition with a temperature of 22° C. and a humidity of 50% RH. The result showed that the friction coefficient of the roller was 0.38.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation under a condition with a DC voltage Vdc=−650 V, an AC voltage Vpp=1500 V, and a frequency f=500 Hz, as a result of which initial image fog was not observed. At the same time, charging noise was measured by a noise meter, as a result of which charging noise was 63.2 dB. At this time, the charging roller was taken out of the printer cartridge and was wiped, as a result of which any residual toner on the roller was not observed. After continuous printing on 8,000 pieces of sheets, a pattern due to damages of the OPC and the charging rollers, caused by vibration of the charging roller, was observed in the images.

The results of evaluating the charging rollers in Inventive Examples 37 to 39 and Comparative Examples 33 to 35 are shown in Table 8.

TABLE 8

| Items to be | Inventive Examples | | | Comparative Examples | | |
|---|---|---|---|---|---|---|
| Evaluated | 37 | 38 | 39 | 33 | 34 | 35 |
| Adhesiveness to OPC | ○ | ○ | ○ | x | x | ○ |
| Adhesion of Toner | ○ | ○ | ○ | x | x | ○ |
| Fog After Repeated Printing | ○ | ○ | ○ | x | x | Δx |
| Noise | ○ | ○ | ○ | x | Δ | x |

Criteria for Evaluation
○: very good
○Δ: good
Δ: ordinary
Δx: slightly poor
x: poor Inventive Example 40

Charging Member

A charging roller having the same layer configuration as that shown in FIG. 1(B) was produced by forming an elastic layer (thickness: 3 mm, volume resistivity: $1\times10^6$ Ω·cm) made from a conductive urethane foam on the outer periphery of a metal shaft, forming the following intermediate resin layer 85 having a thickness of 100 μm on the surface of the elastic layer, and forming the following outermost resin layer 86 having a thickness of 10 μm thereon.

Intermediate Resin Layer 85

The intermediate resin layer 85 was formed by coating the elastic layer with a paint prepared by adding carbon to a water-based acrylic resin by a dipping method. The volume resistivity was adjusted to $5\times10^7$ Ω·cm.

Outermost Resin Layer 86

A paint was prepared by dissolving a polyamide resin (trade name: H1060, produced by Sanyo Chemical Industries, Ltd.) in ethanol as a solvent and adding a fluorine-acryl block copolymer (trade name: Modiper F200, produced by NOF Corporation) in an amount of 15 parts by weight on the basis of 100 parts by weight of the polyamide resin, and further adding a melamine crosslinking agent in an amount of 10 parts by weight on the basis of 100 parts by weight of the polyamide resin. The intermediate resin layer 85 was coated with the paint by a dipping method, to form the outermost resin layer 86.

The resistance of the roller thus produced was $8\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.13 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.28.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 41

Charging Member

A charging roller having the same layer configuration as that shown in FIG. 1(B) was produced by forming the above-described intermediate resin layer 85 having a thickness of 100 μm on the surface of the same elastic layer as that in Inventive Example 41, and forming the following outermost resin layer 87 having a thickness of 10 μm thereon.

Outermost Resin Layer 87

A paint was prepared by dissolving a polyamide resin (trade name: L203, produced by Sanyo Chemical Industries, Ltd.) in ethanol as a solvent and adding a fluorine-acryl block copolymer (trade name: Modiper F220, produced by NOF Corporation) in an amount of 10 parts by weight on the basis of 100 parts by weight of the polyamide resin, and further adding a melamine crosslinking agent in an amount of 10 parts by weight on the basis of 100 parts by weight of the polyamide resin. The intermediate resin layer 85 was coated with the paint by a dipping method, to form the outermost resin layer 87.

The resistance of the roller thus produced was $6\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 7 V and the surface potential of the roller after 10 sec was 0.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.32.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 42

Charging Member

A charging roller having the same layer configuration as that shown in FIG. 1(B) was produced by forming the above-described intermediate resin layer 85 having a thickness of 100 μm on the surface of the same elastic layer as that in Inventive Example 40, and forming the following outermost resin layer 88 having a thickness of 10 μm thereon.

Outermost Resin Layer 88

A paint was prepared by dissolving a polyamide resin (trade name: A90, produced by Toray Industries, Inc.) in ethanol as a solvent and adding a perfluoroalkyl group containing emulsion (trade name: FC-5120, produced by 3M Company) in an amount of 3 parts by weight on the basis of 100 parts by weight of the polyamide resin, and further adding an epoxy crosslinking agent in an amount of 5 parts by weight on the basis of 100 parts by weight of the polyamide resin. The intermediate resin layer 85 was coated with the paint by a dipping method, to form the outermost resin layer 88.

The resistance of the roller thus produced was $1\times10^7$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 5 V and the surface potential of the roller after 10 sec was 0.43 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.36.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Inventive Example 43

Charging Member

A charging roller having the same layer configuration as that shown in FIG. 1(B) was produced by forming the above-described intermediate resin layer 85 having a thickness of 100 μm on the surface of the same elastic layer as that in Inventive Example 1, and forming the following outermost resin layer 89 having a thickness of 10 μm thereon.

Outermost Resin Layer 89

A paint was prepared by dissolving a polyamide resin (trade name: Harmide 3228, produced by Harima Chemical, Inc.) in toluene as a solvent and adding a fluororesin (trade name: LF200, produced by Asahi Glass Company) in an amount of 50 parts by weight on the basis of 100 parts by weight of the polyamide resin, and further adding carbon in an amount of 20 parts by weight and an isocyanate crosslinking agent in an amount of 5 parts by weight on the basis of 100 parts by weight of the polyamide resin. The intermediate resin layer 85 was coated with the paint 88 by a dipping method, to form the outermost resin layer 89.

The resistance of the roller thus produced was $1\times10^6$ Ω. A charging roller was produced in the same manner as that described above except that carbon as a conductive agent was not added to the outermost resin layer 89. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 31 V and the surface potential of the roller after 10 sec was 2.76 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.33.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which any residual toner on the roller was not observed. Even after continuous printing on 8,000 pieces of sheets, degradation of images was not observed.

Comparative Example 36

Charging Member

A charging roller having the same layer configuration as that shown in FIG. 1(B) was produced by forming the above-described intermediate resin layer 85 having a thickness of 100 μm on the surface of the same elastic layer as that in Inventive Example 40, and forming the following outermost resin layer 90 having a thickness of 10 μm thereon.

Outermost Resin Layer 90

A paint was prepared by dissolving a fluororesin (trade name: LF710N, produced by Asahi Glass Company) in MEK (methyl ethyl ketone) as a solvent, and adding carbon in an amount of 35 parts by weight and an isocyanate crosslinking agent in an amount of 5 parts by weight on the basis of 100 parts by weight of the fluororesin. The intermediate resin layer 85 was coated with the paint by a dipping method, to form the outermost resin layer 90.

The resistance of the roller thus produced was $2\times10^6$ Ω. A charging roller was produced in the same manner as that described above except that carbon as a conductive agent was not added to the outermost resin layer 90. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 470 V and the surface potential of the roller after 10 sec was 250 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.20.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog was only slightly observed, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. Even after continuous printing on 8,000 pieces of sheets, quality of the images was not improved.

Comparative Example 37

Charging Member

A charging roller having the same layer configuration as that shown in FIG. 1(B) was produced by forming the above-described intermediate resin layer 85 having a thickness of 100 μm on the surface of the same elastic layer as that in Inventive Example 40, and forming the following outermost resin layer 91 having a thickness of 10 μm thereon.

Outermost Resin Layer 91

A paint was prepared by dissolving a polyamide resin (trade name: H1060, produced by Sanyo Chemical Industries, Ltd.) in ethanol as a solvent, and adding a melamine crosslinking agent in an amount of 10 parts by weight on the basis of 100 parts by weight of the polyamide resin. The intermediate resin layer 85 was coated with the paint by a dipping method, to form the outermost resin layer 91.

The resistance of the roller thus produced was $5\times10^6$ Ω. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.73 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.88.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which desirable images were obtained, and the printer cartridge was also operated for image formation at a DC voltage Vdc=−1260 V, as a result of which any initial image fog was not observed. At this time, the charging roller was taken out of the printer cartridge and was wiped, as a result of which a large amount of residual toner on the roller was observed. Even after continuous printing on 8,000 pieces of sheets, fog occurred due to adhesion of toner and deterioration of the surface layer of the roller.

Comparative Example 38

Charging Member

A charging roller having the same layer configuration as that shown in FIG. 1(B) was produced by forming the above-described intermediate resin layer 85 having a thickness of 100 μm on the surface of the same elastic layer as that in Inventive Example 40, and forming the following outermost resin layer 92 having a thickness of 10 μm thereon.

Outermost Resin Layer 92

A paint was prepared by dissolving a polyamide resin (trade name: X1850, produced by Sanyo Chemical Industries, Ltd.) in ethanol as a solvent, and adding carbon as a conductive agent in an amount of 20 parts by weight and a melamine crosslinking agent in an amount of 10 parts by weight on the basis of 100 parts by weight of the polyamide resin. The intermediate resin layer 85 was coated with the paint by a dipping method, to form the outermost resin layer 92.

The resistance of the roller thus produced was $1.5\times10^6$ Ω. A charging roller was produced in the same manner as that described above except that carbon as a conductive agent was not added to the outermost resin layer 92. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 220 V and the surface potential of the roller after 10 sec was 90 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.07.

The charging roller was incorporated in a printer cartridge, and was left for two weeks under an environment with a temperature of 40° C. and a humidity of 95% RH. As a result, adhesion occurred between the roller and a photosensitive body (OPC). In a state before occurrence of adhesion between the charging roller and the OPC, the printer cartridge was operated for image formation at an AC voltage Vpp=1800 V and a DC voltage Vdc=−650 V, as a result of which fog slightly occurred, and the printer cartridge was also operated for image formation at a DC voltage Vdc=−1260 V, as a result of which fog occurred. At this time, the charging roller was taken out of the printer cartridge and was wiped, as a result of which a large amount of residual toner on the roller was observed. After continuous printing on 8,000 pieces of sheets, the degree of fog became worse.

Comparative Example 39

Charging Member

A charging roller having the same layer configuration as that shown in FIG. 1(B) was produced by forming the above-described intermediate resin layer 85 having a thickness of 100 μm on the surface of the same elastic layer as that in Inventive Example 40, and forming the following outermost resin layer 93 having a thickness of 10 μm thereon.

Outermost Resin Layer 93

A paint was prepared by dissolving a polyamide resin (trade name: X1850, produced by Sanyo Chemical Industries, Ltd.) in ethanol as a solvent and adding a fluorine-acryl block copolymer (trade name: Modiper F220, produced by NOF Corporation) in an amount of 10 parts by weight on the basis of 100 parts by weight of the polyamide resin, and further adding carbon as a conductive agent in an amount of 20 parts by weight and a melamine crosslinking agent in an amount of 10 parts by weight on the basis of 100 parts by weight of the polyamide resin. The intermediate resin layer 85 was coated with the paint by a dipping method, to form the outermost resin layer 93.

The resistance of the roller thus produced was $1.5\times10^6$ Ω. A charging roller was produced in the same manner as that described above except that carbon as a conductive agent was not added to the outermost resin layer 93. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 240 V and the surface potential of the roller after 10 sec was 80 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.31.

The charging roller was incorporated in a printer cartridge, and was left for two weeks under an environment with a temperature of 40° C. and a humidity of 95% RH. As a result, any adhesion was not observed between the roller and a photosensitive body (OPC). After being left for two weeks, the printer cartridge was operated for image formation at an AC voltage Vpp=1800 V and a DC voltage Vdc=−650 V, as a result of which fog slightly occurred, and the printer cartridge was also operated for image formation at a DC voltage Vdc=−1260 V, as a result of which fog occurred. At this time, the charging roller was taken out of the printer cartridge and was wiped, as a result of which any residual toner on the roller was not observed. Even after continuous printing on 8,000 pieces of sheets, quality of the images was not improved.

The results of evaluating the charging rollers in Inventive Examples 40 to 43 and Comparative Examples 36 to 39 are shown in Table 9.

TABLE 9

| Items to be | Inventive Examples | | | | Comparative Examples | | | |
|---|---|---|---|---|---|---|---|---|
| Evaluated | 40 | 41 | 42 | 43 | 36 | 37 | 38 | 39 |
| Initial Fog | ○ | ○ | ○ | ○Δ | Δx | ○ | x | x |
| Adhesiveness to OPC | ○ | ○ | ○ | ○Δ | ○ | x | x | ○ |
| Adhesion of Toner | ○ | ○ | ○ | ○ | ○ | x | x | ○ |
| Fog After Repeated Printing | ○ | ○ | ○ | ○Δ | x | Δx | x | x |

Criteria for Evaluation
○: very good
○Δ: good
Δ: ordinary
Δx: slightly poor
x: poor Inventive Example 44

Development Member

A paint 94 was prepared by dissolving a polyamide resin (trade name: A90, produced by Toray Industries, Inc.) in ethanol as a solvent and adding a fluororesin composed of a fluorine-acryl block copolymer (trade name: Modiper F200, produced by NOF Corporation) in an amount of 10 parts by weight on the basis of 100 parts by weight of the polyamide resin, and further adding a melamine crosslinking agent in an amount of 10 parts by weight on the basis of 100 parts by weight of the polyamide resin.

An isoprene rubber roller was produced by forming an elastic layer (thickness: 6 mm, volume resistivity: $1\times10^5$ Ω·cm) around the outer periphery of a metal shaft. The elastic layer was made from an isoprene rubber with its resistance adjusted by adding a conductive agent (carbon black) thereto. The isoprene rubber roller was dipped in the above paint 94, followed by drying, to form an outermost resin layer 94 having a thickness of about 10 μm on the isoprene rubber elastic layer of the roller. A development roller having the same layer configuration as that shown in FIG. 1(A) was thus produced.

The surface roughness of the development roller was 3.3 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 2 V and the surface potential of the roller after 10 sec was 0.13 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.31.

Inventive Example 45

Development Member

A paint 95 was prepared by dissolving a polyamide resin (trade name: Harmide 3228, produced by Harima Chemical, Inc.) in toluene as a solvent and adding a perfluoroalkyl group containing polymer type modifier (trade name: F-178RM, produced by Dainippon Ink and Chemicals, Inc.) in an amount of 4 parts by weight on the basis of 100 parts by weight of the polyamide resin, and further adding a powder of silica in an amount of 20 parts by weight on the basis of 100 parts by weight of the polyamide resin and an isocyanate crosslinking agent with an NCO index set to 1.5.

The same isoprene rubber roller as that in Inventive Example 44 was dipped in the above paint 95, followed by drying, to form an outermost resin layer 95 having a thickness of about 10 μm on the isoprene rubber elastic layer of the roller. A development roller having the same layer configuration as that shown in FIG. 1(A) was thus produced.

The surface roughness of the development roller was 6.6 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.25 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.17.

Inventive Example 46

Development Member

A paint 96 was prepared by dissolving a polyamide resin (trade name: Harmide 3228, produced by Harima Chemical, Inc.) in toluene as a solvent and adding a fluororesin (trade name: Kynar 7201, produced by Elf Atochem Japan) in an amount of 60 parts by weight on the basis of 100 parts by weight of the polyamide resin, and further adding a powder of silica in an amount of 10 parts by weight on the basis of 100 parts by weight of the polyamide resin and an isocyanate crosslinking agent with an NCO index set to 1.5.

The same isoprene rubber roller as that in Inventive Example 44 was dipped in the above paint 96, followed by drying, to form an outermost resin layer 96 having a thickness of about 10 μm on the isoprene rubber elastic layer of the roller. A development roller having the same layer configuration as that shown in FIG. 1(A) was thus produced.

The surface roughness of the development roller was 5.3 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 14 V and the surface potential of the roller after 10 sec was 1.95 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.19.

Comparative Example 40

Development Member

A paint 97 was prepared by dissolving a polyamide resin (trade name: H1060, produced by Sanyo Chemical Industries, Ltd.) in ethanol as a solvent and adding a melamine crosslinking agent in an amount of 10 parts by weight on the basis of 100 parts by weight of the polyamide resin.

The same isoprene rubber roller as that in Inventive Example 44 was dipped in the above paint 97, followed by drying, to form an outermost resin layer 97 having a thickness of about 10 μm on the isoprene rubber elastic layer of the roller. A development roller having the same layer configuration as that shown in FIG. 1(A) was thus produced.

The surface roughness of the development roller was 3.3 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.26 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.02.

Comparative Example 41

Development Member

A paint 98 was prepared by dissolving a polyamide resin (trade name: X1860, produced by Dai-ichi Kogyo Seiyaku Co., Ltd.) in methanol as a solvent and adding a melamine crosslinking agent in an amount of 10 parts by weight on the basis of 100 parts by weight of the polyamide resin.

The same isoprene rubber roller as that in Inventive Example 44 was dipped in the above paint 98, followed by drying, to form an outermost resin layer 98 having a thickness of about 10 μm on the isoprene rubber elastic layer of the roller. A development roller having the same layer configuration as that shown in FIG. 1(A) was thus produced.

The surface roughness of the development roller was 3.4 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 270 V and the surface potential of the roller after 10 sec was 120 V. The roller was then subjected to friction testing using a cloth of 70 mesh containing 100% of cellulose (density: 30 gm$^2$ ) by a measurement instrument shown in FIG. 4 under a condition with a temperature of 22° C. and a humidity of 50% RH. The result showed that the friction coefficient of the roller was 0.87.

Comparative Example 42

Development Member

A paint 99 was prepared by dissolving a polyamide resin (trade name: X1860, produced by Dai-ichi Kogyo Seiyaku Co., Ltd.) in methanol as a solvent and adding a fluororesin composed of a fluorine-acryl block copolymer (trade name: Modiper F220, produced by NOF Corporation) in an amount of 3 parts by weight on the basis of 100 parts by weight of the polyamide resin, and further adding a powder of silica in an amount of 10 parts by weight and a melamine crosslinking agent in an amount of 10 parts by weight on the basis of 100 parts by weight of the polyamide resin.

The same isoprene rubber roller as that in Inventive Example 44 was dipped in the above paint 99, followed by drying, to form an outermost resin layer 99 having a thickness of about 10 μm on the isoprene rubber elastic layer of the roller. A development roller having the same layer configuration as that shown in FIG. 1(A) was thus produced.

The surface roughness of the development roller was 7.2 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 350 V and the surface potential of the roller after 10 sec was 160 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.29.

Each of the development rollers in Inventive Examples 44 to 46 and Comparative Examples 40 to 42 was evaluated, in terms of adhesiveness (stickiness) to an OPC, initial image fog, carrying performance of toner, charging performance of toner, image fog after repeated printing, and wear of the development roller, by the following methods. The results are shown in Table 10.

Adhesiveness (Stickiness) to OPC

A roller to be tested was incorporated as a development roller in the printer cartridge shown in FIG. 2 and was left for one week under an environment with a temperature of 40° C. and a humidity of 80% RH, and the adhesiveness of the development roller to a photosensitive drum was examined.

Initial Image Fog

A roller to be tested was incorporated as a development roller in the printer cartridge shown in FIG. 2, and the printer cartridge was operated for image formation in a reversal manner by rotating the development roller at a linear velocity (circumferential speed) of 60 mm/sec. In this printing, a non-magnetic one-component toner having an average particle of 7 μm was used, and the development bias voltage was set to 400 V. For each of images of white solid, half-tone, and black solid formed in the initial stage, the image quality (the presence or absence and the degree of fog) was evaluated.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Charging Performance of Tone

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Image Fog After Repeated Printing

After the test for evaluating initial image fog, an endurance test was performed. In this endurance test, the printing operation was repeated to print images on 10,000 pieces of sheets, and for each of images, the same image evaluation as that for initial image fog was performed.

Wear of Development Roller

The roller to be tested was taken out of the printer cartridge after the above endurance test, and the surface of the roller was observed by a video microscope, to evaluate the degree of damage and wear of the surface of the roller.

TABLE 10

| | Inventive Example 44 | Inventive Example 45 | Inventive Example 46 | Comparative Example 40 | Comparative Example 41 | Comparative Example 42 |
|---|---|---|---|---|---|---|
| Adhesiveness to OPC | ○ | ○ | ○ | x | x | ○ |
| Initial Image Fog | ○ | ○ | ○ | ○ | x | x |
| Carrying Performance of Toner | ○ | ○ | ○ | x | x | x |
| Charging Performance of Toner | ○ | ○ | ○ | ○ | x | x |
| Fog After Repeated Printing | ○ | ○ | ○ | Δx | x | x |
| Wear of Development Roller | ○ | ○ | ○ | x | x | Δx |

Criteria for Evaluation
○: very good
○Δ: good
Δ: ordinary
Δx: slightly poor
x: poor Inventive Example 47

Transfer Member

A paint 100 was prepared by dissolving a polyamide resin (trade name: L203, produced by Sanyo Chemical Industries, Ltd.) in ethanol as a solvent and adding a fluororesin composed of a fluorine-acryl block copolymer (trade name: Modiper F220, produced by NOF Corporation) in an amount of 5 parts by weight on the basis of 100 parts by weight of the urethane resin, and further adding a powder of carbon in an amount of 5 parts by weight and a melamine crosslinking agent in an amount of 10 parts by weight on the basis of 100 parts by weight of the polyamide resin.

A urethane foam roller was produced by forming an elastic layer (thickness: 5 mm, volume resistivity: $1\times10^7$ Ω·cm) around the outer periphery of a metal shaft. The elastic layer was made from a urethane foam with its resistance adjusted by adding a conductive agent (carbon black) thereto. The urethane foam roller was dipped in the above paint 100, followed by drying, to form an outermost resin layer 100 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 100. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.32 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.19.

Comparative Example 43

Transfer Member

A paint 101 was prepared by dissolving a polyamide resin (trade name: X1850, produced by Sanyo Chemical Industries, Ltd.) in ethanol as a solvent and adding a powder of carbon in an amount of 10 parts by weight and a melamine crosslinking agent in an amount of 10 parts by weight on the basis of 100 parts by weight of the polyamide resin.

The same urethane foam roller as that in Inventive Example 47 was dipped in the above paint 101, followed by drying, to form an outermost resin layer 101 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 101. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 250 V and the surface potential of the roller after 10 sec was 120 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.85.

Each of the transfer rollers in Inventive Example 47 and Comparative Example 43 was pressed to a photosensitive drum at a load of 1 kg, and was left for two weeks under an environment with a temperature of 50° C. and a humidity of 85% RH. As a result, the roller in Inventive Example 47 did not cause any problem, while the roller in Comparative Example 43 caused adhesion and contamination between the roller and the photosensitive drum. Each of the transfer rollers in Inventive Example 47 and Comparative Example 43 was then incorporated in a laser printer, and the printer was operated to print images on 5,000 pieces of sheets. As a result, the roller in Inventive Example 47 did not cause any problem, while the roller in Comparative Example 43 caused spot omissions of characters in images and contamination of the back surfaces of transfer sheets due to toner contamination on the surface of the roller.

Inventive Example 48

Cleaning Member

A cleaning roller having the same layer configuration as that shown in FIG. 1(B) was produced by forming an elastic layer (thickness: 3 mm, volume resistivity: $1\times10^3$ Ω·cm) made from a conductive urethane foam around the outer periphery of a metal shaft, forming the following intermediate resin layer 102 having a thickness of 100 μm on the surface of the elastic layer, and forming the following outermost resin layer 103 having a thickness of 10 μm thereon.

Intermediate Resin Layer 102

The intermediate resin layer 102 was formed by coating the elastic layer with a paint prepared by adding carbon to a water-based acrylic resin by a dipping method. The volume resistivity was adjusted to $5\times10^7$ Ω·cm.

Outermost Resin Layer 103

A paint 103 was prepared by dissolving a polyamide resin (trade name: Harmide 3228, produced by Harima Chemical, Inc.) in toluene as a solvent and adding a fluororesin composed of a fluorine-acryl block copolymer (trade name: Modiper F200, produced by NOF Corporation) in an amount of 10 parts by weight on the basis of 100 parts by weight of the polyamide resin, and further adding an isocyanate crosslinking agent with an NCO index set to 1.5. The intermediate resin layer 102 was then coated with the paint 103 by a dipping method, to form the outermost resin layer 103.

The surface roughness of the cleaning roller was 0.9 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 6 V and the surface potential of the roller after 10 sec was 0.29 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.18.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed.

Comparative Example 44

Cleaning Member

A cleaning roller having the same layer configuration as that shown in FIG. 1(B) was produced by forming the same intermediate resin layer 102 as that in Inventive Example 48 on the surface of the same elastic layer as that in Inventive Example 48, and forming the following outermost resin layer 104 having a thickness of 10 μm thereon.

Outermost Resin Layer 104

A paint 104 was prepared by dissolving a polyamide resin (trade name: X1850, produced by Sanyo Chemical Industries, Ltd.) in ethanol as a solvent and adding carbon in an amount of 10 parts by weight and a melamine crosslinking agent in an amount of 10 parts by weight on the basis of 100 parts by weight of the polyamide resin. The intermediate resin layer 102 was coated with the paint 104 by a dipping method, to form the outermost resin layer 104.

The surface roughness of the cleaning roller was 0.8 μm in Rz (ten point average roughness specified in JIS). A cleaning roller was produced in the same manner as that described above except that carbon as a conductive agent was not added to the outermost resin layer 104. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 220 V and the surface potential of the roller after 10 sec was 100 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.21.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation.

Inventive Example 49

Development Member

A paint 105 was prepared by dissolving a urethane resin (trade name: DP307, produced by Sanyo Chemical Industries, Ltd.) in MEK (methyl ethyl ketone) as a solvent and adding a pre-polymer obtained from a both-terminal alcohol modified silicone oil (trade name: FZ-3711, produced by Japan Yunika Co., Ltd.) by means of di-functionality isocyanate in an amount of 30 parts by weight on the basis of 100 parts by weight of the urethane resin, and adding an isocyanate crosslinking agent with an NCO index set to 1.5. A sheet was formed by drying the paint 105. The contact angle between the sheet and water was measured, the result of which was 97°.

An isoprene rubber roller was produced by forming an elastic layer (thickness: 6 mm, volume resistivity: $1\times10^5$ Ω·cm) around the outer periphery of a metal shaft. The elastic layer was made from an isoprene rubber with its resistance adjusted by adding a conductive agent (carbon black) thereto. The isoprene rubber roller was dipped in the above paint 105, followed by drying, to form an outermost resin layer 105 having a thickness of about 10 μm on the isoprene rubber elastic layer of the roller. A development roller having the same layer configuration as that shown in FIG. 1(A) was thus produced.

The surface roughness of the development roller was 3.9 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 3 V and the surface potential of the roller after 10 sec was 0.25 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.25.

Inventive Example 50

Development Member

A paint 106 was prepared by dissolving a urethane resin (trade name: NX304, produced by Sanyo Chemical Industries, Ltd.) in MEK as a solvent and adding a single terminal alcohol modified silicone oil (trade name: X-22-176F, produced by Shin-Etsu Chemical Co., Ltd.) in an amount of 10 parts by weight on the basis of 100 parts by weight of the urethane resin, and adding a powder of silica in an amount of 20 parts by weight on the basis of 100 parts by weight of the urethane resin and an isocyanate crosslinking agent with an NCO index set to 1.5. A sheet was formed by drying the paint 106. The contact angle between the sheet and water was measured, the result of which was 99°.

The same isoprene rubber roller as that in Inventive Example 49 was dipped in the above paint 106, followed by drying, to form an outermost resin layer 106 having a thickness of about 10 μm on the isoprene rubber elastic layer of the roller. A development roller having the same layer configuration as that shown in FIG. 1(A) was thus produced.

The surface roughness of the development roller was 5.2 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 20 V and the surface potential of the roller after 10 sec was 0.32 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction a coefficient of the roller was 0.22.

Comparative Example 45

Development Member

A paint 107 was prepared by dissolving a urethane resin (trade name: DP307, produced by Sanyo Chemical Industries, Ltd.) in MEK as a solvent and adding an isocyanate crosslinking agent with an NCO index set to 1.5. A sheet was formed by drying the paint 107. The contact angle between the sheet and water was measured, the result of which was 80°.

The same isoprene rubber roller as that in Inventive Example 49 was dipped in the above paint 107, followed by drying, to form an outermost resin layer 107 having a thickness of about 10 μm on the isoprene rubber elastic layer of the roller. A development roller having the same layer configuration as that shown in FIG. 1(A) was thus produced.

The surface roughness of the development roller was 3.0 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.21 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.18.

Comparative Example 46

Development Member

A paint 108 was prepared by suitably adjusting the concentration of a water-based urethane resin (trade name: SuperFlex 420, produced by Dai-ichi Kogyo Seiyaku Co., Ltd.). A sheet was formed by drying the paint 108. The contact angle between the sheet and water was measured, the result of which was 77°.

The same isoprene rubber roller as that in Inventive Example 49 was dipped in the above paint 108, followed by drying, to form an outermost resin layer 108 having a thickness of about 10 μm on the isoprene rubber elastic layer of the roller. A development roller having the same layer configuration as that shown in FIG. 1(A) was thus produced.

The surface roughness of the development roller was 3.2 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 500 V and the surface potential of the roller after 10 sec was 320 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.58.

Comparative Example 47

Development Member

A paint 109 was prepared by suitably adjusting the concentration of a water-based urethane resin (trade name: SuperFlex 420, produced by Dai-ichi Kogyo Seiyaku Co., Ltd.), and adding a dimethyl silicone oil (trade name: SH200, produced by Toray-Dow Corning Silicone Corp.) in an amount of 10 parts by weight on the basis of 100 parts by weight of the water-based urethane resin. A sheet was formed by drying the paint 109. The contact angle between the sheet and water was measured, the result of which was 90°.

The same isoprene rubber roller as that in Inventive Example 49 was dipped in the above paint 109, followed by drying, to form an outermost resin layer 109 having a thickness of about 10 μm on the isoprene rubber elastic layer of the roller. A development roller having the same layer configuration as that shown in FIG. 1(A) was thus produced.

The surface roughness of the development roller was 3.8 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 520 V and the surface potential of the roller after 10 sec was 330 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.45.

Each of the development rollers in Inventive Examples 49 and 50 and Comparative Examples 45 to 47 was evaluated, in terms of adhesiveness (stickiness) to an OPC, initial image fog, carrying performance of toner, charging performance of toner, image fog after repeated printing, and wear of the development roller, by the following methods. The results are shown in Table 11.

Adhesiveness (Stickiness) to OPC

A roller to be tested was incorporated as a development roller in the printer cartridge shown in FIG. 2 and was left for one week under an environment with a temperature of 40° C. and a humidity of 80% RH, and the adhesiveness of the development roller to a photosensitive drum was examined.

Initial Image Fog

A roller to be tested was incorporated as a development roller in the printer cartridge shown in FIG. 2, and the printer cartridge was operated for image formation in a reversal manner by rotating the development roller at a linear velocity (circumferential speed) of 60 mm/sec. In this printing, a non-magnetic one-component toner having an average particle of 7 μm was used, and the development bias voltage was set to 400 V. For each of images of white solid, half-tone, and black solid formed in the initial stage, the image quality (the presence or absence and the degree of fog) was evaluated.

Carrying Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked and the weight of the toner thin layer was measured, whereby the carried amount of toner was examined.

Charging Performance of Toner

A roller to be tested was incorporated as a development roller in the printer cartridge shown in FIG. 2, and was rotated at a linear velocity (circumferential speed) of 50 mm/sec, to form a uniform toner thin layer on the surface of the development roller. The toner thin layer was sucked in a Faraday cage and the charged amount of toner was measured.

Image Fog After Repeated Printing

After the test for evaluating initial image fog, an endurance test was performed. In this endurance test, the printing operation was repeated to print images on 10,000 pieces of sheets, and for each of images, the same image evaluation as that for initial image fog was performed.

Wear of Development Roller

The roller to be tested was taken out of the printer cartridge after the above endurance test, and the surface of the roller was observed by a video microscope, to evaluate the degree of damage and wear of the surface of the roller.

TABLE 11

| | Inventive Example 49 | Inventive Example 50 | Comparative Example 45 | Comparative Example 46 | Comparative Example 47 |
|---|---|---|---|---|---|
| Adhesiveness to OPC | ○ | ○ | x | x | ○ |
| Initial Image Fog | ○ | ○ | ○Δ | x | x |
| Carrying Performance of Toner | ○ | ○ | ○ | x | Δx |
| Charging Performance of Toner | ○ | ○ | ○Δ | x | x |
| Fog After Repeated Printing | ○ | ○ | Δx | x | x |
| Wear of Development Roller | ○ | ○ | x | x | ○Δ |

Criteria for Evaluation
○: very good
○Δ: good
Δ: ordinary
Δx: slightly poor
x: poor Inventive Example 51

Transfer Member

A paint 110 was prepared by dissolving a urethane resin (trade name: DP307, produced by Sanyo Chemical Industries, Ltd.) in MEK as a solvent and adding a prepolymer obtained from a both-terminal alcohol modified silicone oil (trade name: FZ-3711, produced by Japan Yunika Co., Ltd.) by means of di-functionality isocyanate in an amount of 30 parts by weight on the basis of 100 parts by weight of the urethane resin, and further adding a powder of carbon in an amount of 20 parts by weight on the basis of 100 parts by weight of the urethane resin and an isocyanate crosslinking agent with an NCO index set to 1.5. A sheet was formed by drying the paint 110. The contact angle between the sheet and water was measured, the result of which was 95°.

A urethane foam roller was produced by forming an elastic layer (thickness: 5 mm, volume resistivity: $1\times10^5$ Ω·cm) around the outer periphery of a metal shaft. The elastic layer was made from a urethane foam with its resistance adjusted by adding a conductive agent (carbon black) thereto. The urethane foam roller was dipped in the above paint 110, followed by drying, to form an outermost resin layer 110 having a thickness of about 10 μm on the urethane foam elastic layer of the roller. A transfer roller having the same layer configuration as that shown in FIG. 1(A) was thus produced.

The surface potential of the roller thus produced was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 9 V and the surface potential of the roller after 10 sec was 1.32 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.18.

Comparative Example 48

Transfer Member

A paint 111 was prepared by suitably adjusting the concentration of a water-based urethane resin (trade name: SuperFlex 420, produced by Dai-ichi Kogyo Seiyaku Co., Ltd.) and adding a powder of carbon in an amount of 20 parts by weight on the basis of 100 parts by weight of the urethane resin. A sheet was formed by drying the paint 111. The contact angle between the sheet and water was measured, the result of which was 76°.

The same urethane foam roller as that in Inventive Example 51 was dipped in the above paint 111, followed by drying, to form an outermost resin layer 111 having a thickness of about 10 μm on the urethane foam elastic layer of the roller. A transfer roller having the same layer configuration as that shown in FIG. 1(A) was thus produced.

A transfer roller was produced in the same manner as that described above except that carbon as a conductive agent was not added to the outermost resin layer 111. The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 550 V and the surface potential of the roller after 10 sec was 340 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 1.78.

Each of the transfer rollers in Inventive Example 51 and Comparative Example 53 was pressed to a photosensitive drum at a load of 1 kg, and was left for two weeks under an environment with a temperature of 50° C. and a humidity of 85% RH. As a result, the roller in Inventive Example 51 did not cause any problem, while the roller in Comparative Example 48 caused adhesion and contamination between the roller and the photosensitive drum. Each of the transfer rollers in Inventive Example 51 and Comparative Example 48 was then incorporated in a laser printer, and the printer was operated to print images on 5,000 pieces of sheets. As a result, the roller in Inventive Example 51 did not cause any problem, while the roller in Comparative Example 48 caused spot omissions of characters in images and contamination of the back surfaces of transfer sheets due to toner contamination on the surface of the roller.

Inventive Example 52

Cleaning Member

A cleaning roller having the same layer configuration as that shown in FIG. 1(B) was produced by forming an elastic layer (thickness: 3 mm, volume resistivity: $1\times10^3$ Ω·cm) made from a conductive urethane foam around the outer periphery of a metal shaft, forming the following intermediate resin layer 112 having a thickness of 100 μm on the surface of the elastic layer, and forming the following outermost resin layer 113 having a thickness of 10 μm thereon.

Intermediate Resin Layer 112

The intermediate resin layer 112 was formed by coating the elastic layer with a paint prepared by adding carbon to a water-based acrylic resin by a dipping method. The volume resistivity was adjusted to $5\times10^7$ Ω·cm.

Outermost Resin Layer 113

A paint 113 was prepared by dissolving a urethane resin (trade name: DP307, produced by Sanyo Chemical Industries, Ltd.) in MEK as a solvent and adding a prepolymer obtained from a both-terminal alcohol modified silicone oil (trade name: FZ-3711, produced by Japan Yunika Co., Ltd.) by means of di-functionality isocyanate in an amount of 30 parts by weight on the basis of 100 parts by weight of the urethane resin, and adding an isocyanate crosslinking agent with an NCO index set to 1.5. The intermediate resin layer 112 was coated with the paint 113 by a dipping method, to form the outermost resin layer 113. A sheet was formed by drying the paint 113. The contact angle between the sheet and water was measured, the result of which was 97°.

The surface roughness of the cleaning roller was 0.6 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 4 V and the surface potential of the roller after 10 sec was 0.18 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 0.28.

The cleaning roller was incorporated in a printer cartridge, and was left for two weeks under an environment with a temperature of 40° C. and a humidity of 95% RH. As a result, any adhesion was not observed between the roller and a photosensitive drum. The printer cartridge was operated for image formation, as a result of which desirable images were obtained. The printing operation was continuously performed to form images on 8,000 pieces of sheets, as a result of which any degradation of images was not observed.

Comparative Example 49

Cleaning Member

A cleaning roller having the same layer configuration as that shown in FIG. 1(B) was produced by forming the same intermediate resin layer 112 as that in Inventive Example 52 on the surface of the same elastic layer as that in Inventive Example 52, and forming the following outermost resin layer 114 having a thickness of 10 μm thereon.

Outermost Resin Layer 114

A paint 114 was prepared by suitably adjusting the concentration of a water-based urethane resin (trade name: SuperFlex 420, produced by Dai-ichi Kogyo Seiyaku Co., Ltd.). The intermediate resin layer 112 was coated with the paint 114 by a dipping method, to form the outermost resin layer 114. A sheet was formed by drying the paint 114. The contact angle between the sheet and water was measured, the result of which was 77°.

The surface roughness of the cleaning roller was 0.5 μm in Rz (ten point average roughness specified in JIS). The surface potential of the roller was measured by disposing a corona discharger with a gap of 1 mm put between the surface of the roller and the corona discharger, and applying a voltage of 8 kV to the corona discharger to generate corona discharge, thereby electrically charging the surface of the roller. As a result, the maximum value of the surface potential of the roller after 0.3 sec was 590 V and the surface potential of the roller after 10 sec was 370 V. The roller was then subjected to friction testing using a cloth of 70 mesh containing 100% of cellulose (density: 30 g/m$^2$) by a measurement instrument shown in FIG. 4 under a condition with a temperature of 22° C. and a humidity of 50% RH. The result showed that the friction coefficient of the roller was 2.2.

The cleaning roller was incorporated in a printer cartridge, and was left for two weeks under an environment with a temperature of 40° C. and a humidity of 95% RH. As a result, adhesion occurred between the roller and a photosensitive drum. The printer cartridge was operated for image formation, as a result of which contamination having one streak pattern extending in the lateral direction was observed periodically in the rotational direction of the photosensitive drum, and fog in white solid due to defective cleaning occurred during image formation.

What is claimed is:

1. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing, as a base resin component, a resin containing fluorine-containing acrylic monomers in an amount of 0.05 to 80 wt %.

2. A conductive member according to claim 1, wherein said basic resin component of said resin material forming said outermost resin layer is a urethane modified acrylic resin containing fluorine-containing acrylic monomers; and said urethane modified acrylic resin contains an acrylic resin component in an amount of 5 to 80 wt %, and 1 to 90 wt % of acrylic monomers in said acrylic resin component contain fluorine.

3. A conductive member according to claim 1, wherein said basic resin component of said resin material forming said outermost resin layer is a urethane modified acrylic resin containing fluorine-containing acrylic monomers; and said urethane modified acrylic resin contains a silicone component in an amount of 1 to 60 wt %.

4. A conductive member according to claim 1, wherein said outermost resin layer contains an isocyanate crosslinking agent having a functionality of two or more.

5. A conductive member according to claim 1, wherein a surface roughness of said conductive member, which is expressed by ten point average roughness Rz specified in JIS-B 0601, is in a range of 4 $\mu$m or less.

6. A conductive member according to claim 1, wherein said resin material forming said outermost resin layer contains a conductive agent.

7. A conductive member according to claim 6, wherein said conductive agent is a conductive powder.

8. A conductive member according to claim 1, wherein said elastic layer is made from one kind or two or more kinds selected from a group consisting of a polyurethane, silicone rubber, and ethylene-propylene-rubber.

9. A conductive member according to claim 1, wherein said elastic layer is made from a urethane foam having a density ranging from 0.05 to 0.9 g/cm$^3$.

10. A conductive member according to claim 1, wherein said conductive member is used as a charging member for charging a body to be charged such as a photosensitive drum by bringing said charging member into contact with said body to be charged and applying a voltage between said body to be charged and said charging member.

11. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin and, wherein said outermost resin layer is made from a resin material containing 50 wt % or more of a polyamide resin and 50 wt % or less of a polysiloxane component.

12. A conductive member according to claim 11, wherein the content of said polyamide resin in said resin material forming said outermost resin layer is in a range of 50 to 99 wt %, and the content of said polysiloxane component in said resin material forming said outermost resin layer is in a range of 1 to 50 wt %.

13. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing 50 wt % or more of a urethane modified acrylic resin and 50 wt % or less of a fluororesin component and/or a fluorine compound component.

14. A conductive member according to claim 13, wherein the content of said urethane modified acrylic resin in said resin material forming said outermost resin layer is in a range of 50 to 99.9 wt % and the content of said fluororesin component and/or said fluorine compound component in said resin material forming said outermost resin layer is in a range of 0.1 to 50 wt %.

15. A conductive member according to claim 13, wherein said urethane modified acrylic resin contains a silicone component in an amount of 1 to 60 wt %.

16. A conductive member according to claim 13, wherein said resin material forming said outermost resin layer contains an isocynate crosslinking agent having a functionality of two or more.

17. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing 50 wt % or more of a urethane resin and 50 wt % or less of a fluororesin component and/or a fluorine compound component.

18. A conductive member according to claim 17, wherein the content of said urethane resin in said resin material forming said outermost resin layer is in a range of 50 to 99.9 wt % and the content of said fluororesin component and/or said fluorine compound component in said resin material forming said outermost resin layer is in a range of 0.1 to 50 wt %.

19. A conductive member according to claim 17, wherein said resin material forming said outermost resin layer contains an isocyanate crosslinking agent having a functionality of two or more.

20. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing 50 wt % or more of an acrylic resin and 50 wt % or less of a fluororesin component and/or a fluorine compound component.

21. A conductive member according to claim 20, wherein a relative dielectric constant of said resin material forming said outermost resin layer in a state that said resin material does not contain any conductive agent is in a range of 7.5 or less.

22. A conductive member according to claim 21, wherein a relative dielectric constant of said resin material forming said outermost resin layer in a state that the volume resistivity of said resin material is adjusted to $1\times10^8$ Ω·cm by adding a conductive agent thereto is in a range of 35 or less.

23. A conductive member according to claim 20, wherein the content of said acrylic resin in said resin material forming said outermost resin layer is in a range of 50 to 99 wt % and the content of said fluororesin component and/or said fluorine compound component in said resin material forming said outermost resin layer is in a range of 1 to 50 wt %.

24. A conductive member according to claim 20, wherein a glass transition temperature of said acrylic resin in said resin material forming said outermost resin layer is in a range of −60 to 50° C.

25. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing 50 wt % or more of a polyamide resin and 50 wt % or less of a fluororesin component and/or a fluorine compound component.

26. A conductive member according to claim 28, wherein the content of said polyamide resin in said resin material forming said outermost resin layer is in a range of 50 to 99.9 wt % and the content of said fluororesin component and/or said fluorine compound component is in a range of 0.1 to 50 wt %.

27. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein said resin layer contains one kind or two or more kinds selected from a group consisting of a fluororesin, a fluorine compound, a urethane resin, a urethane modified acrylic resin, a polyamide resin, an acrylic resin, a fluorine-containing acrylic monomer, a polysiloxane component, and a phenol resin, and wherein said outermost resin layer is made from a resin material containing 50 wt % or more of a urethane resin and 50 wt % or less of a polysiloxane component.

28. A conductive member according to claim 27, wherein the content of said urethane resin in said resin material forming said outermost resin layer is in a range of 50 to 95 wt % and the content of said polysiloxane component in said resin material forming said outermost resin layer is in a range of 5 to 50 wt %.

29. A conductive member according to claim 27, wherein said resin material forming said outermost resin layer contains an isocyanate crosslinking agent having a functionality of two or more.

30. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein a friction coefficient of said conductive member, which is measured by bringing said conductive member in press-contact with a cloth of 70 mesh containing 100% of cellulose (density: 30 g/m$^2$) at a load of 100 gf and sliding said conductive member against the cloth, is in a range of 1 or less.

31. A conductive member according to claim 30, wherein said friction coefficient is in a range of 0.5 or less.

32. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein a contact angle between the surface of said outermost resin layer and water is in a range of 90° or more.

33. A conductive member used for an electrophotographic apparatus, comprising:

an elastic layer; and at least one resin layer formed on said elastic layer;

wherein when the surface of the outermost resin layer of said at least one resin layer, which outermost resin layer is in a state not containing any conductive agent, is charged due to corona discharge generated by applying a voltage of 8 kV to a corona discharger disposed with a gap of 1 mm put between the surface of said outermost resin layer and said corona discharger, a surface potential of said outermost resin layer after an elapse of 0.3 sec is in a range of 50 V or less and a surface potential of said outermost resin layer after an elapse of 10 sec is in a range of 5 V or less, wherein a residual elongation of said resin material forming said outermost resin layer is specified such that when a film made from said resin material and having the same thickness as that of said outermost resin layer is stretched to a length being 1.5 times the original length under an environment with a temperature of 40° C. and a humidity of 95% RH and is left for one day in such a state, a residual elongation of said film is in a range of 50% or less.

34. An electrophotographic apparatus comprising:

a charging unit including a charging member to be brought into contact with a body to be charged for charging said body to be charged, and means for applying a voltage between said body to be charged and said charging member, wherein said charging member of said charging unit is configured as said conductive member described in claim 1.

35. An electrophotographic apparatus according to claim 34, wherein said body to be charged is a latent image support such as a photosensitive drum.

36. An electrophotographic apparatus comprising:

a development unit operated to support a developer on the surface of said conductive member described in claim 1 so as to form a thin film of the developer, and bring said conductive member into contact with a latent image support on the surface of which an electrostatic latent image has been formed so as to stick the developer on the electrostatic latent image formed on the surface of said latent image support, thereby visualizing the electrostatic latent image.

37. An electrophotographic apparatus comprising:

a transfer unit operated to charge a transfer medium by using said conductive member described in claim 1, visualize an electrostatic latent image by a developer, and transfer the visualized electrostatic latent image to said transfer medium.

38. An electrophotographic apparatus comprising:

a cleaning unit operated to remove a developer remaining on a latent image support by using said conductive member described in claim 1.

* * * * *